US011250767B2

(12) United States Patent
Park et al.

(10) Patent No.: US 11,250,767 B2
(45) Date of Patent: Feb. 15, 2022

(54) GATE DRIVING CIRCUIT AND LIGHT EMITTING DISPLAY APPARATUS COMPRISING THE SAME

(71) Applicant: LG Display Co., Ltd., Seoul (KR)

(72) Inventors: JaeKyu Park, Paju-si (KR); SooHong Choi, Paju-si (KR); HongJae Shin, Paju-si (KR); Seongho Yun, Paju-si (KR); Jeongrim Seo, Paju-si (KR)

(73) Assignee: LG DISPLAY CO., LTD., Seoul (KR)

( * ) Notice: Subject to any disclaimer, the term of this patent is extended or adjusted under 35 U.S.C. 154(b) by 0 days.

(21) Appl. No.: 17/129,412

(22) Filed: Dec. 21, 2020

(65) Prior Publication Data

US 2021/0201767 A1 Jul. 1, 2021

(30) Foreign Application Priority Data

Dec. 31, 2019 (KR) ..... 10-2019-0180144

(51) Int. Cl.
*G09G 3/32* (2016.01)

(52) U.S. Cl.
CPC ..... *G09G 3/32* (2013.01); *G09G 2300/0809* (2013.01); *G09G 2310/0291* (2013.01); *G09G 2310/08* (2013.01)

(58) Field of Classification Search
CPC ..... G09G 3/32; G09G 2310/08; G09G 2310/0291; G09G 2300/0809
See application file for complete search history.

(56) References Cited

U.S. PATENT DOCUMENTS

| | | | | |
|---|---|---|---|---|
| 10,547,316 | B2 | 1/2020 | Takasugi et al. | |
| 2016/0189595 | A1* | 6/2016 | Choi | G09G 3/2074 345/212 |
| 2016/0293001 | A1* | 10/2016 | Xu | G08G 1/0133 |
| 2017/0344179 | A1 | 11/2017 | Kim et al. | |
| 2018/0337682 | A1 | 11/2018 | Takasugi et al. | |
| 2019/0180691 | A1* | 6/2019 | Takasugi | G09G 3/3233 |
| 2019/0189060 | A1 | 6/2019 | Takasugi | |
| 2019/0265835 | A1* | 8/2019 | Shin | G06F 3/04166 |

FOREIGN PATENT DOCUMENTS

| | | | |
|---|---|---|---|
| KR | 10-2016-0073928 | A | 6/2016 |
| KR | 10-2017-0079775 | A | 7/2017 |
| KR | 10-2018-0066375 | A | 6/2018 |
| KR | 10-2018-0128123 | A | 12/2018 |
| TW | 201705110 | A | 2/2017 |
| TW | 202036514 | A | 10/2020 |

* cited by examiner

*Primary Examiner* — Muhammad N Edun
(74) *Attorney, Agent, or Firm* — Birch, Stewart, Kolasch & Birch, LLP

(57) ABSTRACT

A gate driving circuit and a light emitting display apparatus comprising the same are discussed, in which a charging characteristic of a control node is improved. The gate driving circuit comprises first to mth stage circuits, wherein each of the first to mth stage circuits includes first to third control nodes, a node control circuit controlling a voltage of each of the first to third control nodes, and an output buffer circuit outputting each of a scan signal, a sense signal and a carry signal in accordance with each of the first to third control nodes, the node control circuit including a node setup circuit charging a first gate high potential voltage in the first control node in response to a first carry signal supplied from a front stage circuit.

19 Claims, 21 Drawing Sheets

GATE DRIVING CIRCUIT AND LIGHT EMITTING DISPLAY APPARATUS COMPRISING THE SAME

CROSS-REFERENCE TO RELATED APPLICATIONS

This application claims the benefit of and priority to the Korean Patent Application No. 10-2019-0180144 filed on Dec. 31, 2019 in the Republic of Korea, the entire contents of which are hereby expressly incorporated by reference as if fully set forth herein into the present application.

BACKGROUND

Technical Field

The present disclosure relates to a gate driving circuit and a light emitting display apparatus comprising the same.

Description of the Related Art

Since a light emitting display apparatus displays an image by using a self-light emitting diode, the light emitting display apparatus has a fast response speed, low power consumption, and a good viewing angle, and thus, are attracting much attention as the next-generation display apparatus.

The light emitting display apparatus can include pixels having a light emitting diode and a pixel circuit that drives the light emitting diode. For example, the pixel circuit includes a driving thin film transistor controlling a driving current flowing to the light emitting diode, and at least one switching thin film transistor controlling (or programming) a gate-source voltage of the driving thin film transistor in accordance with a scan signal. The switching thin film transistor of the pixel circuit can be switched by an output signal of a gate driving circuit directly formed in a substrate of a display panel. For example, the gate driving circuit can output a signal for switching the switching thin film transistor of the pixel circuit in accordance with a voltage of a control node.

Recently, a technique for inserting a black image to shorten a motion picture response time in a light emitting display apparatus has been suggested. The black image insertion technique can shorten the motion picture response time by displaying a black image between adjacent frames to remove an influence of an image of a previous frame on an image of next frame.

An external compensation technique has been used to enhance quality of an image displayed in the light emitting display apparatus. The external compensation technique can compensate for a driving characteristic deviation between pixels by sensing a pixel voltage or current based on a driving characteristic (or electric characteristic) of the pixels and modulating data of an input image based on the sensed result.

However, in the gate driving circuit of the light emitting display apparatus of the related art, a charging characteristic of the control node can be deteriorated due to a threshold voltage change of a thin film transistor, whereby the gate driving circuit can output an abnormal signal or can be operated in error due to a voltage drop (IR Drop) of a gate driving voltage based on a leakage current of the thin film transistor connected to the control node.

The light emitting display apparatus to which the black image insertion technique and/or the external compensation technique is applied sequentially displays black images on a basis of a horizontal line (or horizontal pixel line). As the black image is displayed within one frame in accordance with charging characteristic deterioration of the control node, which is generated in the gate driving circuit, or a leakage current of the thin film transistor connected to the control node, or a time for sensing a driving characteristic of a pixel is not enough, a defect in picture quality is generated, whereby reliability can be deteriorated due to such a defect in picture quality.

The disclosure of the above-described background art is owned by the inventor(s) of the present disclosure to devise this specification or is technical information acquired by a process of devising this specification, but cannot be regarded as a known art disclosed to the general public before this specification is disclosed.

SUMMARY OF THE INVENTION

The present disclosure has been made in view of the above issues, and it is an object of the present disclosure to provide a gate driving circuit and a light emitting display apparatus comprising the same, in which a charging characteristic of a control node is improved.

It is another object of the present disclosure to provide a gate driving circuit and a light emitting display apparatus comprising the same, in which a voltage drop of a gate driving voltage is minimized by a leakage current of a thin film transistor connected to a control node.

In addition to the objects of the present disclosure as mentioned above, additional objects and features of the present disclosure will be clearly understood by those skilled in the art from the following description of the present disclosure.

A gate driving circuit according to one embodiment of the present disclosure comprises first to mth stage circuits where m is a positive number such as an integer equal to or greater than 2, wherein each of the first to mth stage circuits includes first to third control nodes, a node control circuit controlling a voltage of each of the first to third control nodes, and an output buffer circuit outputting each of a scan signal, a sense signal and a carry signal in accordance with each of the first to third control nodes, the node control circuit including a node setup circuit charging a first gate high potential voltage in the first control node in response to a first carry signal supplied from a front stage circuit.

A light emitting display apparatus according to one embodiment of the present disclosure comprises a light emitting display panel including a plurality of pixels, a plurality of gate line groups having first and second gate lines connected to the plurality of pixels, and a plurality of data and reference lines connected to the plurality of pixels, crossing the plurality of gate line groups; a gate driving circuit portion connected to the plurality of gate line groups; a data driving circuit portion connected to the plurality of data lines and the plurality of reference lines; and a timing controller controlling a driving timing of each of the gate driving circuit portion and the data driving circuit portion, wherein the gate driving circuit comprises first to mth stage circuits, each of the first to mth stage circuits including first to third control nodes, a node control circuit controlling a voltage of each of the first to third control nodes, and an output buffer circuit outputting each of a scan signal, a sense signal and a carry signal in accordance with each of the first to third control nodes, and the node control circuit including a node setup circuit charging a first gate high potential voltage in the first control node in response to a first carry signal supplied from a front stage circuit.

Details according to various embodiments of the present disclosure in addition to the above objects are included in the detailed description and drawings.

According to one embodiment of the present disclosure, a gate driving circuit and a light emitting display apparatus comprising the same can be provided, in which a charging characteristic of a control node is improved.

According to one embodiment of the present disclosure, a gate driving circuit and a light emitting display apparatus comprising the same can be provided, in which a voltage drop of a gate driving voltage is minimized by a leakage current of a thin film transistor connected to a control node.

In addition to the effects of the present disclosure as mentioned above, additional advantages and features of the present disclosure will be clearly understood by those skilled in the art from the above description of the present disclosure.

BRIEF DESCRIPTION OF THE DRAWINGS

The above and other objects, features and other advantages of the present disclosure will be more clearly understood from the following detailed description taken in conjunction with the accompanying drawings, in which.

DETAILED DESCRIPTION OF THE EMBODIMENTS

Figure 1:
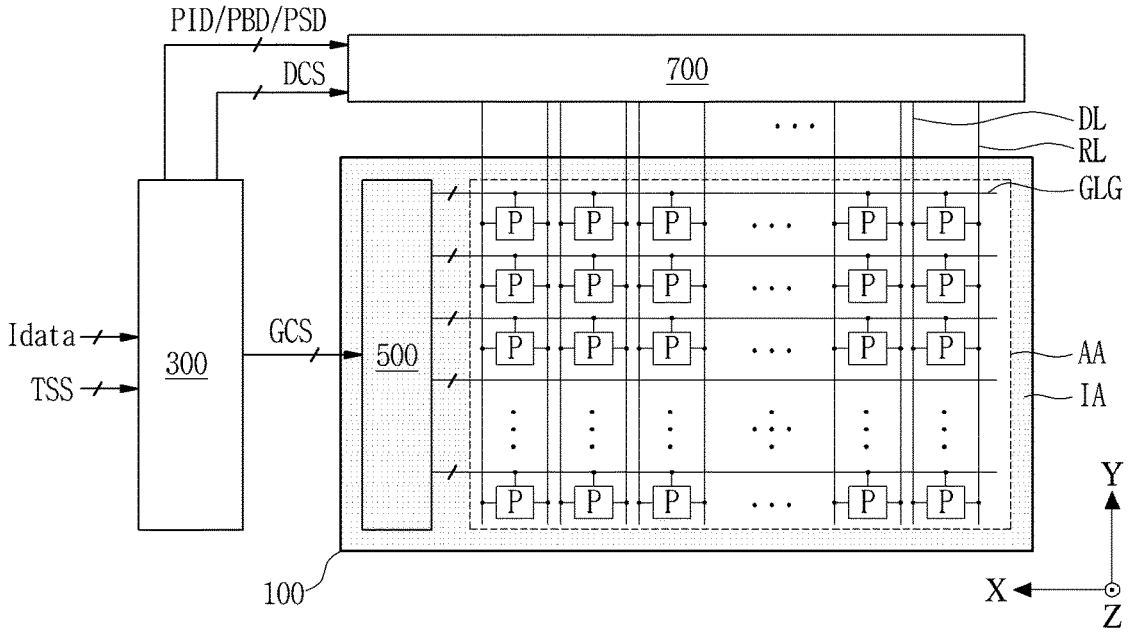
FIG. 1 is a view illustrating a light emitting display apparatus according to one embodiment of the present disclosure.

Advantages and features of the present disclosure, and implementation methods thereof will be clarified through following embodiments described with reference to the accompanying drawings. The present disclosure can, however, be embodied in different forms and should not be construed as limited to the embodiments set forth herein. Rather, these embodiments are provided so that this disclosure will be thorough and complete, and will fully convey the scope of the present disclosure to those skilled in the art. Further, the present disclosure is only defined by scopes of claims.

A shape, a size, a ratio, an angle, and a number disclosed in the drawings for describing embodiments of the present disclosure are merely an example, and thus, the present disclosure is not limited to the illustrated details. Like reference numerals refer to like elements throughout the specification. In the following description, when the detailed description of the relevant known function or configuration is determined to unnecessarily obscure the important point of the present disclosure, the detailed description will be omitted.

In a case where 'comprise', 'have', and 'include' described in the present disclosure are used, another part can be added unless 'only-' is used. The terms of a singular form can include plural forms unless referred to the contrary.

In construing an element, the element is construed as including an error range although there is no explicit description.

In describing a position relationship, for example, when the position relationship is described as 'upon-', 'above-', 'below-', and 'next to-', one or more portions can be arranged between two other portions unless 'just' or 'direct' is used.

In describing a time relationship, for example, when the temporal order is described as 'after-', 'subsequent-', 'next-', and 'before-', a case which is not continuous can be included unless 'just' or 'direct' is used.

It will be understood that, although the terms "first", "second", etc. can be used herein to describe various elements, these elements should not be limited by these terms. These terms are only used to distinguish one element from another and may not define any order. For example, a first element could be termed a second element, and, similarly, a second element could be termed a first element, without departing from the scope of the present disclosure.

The term "at least one" should be understood as including any and all combinations of one or more of the associated listed items. For example, the meaning of "at least one of a first item, a second item, and a third item" denotes the combination of all items proposed from two or more of the first item, the second item, and the third item as well as the first item, the second item, or the third item.

Features of various embodiments of the present disclosure can be partially or overall coupled to or combined with each other, and can be variously inter-operated with each other and driven technically as those skilled in the art can sufficiently understand. The embodiments of the present disclosure can be carried out independently from each other, or can be carried out together in co-dependent relationship.

In the present disclosure, a pixel circuit and a gate driving circuit, which are formed on a substrate of a light emitting display panel, can be embodied as n-type MOSFET type thin film transistors but are not limited thereto. The pixel circuit and the gate driving circuit can be embodied as p-type MOSFET type thin film transistors. The thin film transistor can include a gate, a source, and a drain. In the thin film transistor, a carrier moves from the source to the drain. In the n-type thin film transistor, since the carrier is an electron, a source voltage is lower than a drain voltage such that the electron can move from the source to the drain. In the n-type thin film transistor, since the electron moves from the source to the drain, a current moves from the drain to the source. In the p-type thin film transistor, since the carrier is a hole, the source voltage is higher than the drain voltage in order for the hole to move from the source to the drain. In the p-type thin film transistor, since the hole moves from the source to the drain, a current moves from the source to the drain. In the MOSFET type thin film transistor, the source and the drain are not fixed but can be changed depending on a voltage applied thereto. Therefore, in the description of the embodiment according to the present disclosure, a description will be given based on that any one of the source and the drain is referred to as a first source/drain electrode and the other one of the source and the drain is referred to as a second source/drain electrode.

Hereinafter, a gate driving circuit and a light emitting display apparatus comprising the gate driving circuit according to the present disclosure will be described in detail with reference to the accompanying drawings. Wherever possible, the same reference numbers will be used throughout the drawings to refer to the same or like parts. Since a scale of each of elements shown in the accompanying drawings is different from an actual scale for convenience of description, the present disclosure is not limited to the shown scale.

Figure 2:
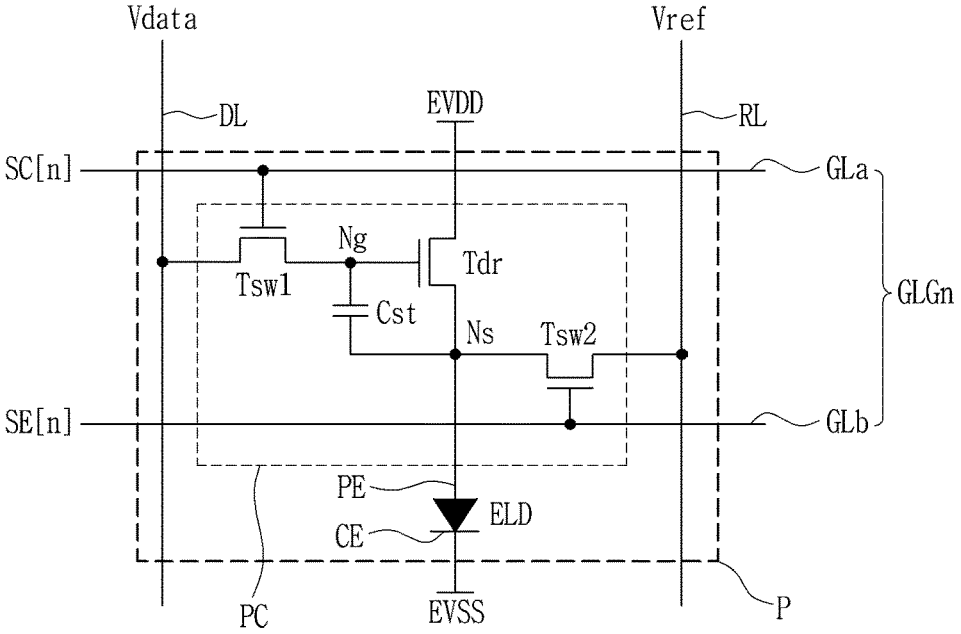
FIG. 2 is an equivalent circuit view illustrating a pixel shown in FIG. 1.
Figure 3:
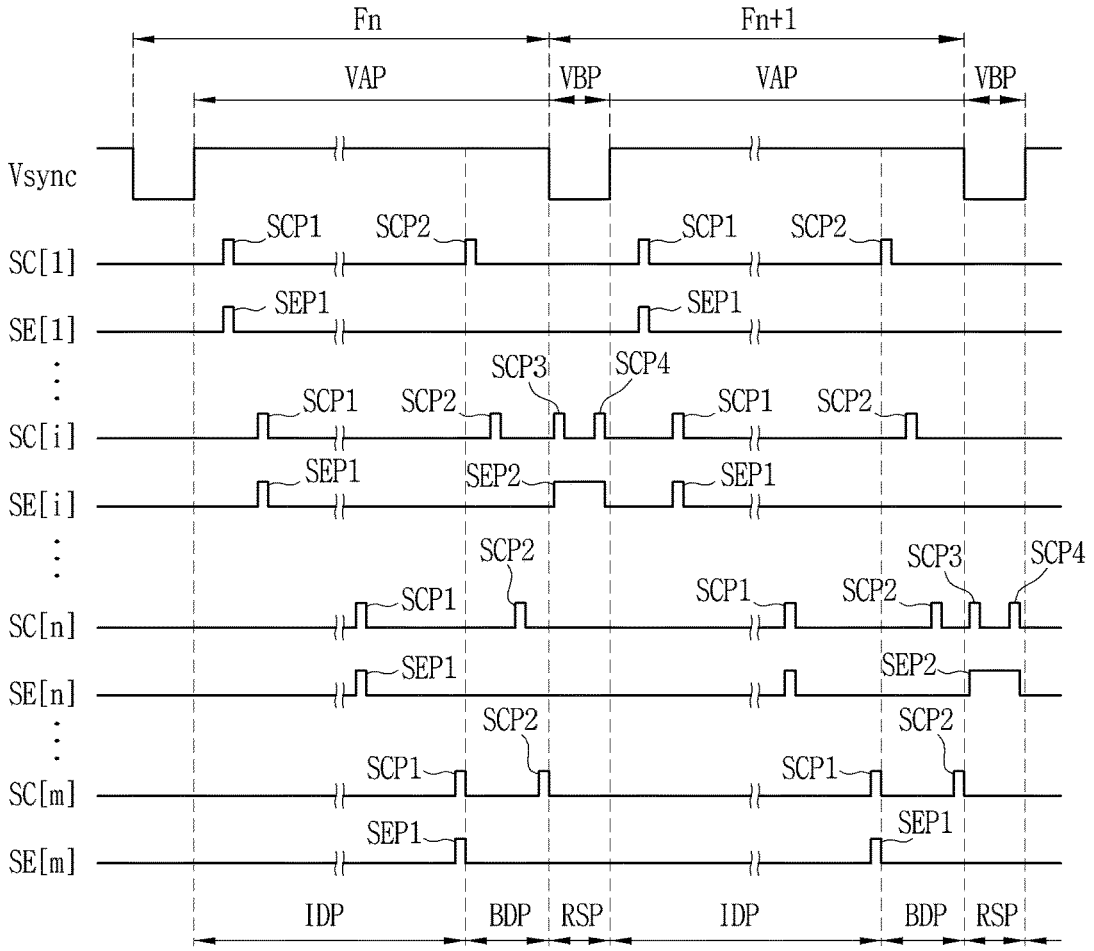
FIG. 3 is a waveform illustrating an output signal of a gate driving circuit according to one embodiment of the present disclosure.

FIG. 1 is a view illustrating a light emitting display apparatus according to one embodiment of the present disclosure, FIG. 2 is an equivalent circuit view illustrating a pixel shown in FIG. 1, and FIG. 3 is a waveform illustrating an output signal of a gate driving circuit according to one embodiment of the present disclosure. All the components of the light emitting display apparatus according to all embodiments of the present disclosure are operatively coupled and configured.

Referring to FIGS. 1 to 3, the light emitting display apparatus according to one embodiment of the present disclosure can include a light emitting display panel 100, a timing controller 300, a gate driving circuit portion 500, and a data driving circuit portion 700.

The light emitting display panel 100 can include a display area AA (or active area) defined on a substrate, and a non-display area IA (or inactive area) surrounding the display area AA.

The display area AA can include a plurality of gate line groups GLG, a plurality of data lines DL, a plurality of reference lines RL and a plurality of pixels P.

Each of the plurality of gate line groups GLG can longitudinally be extended along a first direction X, and can be disposed on the substrate to be spaced apart from another gate line group along a second direction Y crossing the first direction X. Each of the gate line groups GLG can include a first gate line (scan signal line) GLa and a second gate line (sense signal line) GLb.

Each of the plurality of data lines DL can longitudinally be extended along the second direction Y, and can be disposed on the substrate to be spaced apart from another data line along the first direction X.

Each of the plurality of reference lines RL can be disposed on the substrate to be parallel with each of the plurality of data lines DL. For example, the reference lines RL can be expressed as sensing lines.

Each of the plurality of pixels P can be disposed in a pixel area defined by the plurality of gate line groups GLG and the plurality of data lines DL.

Each of the plurality of pixels P according to one embodiment can be a red pixel, a green pixel or a blue pixel. In this case, the red pixel, the green pixel and the blue pixel can embody one unit pixel.

Each of the plurality of pixels P according to another embodiment can be a red pixel, a green pixel, a blue pixel or a white pixel. In this case, the red pixel, the green pixel, the blue pixel and the white pixel, which are adjacent to one another, can embody one unit pixel for displaying one color image.

The display area AA can further include a plurality of horizontal lines or a plurality of horizontal pixel lines along a length direction of each of the plurality of gate line groups GLG. The pixels P disposed in each horizontal line or horizontal pixel line can commonly be connected to the same gate line group GLG.

Each of the plurality of pixels P can include a light emitting diode ELD, and a pixel circuit PC for controlling light emission of the light emitting diode ELD.

The pixel circuit PC can be switched in accordance with a signal supplied through the gate line group GLG adjacent thereto, to output a data current based on a differential voltage Vdata−Vref of a data voltage Vdata supplied through the data line DL adjacent thereto and a reference voltage Vref supplied through the reference line RL adjacent thereto.

The pixel circuit PC according to one embodiment can include a first switching thin film transistor Tsw1, a second switching thin film transistor Tsw2, a driving thin film transistor Tdr, and a storage capacitor Cst. In the following description, the thin film transistor will be referred to as "TFT".

At least one of the first switching TFT Tsw1, the second switching TFT Tsw2 and the driving TFT Tdr can be a-Si TFT, poly-Si TFT, Oxide TFT, or Organic TFT. For example, in the pixel circuit PC, some of the first switching TFT Tsw1, the second switching TFT Tsw2 and the driving TFT Tdr can be a TFT that includes a semiconductor layer (or active layer) made of low-temperature poly-Si (LTPS) having an excellent response characteristic, and the other of the first switching TFT Tsw1, the second switching TFT Tsw2 and the driving TFT Tdr can be a TFT that includes a semiconductor layer (or active layer) made of oxide having an excellent off current characteristic.

The first switching TFT Tsw1 includes a gate electrode connected to the first gate line GLa of the gate line group GLG, a first source/drain electrode connected to the data line DL adjacent thereto, and a second source/drain electrode connected to a gate node Ng of the driving TFT Tdr. The first switching TFT Tsw1 supplies the data voltage Vdata supplied through the data line DL adjacent thereto, to the gate node Ng of the driving TFT Tdr in accordance with scan signals SC[1] to SC[n] supplied through the first gate line GLa, where n can be a positive number such as an integer equal to or greater than 2.

The second switching TFT Tsw2 includes a gate electrode connected to the second gate line GLb of the gate line group GLG, a first source/drain electrode connected to a source node Ns of the driving TFT Tdr, and a second source/drain electrode connected to the reference line RL adjacent thereto. The second switching TFT Tsw2 supplies the reference voltage Vref supplied through the reference line RL adjacent thereto, to a source node Ns of the driving TFT Tdr in accordance with sense signals SE[1] to SE[m] supplied through the second gate line GLb, where m can be a positive number such as an integer equal to or greater than 2.

The storage capacitor Cst can be formed between the gate node Ng and the source node Ns of the driving TFT Tdr. The storage capacitor Cst according to one embodiment can include a first capacitor electrode connected with the gate node Ng of the driving TFT Tdr, a second capacitor electrode connected with the source node Ns of the driving TFT Tdr, and a dielectric layer formed in an overlap area between the first capacitor electrode and the second capacitor electrode. Such a storage capacitor Cst charges a differential voltage between the gate node Ng and the source node Ns of the driving TFT Tdr and then switches the driving TFT Tdr in accordance with the charged voltage.

The driving TFT Tdr can include a gate electrode (or gate node Ng) commonly connected to the second source/drain electrode of the first switching TFT Tsw1 and the first capacitor electrode of the storage capacitor Cst, a first source/drain electrode (or source node Ns) commonly connected to the first source/drain electrode of the second switching TFT Tsw2, the second capacitor electrode of the storage capacitor Cst and the light emitting diode ELD, and a second source/drain electrode (or drain node) connected to a pixel driving power source EVDD. The driving TFT Tdr can be turned on by the voltage of the storage capacitor Cst to control the amount of a current flowing from the pixel driving power source EVDD to the light emitting diode ELD.

The light emitting diode ELD emits light in accordance with the data current supplied from the pixel circuit PC to emit light of luminance corresponding to the data current.

The light emitting diode ELD according to one embodiment can include a pixel electrode (or anode electrode) PE electrically connected with the pixel circuit PC, a self-light emitting diode, and a common electrode (or cathode electrode) CE disposed on the self-light emitting diode and connected to a pixel common power source EVSS.

The pixel electrode PE can be disposed in a light emitting area (or opening area) defined in the pixel P and electrically be connected with the source node Ns of the pixel circuit PC through a contact hole disposed in an insulating layer (or planarization layer) that covers the pixel circuit PC. The pixel electrode PE can be made of a transparent conductive metal material or a reflective metal material depending on a top emission structure or a bottom emission structure of the light emitting diode ELD.

The self-light emitting diode is formed on the pixel electrode PE and is directly in contact with the pixel electrode PE. This light emitting diode ELD emits light in accordance with the data current supplied from the pixel circuit PC to emit light of luminance corresponding to the data current.

The self-light emitting diode according to one embodiment can be a common layer commonly formed in each of the plurality of pixels P so as not to be identified per pixel P. The self-light emitting diode can emit white light by responding to a current flowing between the pixel electrode PE and the common electrode CE. The self-light emitting diode according to one embodiment can include an organic light emitting diode or an inorganic light emitting diode, or can include a deposited or mixture structure of an organic light emitting diode (or inorganic light emitting diode) and a quantum dot light emitting diode.

The organic light emitting diode according to one embodiment includes two or more light emitting material layers (or light emitting portions) for emitting white light. For example, the organic light emitting diode can include first and second light emitting material layers for emitting white light by mixture of first light and second light. In this case, the first light emitting material layer can include at least one of a blue light emitting material, a green light emitting material, a red light emitting material, a yellow light emitting material, and a yellow-green light emitting material. The second light emitting material layer can include at least one of a blue light emitting material, a green light emitting material, a red light emitting material, a yellow light emitting material, and a yellow-green light emitting material to emit second light which can make white light by mixture with the first light emitted from the first light emitting material layer.

The organic light emitting diode according to one embodiment can further include at least one functional layer for improving light emission efficiency and/or lifetime. For example, the functional layer can be disposed in each of an upper portion and/or a lower portion of the light emitting material layer.

The inorganic light emitting diode according to one embodiment can include a semiconductor light emitting diode, a micro light emitting diode, or a quantum dot light emitting diode. For example, when the light emitting diode ELD is an inorganic light emitting diode, the light emitting diode ELD can have, but not limited to, a scale of 1 to 100 micrometers.

The common electrode CE can be disposed on the display area AA, and can directly be in contact with the self-light emitting diode or electrically and directly be in contact with the self-light emitting diode. The common electrode CE can be made of a transparent conductive metal material or a reflective metal material depending on a top emission structure or a bottom emission structure of the light emitting diode ELD.

The number of the gate lines GLa and GLb connected to each of the plurality of pixels P can be varied depending on a structure or driving method of the pixel P. For example, when the first switching TFT Tsw1 and the second switching TFT Tsw2 have a two-scan structure in which the TFTs Tsw1 and Tsw2 are driven differently from each other, each pixel P is connected to two gate lines GLa and GLb. When the first switching TFT Tsw1 and the second switching TFT Tsw2 have one scan structure in which the TFTs Tsw1 and Tsw2 are driven equally to each other, each pixel P is connected to one gate line group GLG. In the present disclosure, a description will be given based on the two-scan structure for convenience of description, but technical spirits of the present disclosure are not limited to the two-scan structure.

The timing controller 300 can be embodied to control the light emitting display panel 100 in a display mode and a sensing mode based on a vertical synchronization signal Vsync and a horizontal synchronization signal of timing synchronization signals TSS provided from a display driving system (or host controller).

The display mode of the light emitting display panel 100 can be driving for sequentially displaying an input image and a black image, which have a certain time difference, in a plurality of horizontal lines. The display mode according to one embodiment can include an image display period (or light emitting display period) IDP for displaying an input image, and a black display period (or impulse non-light emission period) for displaying a black image.

The sensing mode (or real-time sensing mode) of the light emitting display panel 100 can be real-time sensing driving for sensing a driving characteristic of the pixels P disposed in one of the plurality of horizontal lines and updating a compensation value per pixel to compensate for a driving characteristic change of the corresponding pixels P based on the sensed value, after the image display period (IDP) in one frame. The sensing mode according to one embodiment can sense driving characteristics of the pixels P disposed in any one of the plurality of horizontal lines in accordance with an irregular order in a vertical blank period VBP of each frame. Since the pixels P emitting light in accordance with the display mode do not emit light in the sensing mode, line dim can occur due to non-light emission of the sensed horizontal line when the horizontal lines are sensed sequentially in the sensing mode. On the other hand, when the horizontal lines are sensed in the sensing mode in an irregular order or a random order, line dim can be minimized or avoided due to a visual dispersion effect.

According to one embodiment, the timing controller 300 can set each frame Fn, Fn+1 for displaying an image on the light emitting display panel 100 to the image display period IDP, the black display period BDP and the real-time sensing period RSP. For example, the timing controller 300 can set a vertical active period VAP of one frame period Fn, Fn+1 to the display period IDP, BDP for the display mode, and can set the vertical blank period VBP to the sensing period (or real time sensing period) RSP for the sensing mode.

The timing controller 300 can vary a duty (or light emission duty) of the image display period IDP by controlling a start timing of the black display period BDP in one frame Fn, Fn+1. The timing controller 300 according to one embodiment can extract a motion vector of input images by comparing and analyzing the input images on a basis of frame Fn, Fn+1, and can vary the start timing of the black display period BDP in accordance with the motion vector of the images. For example, the timing controller 300 can reduce the duty of the image display period IDP by advancing the start timing of the black display period BDP within one frame Fn, Fn+1 if the motion vector of the images is greater than a reference value, thereby increasing maximum instantaneous luminance of the pixel P. As a result, a motion picture response time can be reduced and at the same time motion blurring can be minimized. On the contrary, the timing controller 300 can increase the duty of the image display period IDP by delaying the start timing of the black display period BDP within one frame Fn, Fn+1 if the motion vector of the images is smaller than the reference value, thereby increasing luminance of the pixel P. As a result, a motion picture response time can be reduced and at the same time motion blurring can be minimized.

The timing controller 300 can generate and output a gate control signal GCS and a data control signal DCS for driving the light emitting display panel 100 in the image display period IDP, the black display period BDP and the sensing period RSP based on the timing synchronization signals TSS provided from the display driving system (or host controller).

The data control signal DCS can include a source start pulse, a source sampling clock and a source output enable to control the driving timing of the data driving circuit portion 700.

The gate control signal GCS can include a gate start signal, a first reset signal, a second reset signal, a gate driving clock, and a line sensing preparation signal to control the driving timing of the gate driving circuit portion 500.

The timing controller 300 can generate a respective gate driving clock in each of the image display period IDP, the black display period BDP, and the sensing period RSP. For example, the timing controller 300 can generate an image display gate driving clock in the image display period IDP, a black display gate driving clock in the black display period BDP, and a sensing gate driving clock in the sensing period RSP. The image display gate driving clock, the black display gate driving clock and the sensing gate driving clock can be different from one another.

The timing controller 300 can align input data Idata supplied from the display driving system (or host controller) per image display period IDP of the display mode to be suitable for driving of the light emitting display panel 100 as pixel image data PID and then supply the aligned pixel image data to the data driving circuit portion 700.

The timing controller 300 can generate pixel black data PBD per black display period BDP of the display mode and supply the generated pixel black data PBD to the data driving circuit portion 700. For example, the timing controller 300 can generate a preset non-light emitting gray scale value or black gray scale value of the light emitting diode ELD as pixel black data PBD.

The timing controller 300 can generate pixel sensing data PSD per sensing period RSP of the sensing mode and supply the generated pixel sensing data PSD to the data driving circuit portion 700. For example, the timing controller 300 can generate a gray scale value, which can turn on the driving TFT Tdr of the pixels disposed in a horizontal line to be sensed in the sensing period RSP, as pixel sensing data PSD. At this time, the pixel sensing data PSD corresponding to the pixels constituting a unit pixel can have the same gray scale value or respective gray scale values different per pixel.

The gate driving circuit portion 500 can be disposed in the non-display area IA of the light emitting display panel 100 and electrically connected with the plurality of gate line groups GLG. The gate driving circuit portion 500 can sequentially drive the plurality of gate line groups GLG based on the gate control signal GCS supplied from the timing controller 300.

The gate driving circuit portion 500 can respectively generate a scan signal SC and a sense signal SE respectively corresponding to the image display period IDP, the black display period BDP and the sensing period RSP based on the gate control signal GCS supplied from the timing controller 300, and can supply the generated scan signal SC and sense signal SE to the corresponding gate line group GLG. For example, the gate driving circuit portion 500 sequentially supplies scan signals SC[1] to SC[m] and sense signals SE[1] to SE[m] to the plurality of gate line groups GLG in the vertical active period VAP of each frame period, and can output scan signals SC[i], SC[n] and sense signals SE[i], SE[n] to any one of the gate line groups GLG in the vertical blank period VBP of each frame period.

According to one embodiment, the gate driving circuit portion 500 sequentially supplies scan signals SC[1] to SC[m] having a first scan pulse SCP1 corresponding to the image display period IDP and a second scan pulse SCP2 corresponding to the black display period BDP to the first gate line GLa of each of the plurality of gate line groups GLG in the display mode, and can sequentially supply sense signals SE[1] to SE[m] having a first sense pulse SEP1 synchronized with the first scan pulse SCP1 to the second gate line GLb of each of the plurality of gate line groups GLG.

Optionally, the gate driving circuit portion 500 can group the plurality of gate line groups GLG in a plurality of horizontal groups, and can simultaneously supply the second scan pulse SCP2 of the scan signal SC[i] on a horizontal group basis in the black display period BDP of the display mode. For example, when the display area AA is virtually divided into a first area and a second area, the gate driving circuit portion 500 can simultaneously supply the second scan pulse SCP2 to the plurality of first gate lines GLa disposed in the second area in the display mode, in the middle of sequentially supplying the first scan pulse SCP1 to the plurality of first gate lines GLa disposed in the first area.

According to one embodiment, the gate driving circuit portion 500 can supply scan signals SC[i], SC[n] having a third scan pulse SCP3 (or sensing scan pulse) and a fourth scan pulse SCP4 (or reset scan pulse) to the first gate line GLa of the gate line group GLG disposed in any one specific horizontal line to be sensed, among the plurality of gate line groups GLG, per sensing mode of each frame Fn, Fn+1, and can supply the sense signals SE[i], SE[n] having a second sense pulse SEP2 (or sensing sense pulse) overlapped with all of the third scan pulse SCP3 and the fourth scan pulse SCP4 to the second gate line GLb of the gate ling group GLG disposed in a specific horizontal line.

As an example, in the sensing mode of the Nth frame Fn, when sensing driving is performed for the pixels P connected to the ith gate line group of the plurality of gate line groups GLG, the gate driving circuit portion 500 can supply the scan signal SC[i] having a third scan pulse SCP3 and a fourth scan pulse SCP4 to the first gate line GLa of the ith gate line group and at the same time supply the sense signal SE[i] having a second sense pulse SEP2 overlapped with all of the third scan pulse SCP3 and the fourth scan pulse SCP4 to the second gate line GLb of the ith gate ling group.

As another example, in the sensing mode of the (N+1)th frame Fn+1, when sensing driving (or sensing period RSP) is performed for the pixels P connected to the nth gate line group of the plurality of gate line groups GLG, the gate driving circuit portion 500 can supply the scan signal SC[n] having a third scan pulse SCP3 and a fourth scan pulse SCP4 to the first gate line GLa of the nth gate line group and at the same time supply the sense signal SE[n] having a second sense pulse SEP2 overlapped with all of the third scan pulse SCP3 and the fourth scan pulse SCP4 to the second gate line GLb of the nth gate ling group.

The gate driving circuit portion 500 can directly be formed or embedded in the non-display area of the display panel 100 and thus connected with the plurality of gate line groups GLG individually in accordance with the manufacturing process of the TFT.

As an example, the gate driving circuit portion 500 can be embodied in the non-display area IA at a left side of the substrate and drive the plurality of gate line groups GLG in due order in accordance with a single feeding method.

As another example, the gate driving circuit portion 500 can be embodied in the non-display area IA at each of a left side and a right side of the substrate and drive the plurality of gate line groups GLG in due order in accordance with a double feeding method or a single feeding method. For example, in the single feeding method, the gate driving circuit portion 500 embodied in the non-display area IA at the left side of the substrate can sequentially drive the odd numbered gate line groups of the plurality of gate line groups GLG, and the gate driving circuit portion 500 embodied in the non-display area IA at the right side of the substrate can sequentially drive the even numbered gate line groups of the plurality of gate line groups GLG. In the double feeding method, each of the gate driving circuit portion 500 embodied in the non-display area IA at the left side of the substrate and the gate driving circuit portion 500 embodied in the non-display area IA at the right side of the substrate can sequentially drive the plurality of gate line groups GLG at the same time.

The data driving circuit portion 700 can be connected with the plurality of data lines DL provided in the light emitting display panel 100. The data driving circuit portion 700 according to one embodiment can convert the data PID, PBD and PSD to analog type data voltages Vdata by using the data PID, PBD and PSD and the data control signal DCS supplied from the timing controller 300 and a plurality of reference gamma voltages supplied from a power supply, and can supply the converted data voltages to the corresponding data line DL.

In the image display period IDP of the display mode, the data driving circuit portion 700 can convert the pixel image data PID to the image data voltage Vdata based on the data control signal DCS supplied from the timing controller 300 and supply the converted image data voltage Vdata to the corresponding data line DL, and at the same time can generate a reference voltage Vref and supply the generated reference voltage Vref to the reference line RL. The image data voltage Vdata can be synchronized with the first scan pulse SCP1 of the scan signals SC[1] to SC[m] supplied to the gate line group GLG corresponding to the image display period IDP of the display mode. The reference voltage Vref can be synchronized with the display sense pulse SEP of the sense signals SE[1] to SE[m] supplied to the gate line group GLG corresponding to the image display period IDP of the display mode.

In the black display period BDP of the display mode, the data driving circuit portion 700 can convert the pixel black data PBD to the black data voltage Vdata based on the data control signal DCS supplied from the timing controller 300 and supply the converted black data voltage Vdata to the corresponding data line DL. The black data voltage Vdata can be synchronized with the second scan pulse SCP2 for display of the scan signals SC[i] and SC[n] supplied to the gate line group GLG corresponding to the black display period BDP of the display mode.

In the sensing period RSP of the sensing mode, the data driving circuit portion 700 can convert the pixel sensing data PSD to the sensing data voltage Vdata based on the data control signal DCS supplied from the timing controller 300 and supply the converted sensing data voltage Vdata to the corresponding data line DL, and at the same time can generate a reference voltage Vref and supply the generated reference voltage Vref to the reference line RL. The sensing data voltage Vdata can be synchronized with the third scan pulse SCP3 of the scan signals SC[i] and SC[n] supplied to the gate line group GLG corresponding to the sensing period RSP of the sensing mode. The reference voltage Vref can be synchronized with the second sense pulse SEP2 of the sense signals SE[i] and SE[n] supplied to the gate line group GLG corresponding to the sensing period RSP of the sensing mode.

In the sensing period RSP of the sensing mode, the data driving circuit portion 700 can sense a driving characteristic of the pixel P, for example, a characteristic value of the driving TFT, through the plurality of reference lines RL, and can generate sensing low data corresponding to the sensed value and supply the generated sensing low data to the timing controller 300. The data driving circuit portion 700 can generate a restoring data voltage Vdata synchronized with the fourth scan pulse SCP4 of the scan signals SC[i]

and SC[n] supplied to the gate line group GLG corresponding to the sensing period RSP of the sensing mode and supply the generated restoring data voltage Vdata to the data line DL, thereby restoring (or recovering) a display state (or driving state) of the pixels P connected to the gate line group GLG corresponding to the sensing period RSP equally to a previous state of the sensing period RSP. For example, when the image display period IDP is performed prior to the sensing period RSP, the restoring data voltage Vdata can be image data voltage Vdata. When the black display period BDP is performed prior to the sensing period RSP, the restoring data voltage Vdata can be black data voltage Vdata.

Meanwhile, the timing controller 300 according to one embodiment stores sensing low data per pixel P supplied from the data driving circuit portion 700 in a storage circuit in accordance with the sensing mode. In the display mode, the timing controller 300 can compensate for the pixel image data PID to be supplied to the sensed pixel P based on the sensing low data stored in the storage circuit and supply the compensated pixel image data to the data driving circuit portion 700. For example, the sensing low data can include sequential change information of each of the driving TFT and the light emitting diode ELD, which are disposed in the pixel P. Therefore, the timing controller 300 can sense a characteristic value (for example, threshold voltage or mobility) of the driving TFT disposed in each pixel, in the sensing mode, and can compensate for the pixel image data PDI to be supplied to each pixel P, based on the sensed characteristic value, thereby minimizing or avoiding picture quality deterioration based on characteristic value deviation of the driving TFT in the plurality of pixels P. Since the sensing mode of the light emitting display apparatus is the technique already known in the art by the applicant of the present disclosure, its detailed description will be omitted. For example, the light emitting display apparatus according to the present disclosure can sense the driving characteristic value disposed in each pixel P through the sensing mode disclosed in the Korean Laid-Open Patent No. 10-2016-009317, 10-2017-0054654, or 10-2018-0002099.

Figure 4:
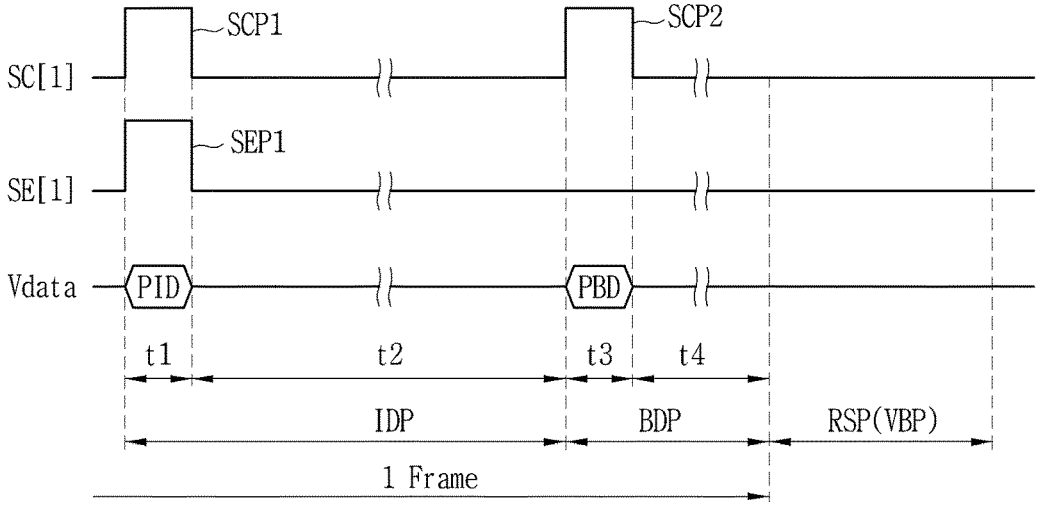
FIG. 4 is a timing view illustrating a scan signal, a sense signal and a data voltage for driving pixels disposed in one horizontal line.

FIG. 4 is a timing view illustrating a scan signal, a sense signal and a data voltage for driving pixels disposed in one horizontal line.

Referring to FIGS. 2 and 4, the pixel P according to one embodiment of the present disclosure can be driven (or operated) in the image display period IDP and the black display period BDP for one frame.

The image display period IDP of the pixel P can include an image data addressing period t1 and a light emission period t2.

At the image data addressing period (or first data addressing period) t1 of the pixel P, the first switching TFT Tsw1 disposed in the pixel P is turned on by the first scan pulse SCP1 of the scan signal SC[1] supplied through the first gate line GLa of the first gate line group GLG1, and the second switching TFT Tsw2 is turned on by the sense pulse SEP of the sense signal SE[1] supplied through the second gate line GLb of the first gate line group GLG1. Therefore, the image data voltage Vdata of the pixel image data PID supplied through the data line DL is applied to the gate node Ng of the driving TFT Tdr, and at the same time, the reference voltage Vref supplied through the reference line RL is applied to the source node Ns of the driving TFT Tdr. Therefore, at the image data addressing period t1, a voltage difference Vdata-Vref between the gate node Ng and the source node Ns of the driving TFT Tdr can be set to a voltage higher than the threshold voltage of the driving TFT Tdr, and the storage capacitor Cst can store a differential voltage Vdata-Vref of the image data voltage Vdata and the reference voltage Vref. In this case, the image data voltage Vdata can have a voltage level in which the threshold voltage of the driving TFT Tdr sensed through the sensing mode is reflected in an actual data voltage or compensated.

At the light emission period t2 of the pixel P, each of the first and second switching TFTs Tsw1 and Tsw2 disposed in the pixel P is turned off, whereby the driving TFT Tdr disposed in the pixel P is turned on by the voltage Vdata-Vref charged in the storage capacitor Cst. Therefore, the driving TFT Tdr supplies the data current determined by the differential voltage Vdata-Vref of the image data voltage Vdata and the reference voltage Vref to the light emitting diode ELD to allow the light emitting diode ELD to emit light in proportion to the data current flowing from the pixel driving power source EVDD to the pixel common power source EVSS. For example, at the light emission period t2, if the first and second switching TFTs Tsw1 and Tsw2 are turned off, a current flows to the driving TFT Tdr and the light emitting diode ELD starts to emit light in proportion to the current, whereby a voltage of the source node Ns of the driving TFT Tdr is increased and a voltage of the gate node Ng of the driving TFT Tdr is increased by the storage capacitor Cst as much as the voltage increase of the source node Ns of the driving TFT Tdr. As a result, a gate-source voltage Vgs of the driving TFT Tdr can continuously be maintained by the voltage of the storage capacitor Cst, and light emission of the light emitting diode ELD can be sustained to reach the start timing of the black display period BDP. The light emission period of the light emitting diode ELD can correspond to a light emission duty.

The black display period BDP of the pixel P can include a black data addressing period t3 and a non-light emission period t4.

At the black data addressing period (or second data addressing period) t3 of the pixel P, the first switching TFT Tsw1 disposed in the pixel P is turned on by the second scan pulse SCP2 of the scan signal SC[1] supplied through the first gate line GLa of the first gate line group GLG1, and the second switching TFT Tsw2 is maintained at a turn-off state by the sense signal SE[1] of a TFT off-voltage level supplied through the second gate line GLb of the first gate line group GLG1. Therefore, the black data voltage Vdata of the pixel black data PBD supplied through the data line DL is applied to the gate node Ng of the driving TFT Tdr. At this time, the source node Ns of the driving TFT Tdr can be maintained at an operation voltage level (or non-light emitting start voltage) of the light emitting diode ELD in accordance with the turn-off state of the second switching TFT Tsw2. The black data voltage Vdata can have a voltage level lower than an operation voltage level (or non-light emitting voltage level) of the light emitting diode ELD or a voltage level lower than the threshold voltage of the driving TFT Tdr. Therefore, at the black data addressing period t3, the driving TFT Tdr is turned off as the voltage Vgs between the gate node Ng and the source node Ns is varied to be lower than the threshold voltage of the driving TFT Tdr by the black data voltage Vdata. For this reason, as the data current supplied from the driving TFT Tdr to the light emitting diode ELD is cut off, light emission of the light emitting diode ELD is stopped, whereby the pixel P displays a black image due to non-light emission of the light emitting diode ELD.

At the non-light emission period t4 of the pixel P, the first switching TFT Tsw1 disposed in the pixel P is turned off, and the second switching TFT Tsw2 is maintained at a turn-off state, whereby the driving TFT Tdr maintains the turn-off state. For this reason, the light emitting diode ELD can maintain the non-light emission state, and non-light emission of the light emitting diode ELD can be sustained to reach the image data addressing period t1 of next frame or the start timing of the sensing period RSP. The non-light emission period of the light emitting diode ELD can correspond to a black duty or a non-light emission duty.

Meanwhile, the pixels P disposed in the other horizontal line except any one specific horizontal line to be sensed among the plurality of horizontal lines disposed in the display area can be driven in the image display period IDP and the black display period BDP substantially equally to the pixel P disposed in the aforementioned first horizontal line.

Figure 5:
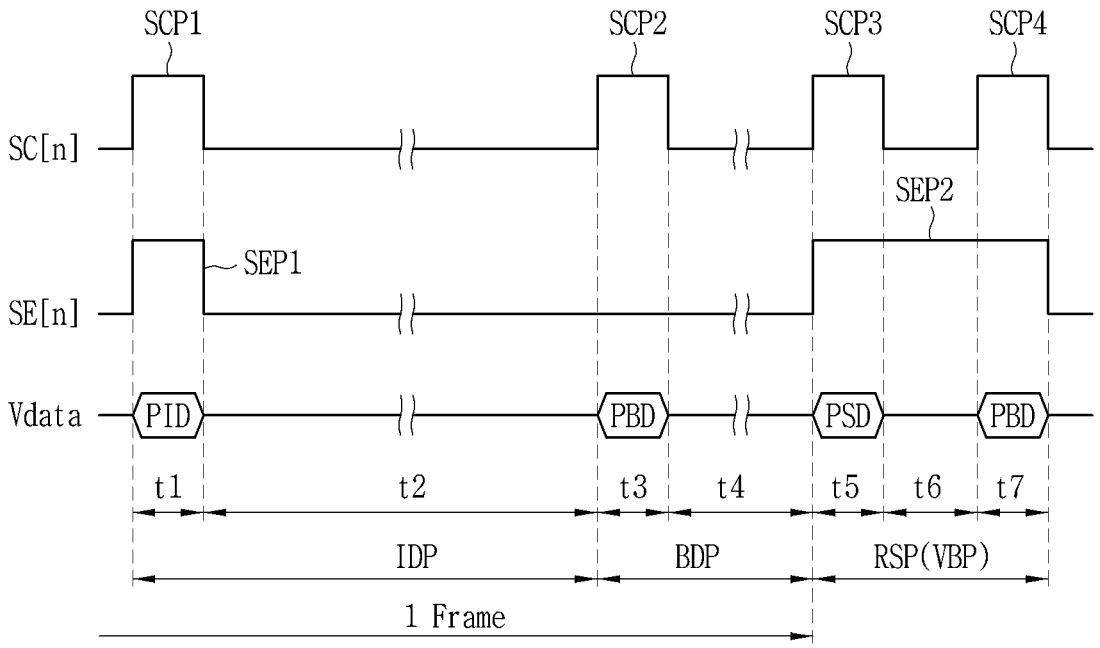
FIG. 5 is a timing view illustrating a scan signal, a sense signal and a data voltage for driving pixels disposed in an nth horizontal line.

FIG. 5 is a timing view illustrating a scan signal, a sense signal and a data voltage for driving pixels disposed in an nth horizontal line.

Referring to FIGS. 2 and 5, the pixel P according to one embodiment of the present disclosure can be driven (or operated) in the image display period IDP, the black display period BDP and the sensing period RSP for one frame.

The image display period IDP of the pixel P can include an image data addressing period t1 and a light emission period t2. Since the image data addressing period t1 and the light emission period t2 are substantially equal to those described with reference to FIG. 4, their repeated description will be omitted.

The black display period IDP of the pixel P can include a black data addressing period t3 and a non-light emission period t4. Since the black data addressing period t3 and the non-light emission period t4 are substantially equal to those described with reference to FIG. 4, their repeated description will be omitted.

The sensing period RSP of the pixel P can include a sensing data addressing period t5 and a sampling period t6.

At the sensing data addressing period (or third data addressing period) t5 of the pixel P, the first switching TFT Tsw1 disposed in the pixel P is turned on by the third scan pulse SCP3 of the scan signal SC[n] supplied through the first gate line GLa of the nth gate line group GLGn, and the second switching TFT Tsw2 is turned on by the second sense pulse SEP2 of the sense signal SE[n] supplied through the second gate line GLb of the nth gate line group GLGn. Therefore, the sensing data voltage Vdata of the pixel sensing data PSD supplied through the data line DL is applied to the gate node Ng of the driving TFT Tdr, and at the same time, the reference voltage Vref supplied through the reference line RL is applied to the source node Ns of the driving TFT Tdr. Therefore, at the sensing data addressing period t5, a voltage Vgs between the gate node Ng and the source node Ns of the driving TFT Tdr is set to correspond to the sensing data voltage. For example, the sensing data voltage Vdata can have a level of a target voltage set to sense the threshold voltage of the driving TFT Tdr.

At the sampling period t6 (or real-time sensing period) of the pixel P, the first switching TFT Tsw1 disposed in the pixel P is turned off by the scan signal SC[n] of the TFT off-voltage level supplied through the first gate line GLa of the nth gate line group GLGn, and the second switching TFT Tsw2 is maintained at the turn-on state by the second sense pulse SEP2 of the sense signal SE[n] supplied through the second gate line GLb of the nth gate line group GLGn. The reference line RL is electrically connected to a sensing unit embedded in the data driving circuit. Therefore, the sensing unit of the data driving circuit can sample a sensing pixel current or sensing pixel voltage supplied through the source node Ns of the driving TFT Tdr and the second switching TFT Tsw2 and the reference line RL, and can convert the sampled sampling signal through analog-digital conversion to generate sensing low data and supply the generated sensing low data to the timing controller 300.

The sensing period RSP of the pixel P according to one embodiment of the present disclosure can further include a data restoring period t7.

At the data restoring period t7 (or real-time sensing period) of the pixel P, the first switching TFT Tsw1 disposed in the pixel P is turned off by the scan signal SC[n] of the TFT off-voltage level supplied through the first gate line GLa of the nth gate line group GLGn, and the second switching TFT Tsw2 is maintained at the turn-on state by the second sense pulse SEP2 of the sense signal SE[n] supplied through the second gate line GLb of the nth gate line group GLGn. The reference line RL is electrically detached from the sensing unit of the data driving circuit and electrically connected with a reference power source. Therefore, the restoring data voltage Vdata of the pixel black data PBD supplied through the data line DL is applied to the gate node Ng of the driving TFT Tdr and at the same time, the reference voltage Vref supplied through the reference line RL is applied to the source node Ns of the driving TFT Tdr. Therefore, at the data restoring period t7, the voltage between the gate node Ng and the source node Ns of the driving TFT Tdr is restored to a previous state of the sensing period RSP, whereby the pixels P can again emit light and re-emission of the light emitting diode ELD can be sustained to reach the image data addressing period t1 of next frame Fn+1.

Figure 6:
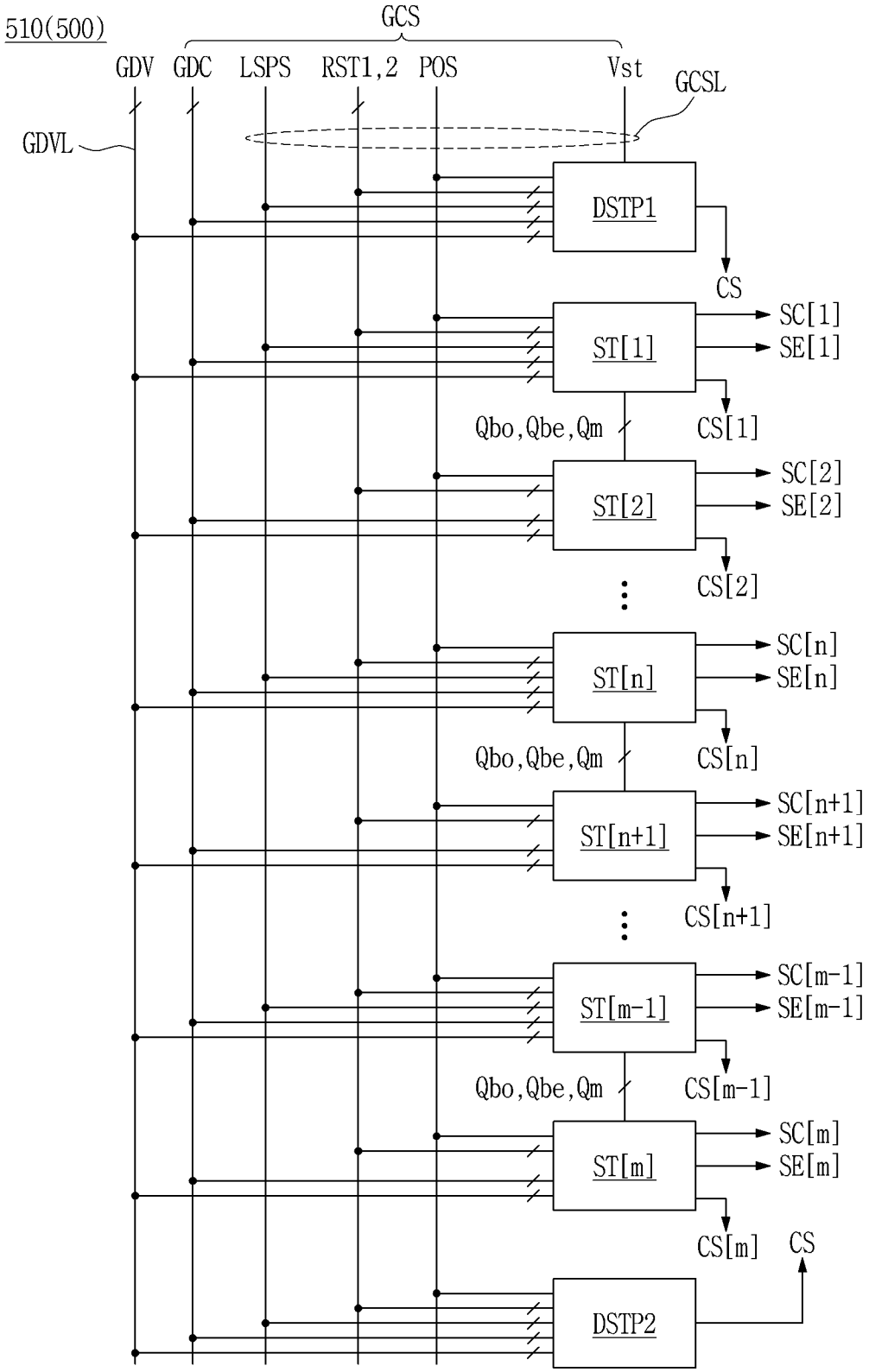
FIG. 6 is a waveform illustrating a gate driving circuit according to one embodiment of the present disclosure, which is shown in FIG. 1.

FIG. 6 is a waveform illustrating a gate driving circuit according to one embodiment of the present disclosure, which is shown in FIG. 1.

Referring to FIGS. 1 and 6, the gate driving circuit portion 500 according to one embodiment of the present disclosure can include a gate driving circuit 510.

The gate driving circuit 510 can include a gate control signal line GCSL, a gate driving voltage line GDVL, and first to mth stage circuits ST[1] to ST[m]. The gate driving circuit 510 can further include a front dummy stage circuit portion DSTP1 disposed at a front end of the first stage circuit ST[1], and a rear dummy stage circuit portion DSTP2 disposed at a rear end of the mth stage circuit ST[m].

The gate control signal line GCSL receives the gate control signal GCS supplied from the timing controller 300. The gate control signal line GCSL according to one embodiment can include a gate start signal line, a first reset signal line, a second reset signal line, a plurality of gate driving clock lines, a display panel on signal line, and a sensing preparation signal line.

The gate start signal line can receive a gate start signal Vst supplied from the timing controller 300. For example, the gate start signal line can be connected to the front dummy stage circuit portion DSTP1.

The first reset signal line can receive a first reset signal RST1 supplied from the timing controller 300. The second reset signal line can receive a second reset signal RST2 supplied from the timing controller 300. For example, each of the first and second reset signal lines can commonly be connected to the front dummy stage circuit portion DSTP1, the first to mth stage circuits ST[1] to ST[m], and the rear dummy stage circuit portion DSTP2.

The plurality of gate driving clock lines can include a plurality of carry clock lines, a plurality of scan clock lines and a plurality of sense clock lines, which respectively receive a plurality of carry shift clocks, a plurality of scan shift clocks and a plurality of sense shift clocks. The clock lines included in the plurality of gate driving clock lines can selectively be connected to the front dummy stage circuit portion DSTP1, the first to mth stage circuits ST[1] to ST[m], and the rear dummy stage circuit portion DSTP2.

The display panel on signal line can receive a display panel on signal POS supplied from the timing controller 300. For example, the display panel on signal line can commonly be connected to the front dummy stage circuit portion DSTP1 and the first to mth stage circuits ST[1] to ST[m].

The sensing preparation signal line can receive a line sensing preparation signal LSPS supplied from the timing controller 300. For example, the sensing preparation signal line can commonly be connected to the first to mth stage circuits ST[1] to ST[m]. Optionally, the sensing preparation signal line can additionally be connected to the front dummy stage circuit portion DSTP1.

The gate driving voltage line GDVL can include first to fourth gate high potential voltage lines respectively receiving first to fourth gate high potential voltages having their respective voltage levels different from one another, from a power supply circuit, and first to third gate low potential voltage lines respectively receiving first to third gate low potential voltages having their respective voltage levels different from one another, from the power supply circuit.

According to one embodiment, the first gate high potential voltage can have a voltage level higher than that of the second gate high potential voltage. The third and fourth gate high potential voltages can be swung to be opposite to each other or reversed with respect to each other for alternating current driving between a high voltage (or TFT on voltage or first voltage) and a low voltage (or TFT off voltage or second voltage). For example, when the third gate high potential voltage (or gate odd high potential voltage) has a high voltage, the fourth gate high potential voltage (or gate even high potential voltage) can have a low voltage. When the third gate high potential voltage has a low voltage, the fourth gate high potential voltage can have a high voltage.

Each of the first and second gate high potential voltage lines can commonly be connected to the first to mth stage circuits ST[1] to ST[m], the front dummy stage circuit portion DSTP1 and the rear dummy stage circuit portion DSTP2.

The third gate high potential voltage line can commonly be connected to odd numbered stage circuits of the first to mth stage circuits ST[1] to ST[m], and can commonly be connected to odd numbered dummy stage circuits of each of the front dummy stage circuit portion DSTP1 and the rear dummy stage circuit portion DSTP2.

The fourth gate high potential voltage line can commonly be connected to even numbered stage circuits of the first to mth stage circuits ST[1] to ST[m], and can commonly be connected to even numbered dummy stage circuits of each of the front dummy stage circuit portion DSTP1 and the rear dummy stage circuit portion DSTP2.

According to one embodiment, the first gate low potential voltage and the second gate low potential voltage can substantially have the same voltage level. The third gate low potential voltage can have a TFT off voltage level. The first gate low potential voltage can have a voltage level higher than that of the third gate low potential voltage. In one embodiment of the present disclosure, the first gate low potential voltage can be set to a voltage level higher than that of the third gate low potential voltage, whereby an off current of a TFT having a gate electrode connected to a control node of a stage circuit, which will be described later, can certainly be cut off to make sure of stability and reliability in the operation of the corresponding TFT.

The first to third gate low potential voltage lines can commonly be connected to the first to mth stage circuits ST[1] to ST[m].

The front dummy stage circuit portion DSTP1 can sequentially generate a plurality of front carry signals in response to the gate start signal Vst supplied from the timing controller 300, thereby supplying the generated front carry signals to any one of the rear stages as the front carry signals or the gate start signals.

The rear dummy stage circuit portion DSTP2 can sequentially generate a plurality of rear carry signals to supply the rear carry signals (or stage reset signals) to any one of the front stages.

The first to mth stage circuits ST[1] to ST[m] can be connected to one another to be mutually dependent upon one another. The first to mth stage circuits ST[1] to ST[m] can generate first to mth scan signals SC[1] to SC[m] and first to meth sense signals SE[1] to SE[m] and output the generated signals to the corresponding gate line group GLG disposed on the light emitting display panel 100. The first to mth stage circuits ST[1] to ST[m] can generate first to mth carry signals CS[1] to CS[m] and supply the generated signals to any one of the rear stages as the front carry signals (or gate start signals) and at the same time supply the generated signals to any one of the front stages as the rear carry signals (or stage reset signals).

Two adjacent stages ST[n] and ST[n+1] of the first to mth stage circuits ST[1] to ST[m] can mutually share some of a sensing control circuit and control nodes Qbo, Qbe, Qm, whereby circuit configuration of the gate driving circuit 500 can be simplified, and an area occupied by the gate driving circuit portion 500 in the light emitting display panel 100 can be reduced.

Figure 7:
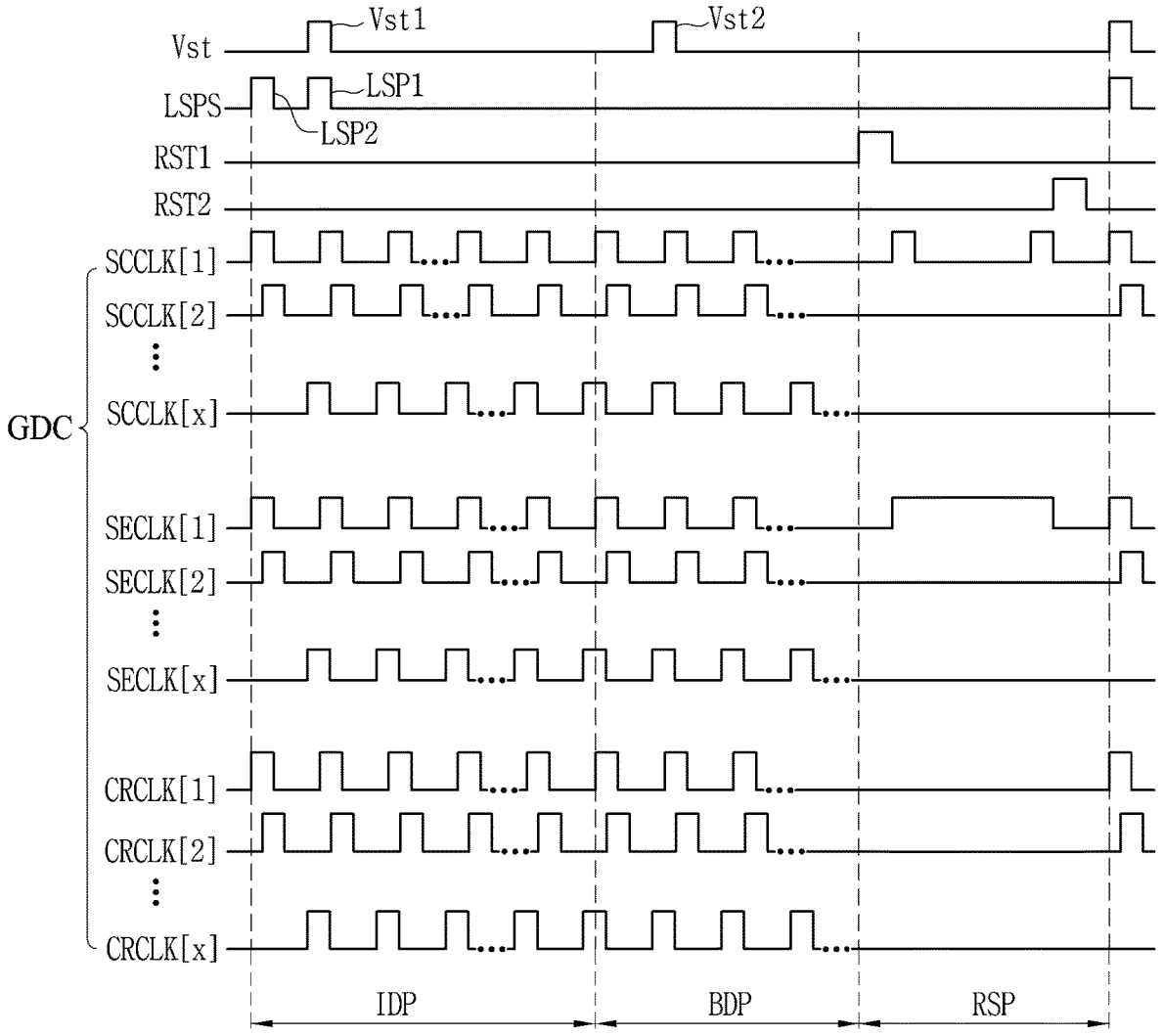
FIG. 7 is a waveform illustrating a signal applied to a gate control signal line shown in FIG. 6, and a voltage and an output signal of a control node of each of first and second stage circuits.

FIG. 7 is a waveform illustrating a signal applied to a gate control signal line shown in FIG. 6, and a voltage and an output signal of a control node of each of first and second stage circuits.

Referring to FIGS. 6 and 7, the gate control signal GCS applied to the gate control signal line according to one embodiment of the present disclosure can include a gate start signal Vst, a line sensing preparation signal LSPS, a first reset signal RST1, a second reset signal RST2, a display panel on signal POS, and a plurality of gate driving clocks GDC.

The gate start signal Vst is a signal for controlling a start timing of each of the image display period IDP and the black display period BDP of every frame, and can be generated just before each of the image display period IDP and the black display period BDP starts. For example, the gate start signal Vst can be generated twice per frame.

The gate start signal Vst according to one embodiment can include a first gate start pulse (or image display gate start pulse) Vst1 generated just before the image display period IDP starts within one frame, and a second gate start pulse (or black display gate start pulse) Vst2 generated just before the black display period BDP starts.

The line sensing preparation signal LSPS can be generated irregularly or randomly within the image display period IDP of every frame. The each of the line sensing preparation signals LSPS generated per frame can be different from a start timing of one frame.

The line sensing preparation signal LSPS according to one embodiment can include a line sensing selection pulse LSP1 and a line sensing release pulse LSP2.

The line sensing selection pulse LSP1 can be a signal for selecting any one horizontal line to be sensed among a plurality of horizontal lines. The line sensing selection pulse LSP1 can be synchronized with a gate start pulse or a front carry signal supplied to any one of the stage circuits ST[1] to ST[m] as a gate start signal. For example, the line sensing selection pulse LSP1 can be expressed as a sensing line precharging control signal.

The line sensing release pulse LSP2 can be a signal for releasing line sensing for a horizontal line which is completely sensed. The line sensing release pulse LSP2 can be generated between an end timing of the sensing period RSP and a start timing of the line sensing selection pulse LSP1.

The first reset signal RST1 can be generated at the time when the sensing mode starts. The second reset signal RST2 can be generated at the time when the sensing mode ends. Optionally, the second reset signal RST2 can be omitted or equal to the first rest signal RST1.

The display panel on signal POS can be generated when the light emitting display apparatus is powered on. The display panel on signal POS can commonly be supplied to all the stage circuits embodied in the gate driving circuit 510. Therefore, all the stage circuits embodied in the gate driving circuit 510 can simultaneously be initialized or reset by the display panel on signal POS of a high voltage.

The plurality of gate driving clocks GDC can include a plurality of carry shift clocks CRCLK[1] to CRCLK[x] having their respective phases different from one another or sequentially shifted phases, a plurality of scan shift clocks SCCLK[1] to SCCLK[x] having their respective phases different from one another or sequentially shifted phases, and a plurality of sense shift clocks SECLK[1] to SECLK[x] having their respective phases different from one another or sequentially shifted phases.

The carry shift clocks CRCLK[1] to CRCLK[x] can be clock signals for generating carry signals, the scan shift clocks SCCLK[1] to SCCLK[x] can be clock signals for generating scan signals having scan pulses, and the sense shift clocks SECLK[1] to SECLK[x] can be clock signals for generating sense signals having sense pulses.

Each of the scan shift clocks SCCLK[1] to SCCLK[x] and the sense shift clocks SECLK[1] to SECLK[x] can be swung between a high voltage and a low voltage. A swing voltage width of the carry shift clocks according to one embodiment can be greater than a switching voltage width of each of the scan shift clocks SCCLK[1] to SCCLK[x] and the sense shift clocks SECLK[1] to SECLK[x].

For the display mode, each of the scan shift clocks SCCLK[1] to SCCLK[x] and the sense shift clocks SECLK [1] to SECLK[x] can be swung. For the sensing mode, a specific one SCCLK[1] of the scan shift clocks SCCLK[1] to SCCLK[x] can be swung to correspond to the third and fourth scan pulses SCP3 and SCP4 shown in FIG. 5, and the other scan shift clocks can maintain a low voltage. For the sensing mode, a specific one SECLK[1] of the sense shift clocks SECLK[1] to SECLK[x] can be swung to correspond to the second scan pulse SCP2 shown in FIG. 5, and the other sense shift clocks can maintain a low voltage. These clocks can be overlapped with one another to make sure of an enough charging time during high speed driving. High voltage periods of the adjacent clocks can be overlapped with each other as much as a period which is set.

Figure 8:
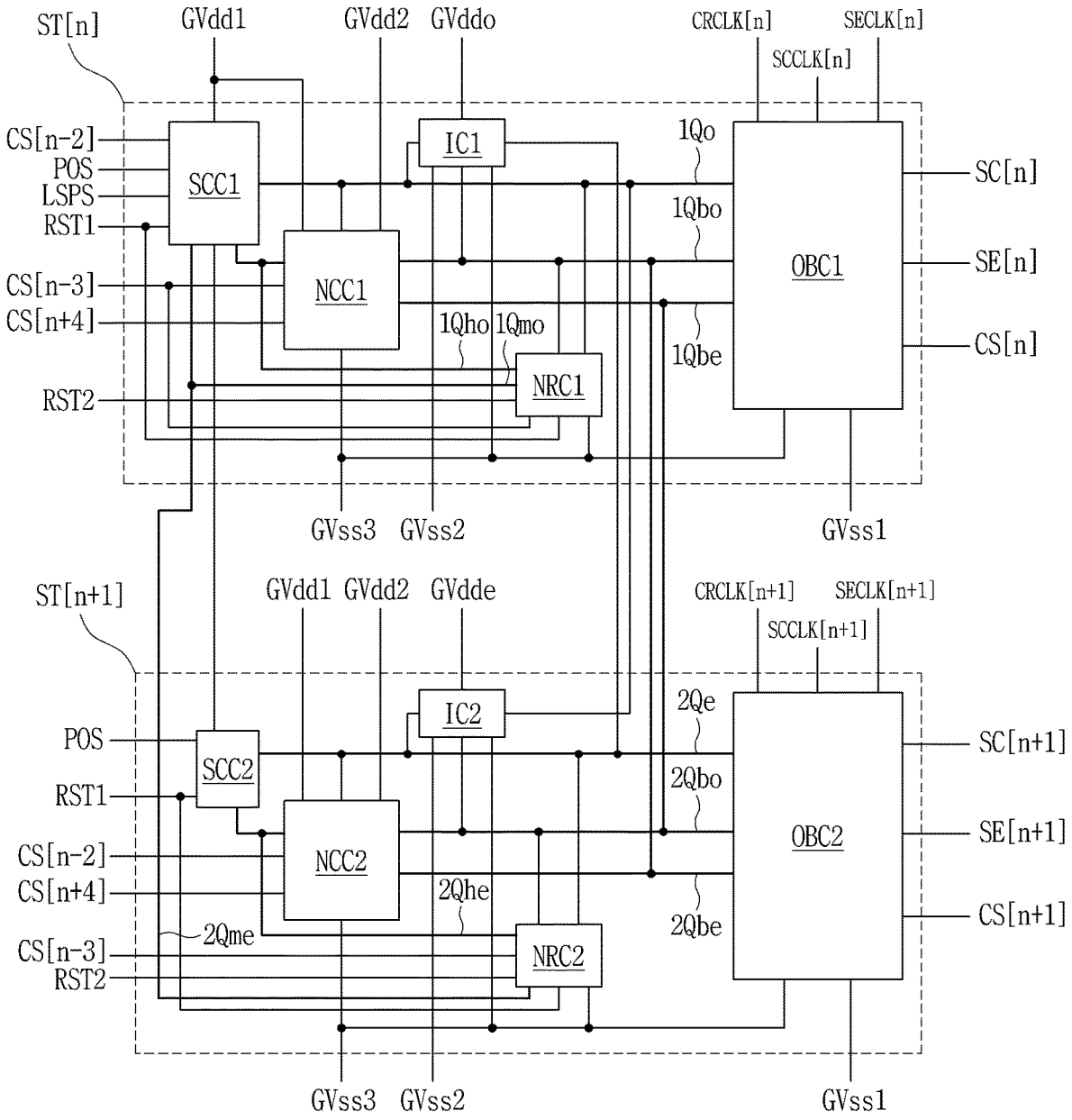
FIG. 8 is a block view illustrating an nth stage circuit and an (n+1)th stage circuit shown in FIG. 6.

FIG. 8 is a block view illustrating an nth stage circuit and an (n+1)th stage circuit shown in FIG. 6.

Referring to FIGS. 6 to 8, the nth stage circuit ST[n] can be odd numbered stage circuits of the first to mth stage circuits ST[1] to ST[m].

The nth stage circuit ST[n] according to one embodiment can include first to fifth odd control nodes 1Qo, 1Qbo, 1Qbe, 1Qho and 1Qmo, a first sensing control circuit SCC1, a first node control circuit NCC1, a first inverter circuit IC1, a first node reset circuit NRC1, and a first output buffer circuit OBC1.

The first odd control node 1Qo can electrically be connected to each of the first sensing control circuit SCC1, the first node control circuit NCC1, the first inverter circuit IC1, the first node reset circuit NRC1 and the first output buffer circuit OBC1.

Each of the second and third odd control nodes 1Qbo and 1Qbe can electrically be connected to each of the first node control circuit NCC1, the first inverter circuit IC1, the first node reset circuit NRC1 and the first output buffer circuit OBC1.

The second odd control node 1Qbo can electrically be connected with the (n+1)th stage circuit ST[n+1].

The third odd control node 1Qbe can electrically be connected with the (n+1)th stage circuit ST[n+1].

The fourth odd control node 1Qho can electrically be connected to each of the first sensing control circuit SCC1, the first node control circuit NCC1 and the first node reset circuit NRC1.

The fifth odd control node 1Qmo can electrically be connected to each of the first sensing control circuit SCC1 and the first node reset circuit NRC1, and can electrically be connected with the (n+1)th stage circuit ST[n+1].

The first sensing control circuit SCC1 can be embodied to control the potential of the fifth odd control node 1Qmo through the first gate high potential voltage GVdd1 in response to the line sensing preparation signal LSPS and the (n−2)th carry signal CS[n−2] (second front carry signal) and control the potential of the first odd control node 1Qo through the first gate high potential voltage GVdd1 in response to the voltage of the fifth odd control node 1Qmo and the first reset signal RST1. The first sensing control circuit SCC1 can be embodied to discharge or reset the potential of the first odd control node 1Qo through the third gate low potential voltage GVss3 in response to the display panel on signal POS supplied when the light emitting display apparatus is powered on.

The first node control circuit NCC1 can be embodied to control the voltage of each of the first to third odd control nodes 1Qo, 1Qbo and 1Qbe.

The first node control circuit NCC1 can be embodied to control the potential of the first odd control node 1Qo through the first gate high potential voltage GVdd1 in response to the (n−3)th carry signal CS[n−3] (first front carry signal), and can be embodied to control the potential of each of the first odd control node 1Qo and the fourth odd control node 1Qho through the third gate low potential voltage GVss3 in response to the (n+4)th carry signal CS[n+4] (or second rear carry signal). Optionally, the first node control circuit NCC1 can be embodied to control the potential of each of the first odd control node 1Qo and the fourth odd control node 1Qho through the third gate low potential voltage GVss3 in response to the (n+3)th carry signal CS[n+3] (or first rear carry signal).

The first node control circuit NCC1 can be embodied to control the potential of the fourth odd control node 1Qho through the first gate high potential voltage GVdd1 in response to the voltage of the first odd control node 1Qo. The first node control circuit NCC1 can be embodied to control the potential of each of the first odd control node 1Qo and the fourth odd control node 1Qho through the third gate low potential voltage GVss3 in response to the voltage of the second odd control node 1Qbo or the voltage of the third odd control node 1Qbe.

The first inverter circuit IC1 can be embodied to control the potential of the second odd control node 1Qbo through the third gate high potential voltage GVddo or the third gate low potential voltage GVss3 in response to the voltage of the first odd control node 1Qo. For example, when the potential of the first odd control node 1Qo is a high voltage or more, the first inverter circuit IC1 can control the potential of the second odd control node 1Qbo through the third gate low potential voltage GVss3. And, the first inverter circuit IC1 can be embodied to control the potential of the second odd control node 1Qbo through the third gate high potential voltage GVddo or the third gate low potential voltage GVss3 in response to the voltage of the first even control node 2Qe of the (n+1)th stage circuit ST[n+1]. For example, when the potential of the first even control node 2Qe of the (n+1)th stage circuit ST[n+1] is a low voltage, the first inverter circuit IC1 can control the potential of the second odd control node 1Qbo through the third gate high potential voltage GVddo.

The first node reset circuit NRC1 can be embodied to control the potential of the second odd control node 1Qbo with the third gate low potential voltage GVss3 in response to the (n−3)th carry signal CS[n−3]. The first node reset circuit NRC1 can be embodied to control the potential of the second odd control node 1Qbo with the third gate low potential voltage GVss3 in response to the voltage of the fifth odd control node 1Qmo and the first reset signal RST1. The first node reset circuit NRC1 can be embodied to control the potential of the first odd control node 1Qo with the third gate low potential voltage GVss3 in response to the voltage of the fifth fourth odd control node 1Qho, the voltage of the fifth odd control node 1Qmo and the second reset signal RST2.

The first output buffer circuit OBC1 can be embodied to output the nth scan shift clock SCCLK[n] as the nth scan signal SC[n] in response to the voltage of each of the first to third odd control nodes 1Qo, 1Qbo and 1Qbe. The first output buffer circuit OBC1 can be embodied to output the nth sense shift clock SECLK[n] as the nth sense signal SE[n] in response to the voltage of each of the first to third odd control nodes 1Qo, 1Qbo and 1Qbe. The first output buffer circuit OBC1 can be embodied to output the nth carry shift clock CRCLK[n] as the nth carry signal CS[n] in response to the voltage of each of the first to third odd control nodes 1Qo, 1Qbo and 1Qbe.

According to one embodiment, when the potential of the first odd control node 1Qo based on coupling between a boost capacitor embodied between the first odd control node 1Qo and the output node and a clock is bootstrapped, the first output buffer circuit OBC1 can output each of the corresponding scan shift clock SCCLK[n], sense shift clock SECLK[n] and carry shift clock CRCLK[n] to a corresponding output node.

The (n+1)th stage circuit ST[n+1] according to one embodiment can be even numbered stage circuits of the first to mth stage circuits ST[1] to ST[m].

The (n+1)th stage circuit ST[n] according to one embodiment can include first to fifth even control nodes 2Qe, 2Qbo, 2Qbe, 2Qhe and 2Qme, a second sensing control circuit SCC2, a second node control circuit NCC2, a second inverter circuit IC2, a second node reset circuit NRC2, and a second output buffer circuit OBC2.

The first even control node 2Qe can electrically be connected to each of the second sensing control circuit SCC2, the second node control circuit NCC2, the second inverter circuit IC2, the second node reset circuit NRC2 and the second output buffer circuit OBC2.

Each of the second and third even control nodes 2Qbo and 2Qbe can electrically be connected to each of the second node control circuit NCC2, the second inverter circuit IC2, the second node reset circuit NRC2 and the second output buffer circuit OBC2.

The second even control node 2Qbo can electrically be connected with the third odd control node 1Qbe of the nth stage circuit ST[n]. Therefore, the third odd control node 1Qbe of the nth stage circuit ST[n] and the second even control node 2Qbo of the (n+1)th stage circuit ST[n+1] can be connected or shared with each other.

The third even control node 2Qbe can electrically be connected to each of the second odd control node 1Qbo of the nth stage circuit ST[n]. Therefore, the second odd control node 1Qbo of the nth stage circuit ST[n] and the third even control node 2Qbe of the (n+1)th stage circuit ST[n+1] can be connected or shared with each other.

The fourth even control node 2Qhe can electrically be connected to each of the second sensing control circuit SCC2, the second node control circuit NCC2 and the second node reset circuit NRC2.

The fifth even control node 2Qme can electrically be connected to the second node reset circuit NRC2, and can electrically be connected with the fifth odd control node 1Qmo of the nth stage circuit ST[n] and the first node reset circuit NRC1.

The second sensing control circuit SCC2 can share the potential of the fifth odd control node 1Qmo of the first sensing control circuit SCC1 embodied in the nth stage circuit ST[n]. For example, the second sensing control circuit SCC2 can share a circuit embodied to control the potential of the fifth odd control node 1Qmo with the first gate high potential voltage GVdd1 in response to the line sensing preparation signal LSPS and the (n−2)th carry signal CS[n−2] in the first sensing control circuit SCC1 embodied in the nth stage circuit ST[n].

The second sensing control circuit SCC2 can be embodied to control the potential of the first even control node 2Qe with the first gate high potential voltage GVdd1 supplied from the first sensing control circuit SCC1 of the nth stage circuit ST[n], in response to the first reset signal RST1. The second sensing control circuit SCC2 can be embodied to discharge or reset the potential of the first even control node 2Qe through the third gate low potential voltage GVss3 in response to the display panel on signal POS supplied when the light emitting display apparatus is powered on.

The second node control circuit NCC2 can be embodied to control the voltage of each of the first to third even control nodes 2Qe, 2Qbo and 2Qbe.

The second node control circuit NCC2 can be embodied to control the potential of the first even control node 2Qe through the first gate high potential voltage GVdd1 in response to the (n−2)th carry signal CS[n−2], and can be embodied to control the potential of each of the first even control node 2Qe and the fourth even control node 2Qhe through the third gate low potential voltage GVss3 in response to the (n+4)th carry signal CS[n+4].

The second node control circuit NCC2 can be embodied to control the potential of the fourth even control node 2Qhe through the first gate high potential voltage GVdd1 in response to the voltage of the first even control node 2Qe. The second node control circuit NCC2 can be embodied to control the potential of each of the first even control node 2Qe and the fourth even control node 2Qhe through the third gate low potential voltage GVss3 in response to the voltage of the second even control node 2Qbo or the voltage of the third even control node 2Qbe.

The second inverter circuit IC2 can be embodied to control the potential of the second even control node 2Qbo through the fourth gate high potential voltage GVdde or the third gate low potential voltage GVss3 in response to the voltage of the first even control node 2Qe. For example, when the potential of the first even control node 2Qe is a high voltage or more, the second inverter circuit IC2 can control the potential of the second even control node 2Qbo through the third gate low potential voltage GVss3. The second inverter circuit IC2 can be embodied to control the potential of the second even control node 2Qbo through the third gate high potential voltage GVddo or the third gate low potential voltage GVss3 in response to the voltage of the first odd control node 1Qo of the nth stage circuit ST[n]. For example, when the potential of the first odd control node 1Qo of the nth stage circuit ST[n] is a low voltage, the second inverter circuit IC2 can control the potential of the second even control node 2Qbo through the fourth gate high potential voltage GVdde.

The second node reset circuit NRC2 can be embodied to control the potential of the second even control node 2Qbo with the third gate low potential voltage GVss3 in response to the (n−3)th carry signal CS[n−3]. The second node reset circuit NRC2 can be embodied to control the potential of the second even control node 2Qbo with the third gate low potential voltage GVss3 in response to the voltage of the fifth even control node 2Qme and the first reset signal RST1. The second node reset circuit NRC2 can be embodied to control the potential of the first even control node 2Qe with the third gate low potential voltage GVss3 in response to the voltage of the fourth even control node 2Qbe, the voltage of the fifth even control node 2Qme and the second reset signal RST2.

The second output buffer circuit OBC2 can be embodied to output the (n+1)th scan shift clock SCCLK[n+1] as the (n+1)th scan signal SC[n+1] in response to the voltage of each of the first to third even control nodes 2Qe, 2Qbo and 2Qbe. The second output buffer circuit OBC2 can be embodied to output the (n+1)th sense shift clock SECLK[n+1] as the (n+1)th sense signal SE[n+1] in response to the voltage of each of the first to third even control nodes 2Qe, 2Qbo and 2Qbe. The second output buffer circuit OBC2 can be embodied to output the (n+1)th carry shift clock CRCLK[n+1] as the (n+1)th carry signal CS[n+1] in response to the voltage of each of the first to third even control nodes 2Qe, 2Qbo and 2Qbe.

According to one embodiment, when the potential of the first even control node 2Qe based on coupling between a boost capacitor embodied between the first even control node 2Qe and the output node and a clock is bootstrapped, the second output buffer circuit OBC2 can output each of the corresponding scan shift clock SCCLK[n+1], sense shift clock SECLK[n+1] and carry shift clock CRCLK[n+1] to a corresponding output node.

In the gate driving circuit according to one embodiment of the present disclosure, some circuit that includes the fifth odd control node 1Qmo in the sensing control circuits SCC1 and SCC2 embodied in the nth stage circuit ST[n] can be shared with the (n+1)th stage circuit ST(n+1) adjacent thereto, whereby circuit configuration for the sensing mode can be simplified. In the gate driving circuit according to one embodiment of the present disclosure, the nth stage circuit ST[n] and the (n+1)th stage circuit ST[n+1], which are adjacent to each other, can mutually share the second and third control nodes 1Qbo, 1Qbe, 2Qbo and 2Qbe, which are alternately driven, whereby configuration of the inverter circuits IC1 and IC2 of the stage circuits can be simplified.

Meanwhile, for convenience of description, the aforementioned description of FIG. 8 is based on that the control node embodied in each of the nth stage circuit ST[n] and the (n+1)th stage circuit ST[n+1] is divided into the odd control node and the even control node, but is not limited thereto. For example, it is to be understood that each of the first to mth stage circuits ST[1] to ST[m] includes first to fifth control nodes.

Figure 9:
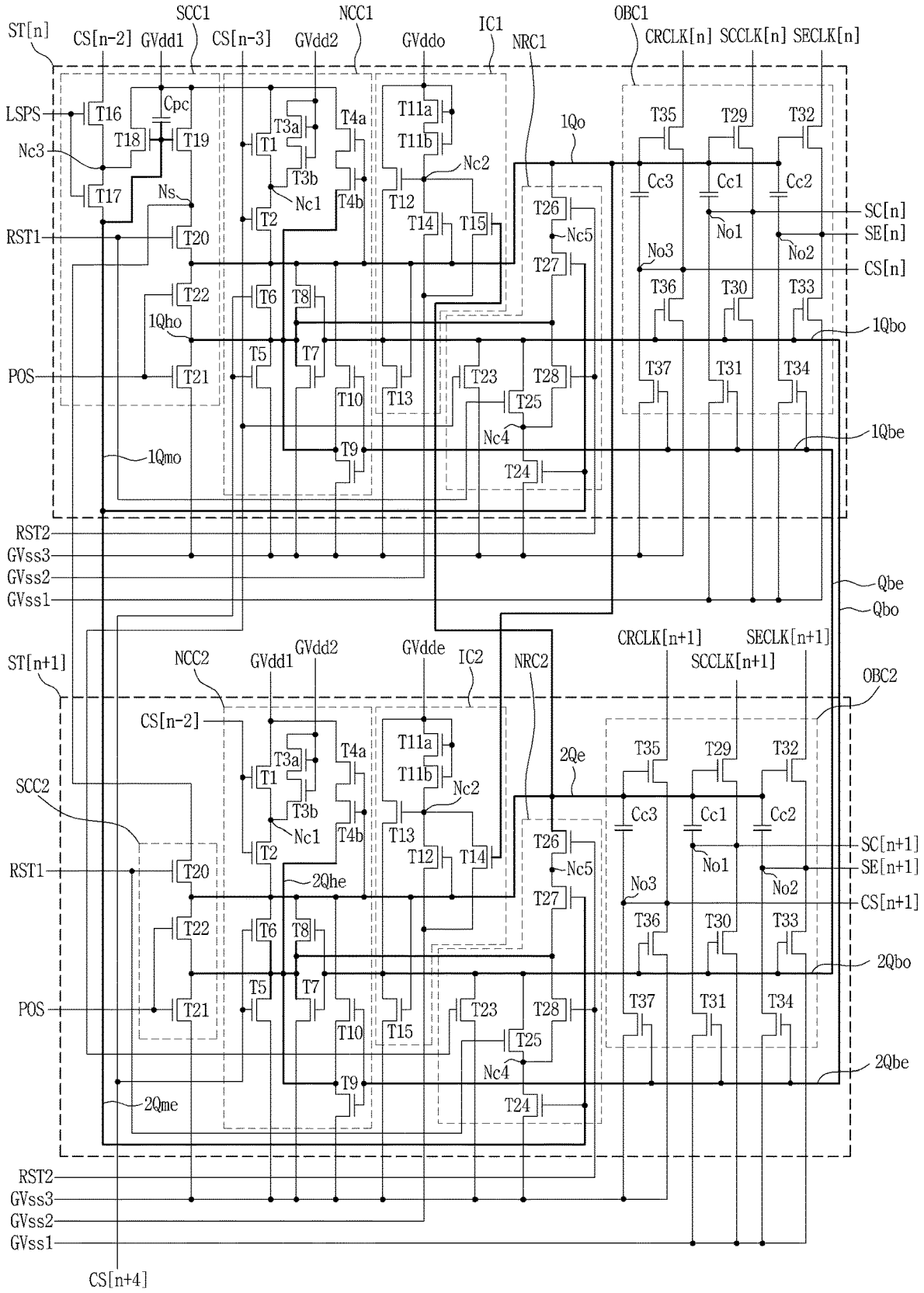
FIG. 9 is a circuit view illustrating an nth stage circuit and an (n+1)th stage circuit according to one embodiment of the present disclosure shown in FIG. 8.

FIG. 9 is a circuit view illustrating an nth stage circuit and an (n+1)th stage circuit shown in FIG. 8.

Referring to FIGS. 7 to 9, the nth stage circuit ST[n] according to one embodiment of the present disclosure can include a first sensing control circuit SCC1, a first node control circuit NCC1, a first inverter circuit IC1, a first node reset circuit NRC1, and a first output buffer circuit OBC1, which are selectively connected to the first to fifth odd control nodes 1Qo, 1Qbo, 1Qbe, 1Qho and 1Qmo.

The first node control circuit NCC1 according to one embodiment can include first to tenth TFTs T1 to T10.

The first to fourth TFTs T1, T2, T3*a*, T3*b*, T4*a* and T4*b* serve to control or setup the potential of the first odd control node 1Qo, and thus can be expressed as first node setup circuits.

The first TFT T1 and the second TFT T2 can be electrically connected between the first gate high potential voltage line for transferring the first gate high potential voltage GVdd1 and the first odd control node 1Qo in series, and can be embodied to charge the first gate high potential voltage GVdd1 in the first odd control node 1Qo in response to the (n−3)th carry signal CS[n−3].

In this case, the (n−3)th carry signal CS[n−3] can be a first front carry signal.

The first TFT T1 can output the first gate high potential voltage GVdd1 to a first connection node Nc1 in response to the (n−3)th carry signal CS[n−3] supplied through a front carry input line. For example, the first TFT T1 can be turned on in accordance with the (n−3)th carry signal CS[n−3] of a high voltage to output the first gate high potential voltage GVdd1 to the first connection node Nc1.

The second TFT T2 can electrically connect the first connection node Nc1 to the first odd control node 1Qo in response to the (n−3)th carry signal CS[n−3]. For example, the second TFT T2 can be turned on in accordance with the (n−3)th carry signal CS[n−3] of a high voltage simultaneously with the first TFT T1 to supply the first gate high potential voltage GVdd1 supplied through the first connection node Nc1 to the first odd control node 1Qo.

The third TFTs T3*a* and T3*b* can supply the second gate high potential voltage GVdd2 to the first connection node Nc1 in response to the second gate high potential voltage GVdd2. For example, the third TFTs T3*a* and T3*b* can be turned on in accordance with the second gate high potential voltage GVdd2 to always supply the second gate high potential voltage GVdd2 to the first connection node Nc1 between the first TFT T1 and the second TFT T2, thereby preventing off current of the first TFT T1 and current leakage of the first odd control node 1Qo from occurring. For example, the third TFTs T3*a* and T3*b* can completely turn off the first TFT T1 turned off by the (n−3)th carry signal CS[n−3] having a low voltage by increasing a voltage difference between the gate voltage of the first TFT T1 and the first connection node Nc1. As a result, voltage drop (or current leakage) of the first odd control node 1Qo by off current of the first TFT T1 which is turned off can be prevented from occurring, whereby the voltage of the first odd control node 1Qo can stably be maintained. For example, when the threshold voltage of the first TFT T1 has a negative polarity (−), the gate-source voltage Vgs of the first TFT T1 can be fixed to the negative polarity (−) by the second gate high potential voltage GVdd2 supplied to the drain electrode. For this reason, the first TFT T1 which is turned off can become a complete off state, whereby current leakage based on the off current can be prevented from occurring.

The second gate high potential voltage GVdd2 is set to a voltage level lower than the first gate high potential voltage GVdd1. Resistance of the second gate high potential voltage GVdd2 is set to be higher than that of the first gate high potential voltage GVdd1 to reduce a voltage drop of the first gate high potential voltage GVdd1. The second gate high potential voltage line for supplying the second gate high potential voltage GVdd2 can be used as a path through which a leakage current of the third TFTs T3*a* and T3*b* flows, whereby the voltage drop of the first gate high potential voltage GVdd1 can be reduced. Therefore, in one embodiment of the present disclosure, the first gate high potential voltage line and the second gate high potential voltage line can be detached from each other to independently configure voltage drop components of the first gate high potential voltage line and the second gate high potential voltage line, whereby the voltage drop of the first gate high potential voltage line can be minimized. As a result, an error operation of the gate driving circuit, which is generated due to the voltage drop of the first gate high potential voltage line, can be avoided.

The third TFTs T3*a* and T3*b* according to one embodiment can include (3-1)th and (3-2)th TFTs T3*a* and T3*b* electrically connected with each other in series between the second gate high potential voltage line and the first connection node Nc1 to prevent the leakage current due to the off current from occurring.

The (3-1)th TFT T3*a* can be turned on by the second gate high potential voltage GVdd2 to supply the second gate high potential voltage GVdd2 to the (3-2)th TFT T3*b*. For example, the (3-1)th TFT T3*a* can be connected to the second gate high potential voltage line in the form of diode.

The (3-2)th TFT T3*b* can be turned on by the second gate high potential voltage GVdd2 simultaneously with the (3-1)th TFT T3*a* to supply the second gate high potential voltage GVdd2 supplied through the (3-1)th TFT T3*a*, to the first connection node Nc1.

The fourth TFTs T4*a* and T4*b* can supply the first gate high potential voltage GVdd1 to the fourth odd control node 1Qho in response to the first odd control node 1Qo. For example, the fourth TFTs T4*a* and T4*b* can be turned on in accordance with the high voltage of the first odd control node 1Qo to supply the first gate high potential voltage GVdd1 to the fourth odd control node 1Qho.

The fourth TFTs T4*a* and T4*b* according to one embodiment can include (4-1)th and (4-2)th TFTs T4*a* and T4*b* electrically connected with each other in series between the first gate high potential voltage line and the fourth odd control node 1Qho to prevent the leakage current due to the off current from occurring.

The (4-1)th TFT T4*a* can be turned on by the high voltage of the first odd control node 1Qo to supply the first gate high potential voltage GVdd1 to the (4-2)th TFT T4*b*.

The (4-2)th TFT T4*b* can be turned on by the high voltage of the first odd control node 1Qo simultaneously with the (4-1)th TFT T4*a* to supply the first gate high potential voltage GVdd1 supplied through the (4-1)th TFT T4*a*, to the fourth odd control node 1Qho.

The fifth and sixth TFTs T5 and T6 can be embodied to control the potential of each of the first odd control node 1Qo and the fourth odd control node 1Qho through the third gate low potential voltage GVss3 in response to the (n+4)th carry signal CS[n+4]. The fifth and sixth TFTs T5 and T6 can be expressed as first odd discharge circuits.

The fifth TFT T5 can be embodied to control the potential of the fourth odd control node 1Qho through the third gate low potential voltage GVss3 in response to the (n+4)th carry signal CS[n+4]. For example, the fifth TFT T5 can be turned on in accordance with the (n+4)th carry signal CS[n+4] of a high voltage to discharge or reset the potential of the fourth odd control node 1Qho to the third gate low potential voltage GVss3.

The sixth TFT T6 can electrically connect the first odd control node 1Qo with the fourth odd control node 1Qho in response to the (n+4)th carry signal CS[n+4]. For example, the sixth TFT T6 can be turned on in accordance with the (n+4)th carry signal CS[n+4] of a high voltage simultaneously with the fifth TFT T5 to supply the third gate low potential voltage GVss3 supplied through the fifth TFT T5 and the fourth odd control node 1Qho, to the first odd control node 1Qo, thereby discharging or resetting the potential of the first odd control node 1Qo to the third gate low potential voltage GVss3.

The fourth odd control node 1Qho between the fifth TFT T5 and the sixth TFT T6 can be supplied with the first gate high potential voltage GVdd1 through the fourth TFTs T4*a* and T4*b*. Therefore, the fourth TFTs T4*a* and T4*b* can completely turn off the sixth TFT T6 turned off by the (n+4)th carry signal CS[n+4] of a low voltage by increasing a voltage difference between the gate voltage of the sixth TFT T6 and the fourth odd control node 1Qho. As a result, a voltage drop (or current leakage) of the first odd control node 1Qo through the sixth TFT T6 which is turned off can be prevented from occurring, whereby the voltage of the first odd control node 1Qo can stably be maintained.

The seventh and eighth TFTs T7 and T8 can be embodied to control the potential of each of the first odd control node 1Qo and the fourth odd control node 1Qho through the third gate low potential voltage GVss3 in response to the voltage of the second odd control node 1Qbo. The seventh and eighth TFTs T7 and T8 can be expressed as second odd discharge circuits.

The seventh TFT T7 can be embodied to control the potential of the fourth odd control node 1Qho through the third gate low potential voltage GVss3 in response to the voltage of the second odd control node 1Qbo. For example, the seventh TFT T7 can be turned on in accordance with the high voltage of the second odd control node 1Qbo to discharge or reset the potential of the fourth odd control node 1Qho to the third gate low potential voltage GVss3.

The eighth TFT T8 can electrically connect the first odd control node 1Qo with the fourth odd control node 1Qho in response to the voltage of the second odd control node 1Qbo. For example, the eighth TFT T8 can be turned on by the high voltage of the second odd control node 1Qbo simultaneously with the seventh TFT T7 to supply the third gate low potential voltage GVss3 supplied through the seventh TFT T7 and the fourth odd control node 1Qho, to the first odd control node 1Qo, thereby discharging or resetting the potential of the first odd control node 1Qo to the third gate low potential voltage GVss3.

The fourth odd control node 1Qho between the seventh TFT T7 and the eighth TFT T8 can be supplied with the first gate high potential voltage GVdd1 through the fourth TFTs T4*a* and T4*b*. Therefore, the fourth TFTs T4*a* and T4*b* can completely turn off the eighth TFT T8 turned off by the (n+4)th carry signal CS[n+4] of a low voltage by increasing a voltage difference between the gate voltage of the eighth TFT T8 and the fourth odd control node 1Qho. As a result, a voltage drop (or current leakage) of the first odd control node 1Qo through the eighth TFT T8 which is turned off can be prevented from occurring, whereby the voltage of the first odd control node 1Qo can stably be maintained.

The ninth and tenth TFTs T9 and T10 can be embodied to control the potential of each of the first odd control node 1Qo and the fourth odd control node 1Qho through the third gate low potential voltage GVss3 in response to the voltage of the third odd control node 1Qbe. The ninth and tenth TFTs T9 and T10 can be expressed as third odd discharge circuits.

The ninth TFT T9 can be embodied to control the potential of the fourth odd control node 1Qho through the third gate low potential voltage GVss3 in response to the voltage of the third odd control node 1Qbe. For example, the ninth TFT T9 can be turned on in accordance with the high voltage of the third odd control node 1Qbe to discharge or reset the potential of the fourth odd control node 1Qho to the third gate low potential voltage GVss3.

The tenth TFT T10 can electrically connect the first odd control node 1Qo with the fourth odd control node 1Qho in response to the voltage of the third odd control node 1Qbe. For example, the tenth TFT T10 can be turned on by the high voltage of the third odd control node 1Qbe simultaneously with the ninth TFT T9 to supply the third gate low potential voltage GVss3 supplied through the ninth TFT T9 and the fourth odd control node 1Qho, to the first odd control node 1Qo, thereby discharging or resetting the potential of the first odd control node 1Qo to the third gate low potential voltage GVss3.

The fourth odd control node 1Qho between the ninth TFT T9 and the tenth TFT T10 can be supplied with the first gate high potential voltage GVdd1 through the fourth TFTs T4*a* and T4*b*. Therefore, the fourth TFTs T4*a* and T4*b* can completely turn off the tenth TFT T10 turned off by the (n+4)th carry signal CS[n+4] of a low voltage by increasing a voltage difference between the gate voltage of the tenth TFT T10 and the fourth odd control node 1Qho. As a result, a voltage drop (or current leakage) of the first odd control node 1Qo through the tenth TFT T10 which is turned off can be prevented from occurring, whereby the voltage of the first odd control node 1Qo can stably be maintained.

The first inverter circuit IC1 according to one embodiment can include 11th to 15th TFTs T11*a*, T11*b*, T12, T13, T14 and T15.

The 11th TFTs T11*a* and T11*b* can supply the third gate high potential voltage GVddo to a second connection node Nc2 in response to the third gate high potential voltage GVddo. The 11th TFTs T11*a* and T11*b* according to one embodiment can include (11-1)th and (11-2)th TFTs T11*a* and T11*b* electrically connected with each other in series between the third gate high potential voltage line and the second connection node Nc2 to prevent the leakage current due to the off current from occurring.

The (11-1)th TFT T11*a* can be turned on by the third gate high potential voltage GVddo to supply the third gate high potential voltage GVddo to the (11-2)th TFT T11*b*. For example, the (11-1)th TFT T11*a* can be connected to the third gate high potential voltage line in the form of diode.

The (11-2)th TFT T11*b* can be turned on by the third gate high potential voltage GVddo simultaneously with the (11-1)th TFT T11*a* to supply the third gate high potential voltage GVddo supplied through the (11-1)th TFT T11*a*, to the second connection node Nc2.

The 12th TFT T12 can be turned on or turned off in accordance with a voltage of the second connection node Nc2, and can supply the third gate high potential voltage GVddo to the second odd control node 1Qbo when it is turned on.

The 13th TFT T13 can be turned on or turned off in accordance with the voltage of the first odd control node 1Qo, and can discharge or reset the potential of the second odd control node 1Qbo to the third gate low potential voltage GVss3 when it is turned on.

The 14th TFT T14 can be turned on or turned off in accordance with the voltage of the first odd control node 1Qo, and can discharge or reset the potential of the second connection node Nc2 to the second gate low potential voltage GVss2 when it is turned on.

The 15th TFT T15 can be turned on or turned off in accordance with the voltage of the first even control node 2Qe of the (n+1)th stage circuit ST[n+1], and can discharge or reset the potential of the second connection node Nc2 to the second gate low potential voltage GVss2 when it is turned on.

The first sensing control circuit SCC1 according to one embodiment can include 16th to 222nd TFTs T16 to T22, and a precharging capacitor Cpc.

The 16th to 18th TFTs T16 to T18 and the precharging capacitor Cpc can be embodied to control the fifth odd control node 1Qmo through the (n−2)th carry signal CS[n−2] in response to the line sensing preparation signal LSPS and the (n−2)th carry signal CS[n−2]. The 16th to 18th TFTs T16 to T18 and the precharging capacitor Cpc can be expressed as line sensing preparation circuits or line sensing precharging circuits for precharging the voltage of the fifth odd control node 1Qmo in the display mode. For example, the fifth odd control node 1Qmo can be expressed as a memory node or precharging node for the sensing mode.

The 16th TFT T16 can output the (n−2)th carry signal CS[n−2] to a third connection node Nc3 in response to the line sensing preparation signal LSPS. For example, in the image display mode, the 16th TFT T16 can be turned on in accordance with the line sensing selection pulse LSP1 transferred through the sensing preparation signal line, to output the (n−2)th carry signal CS[n−2] of a high voltage synchronized with the line sensing selection pulse LSP1 to the third connection node Nc3. In the image display mode, the 16th TFT T16 can be turned on in accordance with the line sensing release pulse LSP2 transferred through the sensing preparation signal line, to output the (n−2)th carry signal CS[n−2] of a low voltage to the third connection node Nc3.

The 17th TFT T17 can electrically connect the third connection node Nc3 with the fifth odd control node 1Qmo in response to the line sensing preparation signal LSPS. For example, the 17th TFT T17 can be turned on in accordance with the line sensing preparation signal LSP of a high voltage simultaneously with the 16th TFT T16 to supply the (n−2)th carry signal CS[n−2] supplied through the 17th TFT T17 and the third connection node Nc3, to the fifth odd control node 1Qmo. The third connection node Nc3 can be a connection line between the 16th TFT T16 and the 17th TFT T17.

The 18th TFT T18 can supply the first gate high potential voltage GVdd1 to the third connection node Nc3 in response to the voltage of the fifth odd control node 1Qmo. For example, the 18th TFT T18 can be turned on in accordance with the high voltage of the fifth odd control node 1Qmo to supply the first gate high potential voltage GVdd1 to the third connection node Nc3, thereby preventing a voltage leakage of the fifth odd control node 1Qmo from occurring. For example, the 18th TFT T18 can turn off the 16th TFT T16 turned off by the line sensing preparation signal LSPS of a low voltage by increasing a voltage difference between the gate voltage of the 16th TFT T16 and the third connection control node Nc3. As a result, a voltage drop (or current leakage) of the fifth odd control node 1Qmo through the 16th TFT T16 which is turned off can be prevented from occurring, whereby the voltage of the fifth odd control node 1Qmo can stably be maintained.

The precharging capacitor Cpc can be formed between the fifth odd control node 1Qmo and the first gate high potential voltage line to store a differential voltage between the voltage of the fifth odd control node 1Qmo and the first gate high potential voltage GVdd1. For example, a first electrode of the precharging capacitor Cpc can electrically be connected with the fifth odd control node 1Qmo connected to a gate electrode of the 18th TFT T18, and a second electrode of the precharging capacitor Cpc can electrically be connected with the fifth gate high potential voltage line. The precharging capacitor Cpc stores the high voltage of the (n−2)th carry signal CS[n−2] in accordance with turn-on of the 16th, 17th and 18th TFTs T16, T17 and T18, and maintains the voltage of the fifth odd control node 1Qmo for a certain time period by the voltage stored when the 16th, 17th and 18th TFTs T16, T17 and T18 are turned off. For example, the voltage of the fifth odd control node 1Qmo can be maintained until the 16th and 17th TFTs T16 and T17 are again turned on by the line sensing release pulse LSP2 of the line sensing preparation signal LSPS.

The 19th and 20th TFTs T19 and T20 can be embodied to control the potential of the first odd control node 1Qo through the first gate high potential voltage GVdd1 in response to the voltage of the fifth odd control node 1Qmo and the first reset signal RST1. The 19th and 20th TFTs T19 and T20 can be expressed as sensing line selection circuits.

The 19th TFT T19 can output the first gate high potential voltage GVdd1 to a sharing node Ns in response to the voltage of the fifth odd control node 1Qmo. For example, the 19th TFT T19 can be turned on in accordance with the high voltage of the fifth odd control node 1Qmo precharged with the first gate high potential voltage GVdd1 to supply the first gate high potential voltage GVdd1 to the sharing node Ns.

The 20th TFT T20 can electrically connect the 19th TFT T19 to the first odd control node 1Qo in response to the first reset signal RST1. For example, the 20th TFT T20 can be turned on in accordance with the first reset signal RST1 of the high voltage to supply the first gate high potential voltage GVdd1 supplied through the 19th TFT T19 and the sharing node Ns, to the first odd control node 1Qo, thereby charging the first gate high potential voltage GVdd1 in the first odd control node 1Qo to activate the first odd control node 1Qo.

The 21st and 22nd TFTs T21 and T22 can be embodied to discharge or reset the potential of the first odd control node 1Qo to the third gate low potential voltage GVss3 in response to the display panel on signal POS supplied when the light emitting display apparatus is powered on. The 21st and 22nd TFTs T21 and T22 can be expressed as first stage initialization circuits.

The 21st TFT T21 can supply the third gate low potential voltage GVss3 supplied through the third gate low potential voltage line to the fourth odd control node 1Qho in response to the display panel on signal POS. For example, the 21st TFT T21 can be turned on in accordance with the display panel on signal POS of the high voltage to discharge or reset the potential of the fourth odd control node 1Qo to the third gate low potential voltage GVss3.

The 22nd TFT T22 can electrically connect the first odd control node 1Qo with the fourth odd control node 1Qho in response to the display panel on signal POS. For example, the 22nd TFT T22 can be turned on in accordance with the display panel on signal POS of the high voltage simultaneously with the 21st TFT T21 to supply the third gate low potential voltage GVss3 supplied through the 21st TFT T21 and the fourth odd control node 1Qho, to the first odd control node 1Qo, thereby charging or resetting the potential of the first odd control node 1Qo to the third gate low potential voltage GVss3.

The fourth odd control node 1Qho between the 21st TFT T21 and the 22nd TFT T22 can be supplied with the first gate high potential voltage GVdd1 through the fourth TFTs T4*a* and T4*b* of the first control circuit NCC1. Therefore, the fourth TFTs T4*a* and T4*b* can completely turn off the 22st TFT T22 turned off by the display panel on signal POS of the low voltage by increasing a voltage difference between a gate voltage of the 22st TFT T22 and the fourth odd control node 1Qho. As a result, a voltage drop (or current leakage) of the first odd control node 1Qo through the 22st TFT T22 which is turned off can be prevented from occurring, whereby the voltage of the first odd control node 1Qo can stably be maintained.

Optionally, the first sensing control circuit SCC1 can be omitted. For example, since the first sensing control circuit SCC1 is a circuit used to sense driving characteristics of the pixel in accordance with the sensing mode, if the pixel is not driven in the sensing mode, the first sensing control circuit SCC1 is an unnecessary element and thus can be omitted.

The first node reset circuit NRC1 according to one embodiment can include 23rd to 28th TFTs T21 to T28.

The 23rd TFT T23 can be embodied to control the potential of the second odd control node 1Qbo through the third gate low potential voltage GVss3 in response to the (n−3)th carry signal CS[n−3]. The 23rd TFT T23 can be expressed as a (1-1)th reset circuit.

The 23rd TFT T23 can be turned on in accordance with the (n−3)th carry signal CS[n−3] of the high voltage in the display mode to discharge or reset the potential of the second odd control node 1Qbo to the third gate low potential voltage GVss3.

The 24th and 25th TFTs T24 and T25 can be embodied to control the potential of the second odd control node 1Qbo through the third gate low potential voltage GVss3 in response to the voltage of the fifth odd control node 1Qmo and the first reset signal RST1. The 24th and 35th TFTs T24 and T25 can be expressed as (1-2)th reset circuits.

The 24th TFT T24 can supply the third gate low potential voltage GVss3 to a fourth connection node Nc4 in response to the fifth odd control node 1Qmo. For example, the 24th TFT T24 can be turned on in accordance with the high voltage of the fifth odd control node 1Qmo to supply the third gate low potential voltage GVss3 to the fourth connection node Nc4.

The 25th TFT T25 can electrically connect the second odd control node 1Qbo to the fourth connection node Nc4 in response to the first reset signal RST1. For example, the 25th TFT T25 can be turned on in accordance with the first reset signal RST1 of the high voltage to supply the third gate low potential voltage GVss3 supplied through the 24th TFT T24 and the fourth connection node Nc4, to the second odd control node 1Qbo. The fourth connection node Nc4 can be a connection line between the 24th TFT T24 and the 25th TFT T25.

The 26th to 28th TFTs T26, T27 and T28 can be embodied to control the potential of the first odd control node 1Qo with the third gate low potential voltage GVss3 in response to the voltage of the fourth odd control node 1Qho, the voltage of the fifth odd control node 1Qmo and the second reset signal RST2, in the sensing mode. The 26th to 28th TFTs T26, T27 and T28 can be expressed as fourth odd discharge circuits.

The 26th to 28th TFTs T26, T27 and T28 can electrically be connected in series between the first odd control node 1Qo and the fourth connection node Nc4 and electrically connect the first odd control node 1Qo with the fourth connection node Nc4 in response to the voltage of the fourth odd control node 1Qho, the voltage of the fifth odd control node 1Qmo and the second reset signal RST2.

The 26th TFT T26 can electrically connect the first odd control node 1Qo with the fifth connection node Nc5 in response to the second reset signal RST2. For example, the 26th TFT T26 can be turned on in accordance with the second reset signal RST2 of the high voltage to electrically connect the first odd control node 1Qo with the fifth connection node Nc5.

The 27th TFT T27 can electrically connect the fifth connection node Nc5 with the fourth odd control node 1Qho in response to the voltage of the fifth odd control node 1Qmo. For example, the 27th TFT T27 can be turned on in accordance with the high voltage of the fifth odd control node 1Qmo to electrically connect the fifth connection node Nc5 with the fourth odd control node 1Qho.

The 28th TFT T28 can electrically connect the fourth odd control node 1Qho with the fourth connection node Nc4 in response to the second reset signal RST2. For example, the 28th TFT T28 can be turned on in accordance with the second reset signal RST2 of the high voltage to electrically connect the fourth odd control node 1Qho with the fourth connection node Nc4.

Meanwhile, the 24th to 28th TFTs T24, T25, T26, T27 and T28 can be omitted when the first sensing control circuit SCC1 is omitted.

The first output buffer circuit OBC1 according to one embodiment can include 29th to 37th TFTs T29 to T37, and first to third coupling capacitors Cc1, Cc2 and Cc3.

The 29th to 31st TFTs T29, T30 and T31 and the first coupling capacitor Cc1 can output an nth scan shift clock SCCLK[n] as the nth scan signal SC[n] in response to the voltages of the first to third odd control nodes 1Qo, 1Qbo and 1Qbe. The 29th to 31st TFTs T29, T30 and T31 and the first coupling capacitor Cc1 can be can be expressed as scan output circuits.

The 29th TFT T29 (or first odd pull-up TFT) can output the nth scan signal SC[n] having a scan pulse of a high voltage corresponding to the nth scan shift clock SCCLK[n] to the first output node No1 in accordance with the voltage of the first odd control node 1Qo to supply the scan pulse of the nth scan signal SC[n] to the first gate line of the nth gate line group. For example, the 29th TFT T29 can include a gate electrode connected to the first odd control node 1Qo, a first source/drain electrode connected to the first output node No1 (or scan output terminal), and a second source/drain electrode connected to the nth scan clock line.

According to one embodiment, as shown in FIG. 3, based on the nth scan shift clock SCCLK[n], the 29th TFT T29 can supply the first scan pulse SCP1 to the first gate line of the nth gate line group in the image display period of the display mode, and can supply the second scan pulse SCP2 to the first gate line of the nth gate line group in the black display period of the display mode. In the sensing mode, when driving characteristics of the pixels embodied in the nth horizontal line are sensed, the 29th TFT T29 can additionally supply the third scan pulse SCP3 and the fourth scan pulse SCP4 to the first gate line of the nth gate line group in the sensing period RSP based on the nth scan shift clock SCCLK[n].

The 30th TFT T30 (or (1-1)th odd pull-down TFT) can output the nth scan signal SC[n] of a low voltage corresponding to the first gate low potential voltage GVss1 to the first output node No1 in accordance with the voltage of the second odd control node 1Qbo to supply the nth scan signal SC[n] of the low voltage to the first gate line of the nth gate line group. For example, the 30th TFT T30 can include a gate electrode connected to the second odd control node 1Qbo, a first source/drain electrode connected to the first output node No1, and a second source/drain electrode connected to the first gate low potential voltage line.

The 31st TFT T31 (or (1-2)th odd pull-down TFT) can output the nth scan signal SC[n] of the low voltage corresponding to the first gate low potential voltage GVss1 to the first output node No1 in accordance with the voltage of the third odd control node 1Qbe to supply the nth scan signal SC[n] of the low voltage to the first gate line of the nth gate line group. For example, the 31st TFT T31 can include a gate electrode connected to the third odd control node 1Qbe, a first source/drain electrode connected to the first output node No1, and a second source/drain electrode connected to the first gate low potential voltage line.

Since the 30th TFT T30 and the 31st TFT T31 are maintained at the turn-on state for a relatively longer time period than that of the 29th TFT T29, a degradation speed can be relatively faster than that of the 29th TFT T29. Therefore, the 30th TFT T10 and the 31st TFT T31 according to the present disclosure can be driven alternately on a certain time period basis in accordance with an opposite voltage of each of the second odd control node 1Qbo and the third odd control node 1Qbe, whereby the degradation speed can be delayed. For example, when the 30th TFT T30 is maintained at the turn-on state, the 31st TFT T31 can be maintained at the turn-off state. On the contrary, when the 30th TFT T30 is maintained at the turn-off state, the 31st TFT T31 can be maintained at the turn-on state.

The first coupling capacitor Cc1 can be embodied between the first odd control node 1Qo and the first output node No1. Optionally, the first coupling capacitor Cc1 can be embodied by parasitic capacitance between the gate electrode of the 29th TFT T29 and the first output node No1. The first coupling capacitor Cc1 generates bootstrapping in the first odd control node 1Qo in accordance with phase shift (or change) of the nth scan shift clock SCCLK[n], whereby the 29th TFT T29 can completely turned on. As a result, the nth scan shift clock SCCLK[n] of the high voltage can be output to the first output node No1 through the 29th TFT T29, which is completely turned, without loss.

The 32nd to 34th TFTs T32, T33 and T34 and the second coupling capacitor Cc2 can be embodied to output an nth sense shift clock SECLK[n] as the nth sense signal SE[n] in response to the voltages of the first to third odd control nodes 1Qo, 1Qbo and 1Qbe. The 32nd to 34th TFTs T32, T33 and T34 and the second coupling capacitor Cc2 can be can be expressed as sense output circuits.

The 32nd TFT T32 (or second odd pull-up TFT) can output the nth sense signal SE[n] having a sense pulse of a high voltage corresponding to the nth sense shift clock SECLK[n] to the second output node No2 in accordance with the voltage of the first odd control node 1Qo to supply the sense pulse of the nth sense signal SE[n] to the second gate line of the nth gate line group. For example, the 32nd TFT T32 can include a gate electrode connected to the first odd control node 1Qo, a first source/drain electrode connected to the second output node No2 (or sense output terminal), and a second source/drain electrode connected to the nth sense clock line.

According to one embodiment, as shown in FIG. 3, based on the nth sense shift clock SECLK[n], the 32nd TFT T32 can supply the first sense pulse SEP1 to the second gate line of the nth gate line group in the image display period of the display mode. In the sensing mode, when driving characteristics of the pixels embodied in the nth horizontal line are sensed, the 32nd TFT T32 can additionally supply the second sense pulse SEP2 to the second gate line of the nth gate line group in the sensing period RSP based on the nth sense shift clock SECLK[n].

The 33rd TFT T33 (or (2-1)th odd pull-down TFT) can output the nth sense shift clock SECLK[n] of a low voltage corresponding to the first gate low potential voltage GVss1 to the second output node No2 in accordance with the voltage of the second odd control node 1Qbo to supply the nth sense shift clock SECLK[n] of the low voltage to the second gate line of the nth gate line group. For example, the 33rd TFT T33 can include a gate electrode connected to the second odd control node 1Qbo, a first source/drain electrode connected to the second output node No2, and a second source/drain electrode connected to the first gate low potential voltage line.

The 34th TFT T34 (or (2-2)th odd pull-down TFT) can output the nth sense shift clock SECLK[n] of the low voltage corresponding to the first gate low potential voltage GVss1 to the second output node No2 in accordance with the voltage of the third odd control node 1Qbe to supply the nth sense shift clock SECLK[n] of the low voltage to the second gate line of the nth gate line group. For example, the 34th TFT T34 can include a gate electrode connected to the third odd control node 1Qbe, a first source/drain electrode connected to the second output node No2, and a second source/drain electrode connected to the first gate low potential voltage line.

The 33rd TFT T33 and the 34th TFT T34 according to the present disclosure can be driven alternately on a certain time period basis in accordance with an opposite voltage of each of the second odd control node 1Qbo and the third odd control node 1Qbe, whereby the degradation speed can be delayed.

The second coupling capacitor Cc2 can be embodied between the first odd control node 1Qo and the second output node No2. Optionally, the second coupling capacitor Cc2 can be embodied by parasitic capacitance between the gate electrode of the 32nd TFT T32 and the second output node No2. The second coupling capacitor Cc2 generates bootstrapping in the first odd control node 1Qo in accordance with phase shift (or change) of the nth sense shift clock SECLK[n], whereby the 32nd TFT T32 can completely turned on. As a result, the nth sense shift clock SECLK[n] of the high voltage can be output to the second output node No2 through the 32nd TFT T32, which is completely turned, without loss.

The 35th to 37th TFTs T35, T36 and T37 and the third coupling capacitor Cc3 can be embodied to output an nth carry shift clock CRCLK[n] as the nth carry signal CS[n] in response to the voltages of the first to third odd control nodes 1Qo, 1Qbo and 1Qbe. The 35th to 37th TFTs T35, T36 and T37 and the third coupling capacitor Cc3 can be can be expressed as carry output circuits.

The 35th TFT T35 (or third odd pull-up TFT) can output the nth carry signal CS[n] having a carry pulse of a high voltage corresponding to the nth carry shift clock CRCLK [n] to the third output node No3 in accordance with the voltage of the first odd control node 1Qo to supply the nth carry signal CS[n] of the high voltage to the front or rear stage circuit. According to one embodiment, based on the nth carry shift clock CRCLK[n], the 35th TFT T35 can output the nth carry signal CS[n] to the front or rear stage circuit in the display mode based on the nth carry shift clock CRCLK[n]. For example, the 35th TFT T35 can include a gate electrode connected to the first odd control node 1Qo, a first source/drain electrode connected to the third output node No3, and a second source/drain electrode connected to the nth carry clock line.

The 36th TFT T36 (or (3-1)th odd pull-down TFT) can output the nth carry signal CS[n] of a low voltage corresponding to the first gate low potential voltage GVss1 to the third output node No3 in accordance with the voltage of the second odd control node 1Qbo to supply the nth carry signal CS[n] of the low voltage to the front or rear stage circuit. For example, the 36th TFT T36 can include a gate electrode connected to the second odd control node 1Qbo, a first source/drain electrode connected to the third output node No3, and a second source/drain electrode connected to the first gate low potential voltage line.

The 37th TFT T37 (or (3-2)th odd pull-down TFT) can output the nth carry signal CS[n] of the low voltage corresponding to the first gate low potential voltage GVss1 to the third output node No3 in accordance with the voltage of the third odd control node 1Qbe to supply the nth carry signal CS[n] of the low voltage to the front or rear stage circuit. For example, the 37th TFT T37 can include a gate electrode connected to the third odd control node 1Qbe, a first source/drain electrode connected to the third output node No3, and a second source/drain electrode connected to the first gate low potential voltage line.

The 36th TFT T36 and the 37th TFT T37 according to the present disclosure can be driven alternately on a certain time period basis in accordance with an opposite voltage of each of the second odd control node 1Qbo and the third odd control node 1Qbe, whereby the degradation speed can be delayed.

The third coupling capacitor Cc3 can be embodied between the first odd control node 1Qo and the third output node No3. Optionally, the third coupling capacitor Cc3 can be embodied by parasitic capacitance between the gate electrode of the 35th TFT T35 and the third output node No3. The third coupling capacitor Cc3 generates bootstrapping in the first odd control node 1Qo in accordance with phase shift (or change) of the nth carry shift clock CRCLK [n], whereby the 35th TFT T35 can completely turned on. As a result, the nth carry shift clock CRCLK[n] of the high voltage can be output to the third output node No3 through the 35th TFT T35, which is completely turned, without loss.

The first and second coupling capacitors Cc1 and Cc2 of the first to third coupling capacitors Cc1, Cc2 and Cc3 can generate coupling between a scan output circuit and a sense output circuit or serve as holding capacitors. In this case, the potential of the first odd control node 1Qo can be lowered, whereby driving characteristics and reliability of the gate driving circuit can be deteriorated. Therefore, in order to prevent coupling between the scan output circuit and the sense output circuit from occurring, any one of the first and second coupling capacitors Cc1 and Cc2 can be omitted. For example, the first coupling capacitor Cc1 of the first and second coupling capacitors Cc1 and Cc2 can be omitted.

The (n+1)th stage circuit ST[n+1] according to one embodiment of the present disclosure can include a second sensing control circuit SCC2, a second node control circuit NCC2, a second inverter circuit IC2, a second node reset circuit NRC2, and a second output buffer circuit OBC2, which are selectively connected to the first to fifth even control nodes 2Qe, 2Qbo, 2Qbe, 2Qbe and 2Qme. The (n+1)th stage circuit ST[n+1] can be embodied to be substantially the same as the nth stage circuit ST[n] except the second sensing control circuit SCC2.

The (n+1)th stage circuit ST[n+1] according to one embodiment is substantially the same as the nth stage circuit ST[n] except that the (n+1)th stage circuit ST[n+1] shares the line sensing preparation circuit, the second odd control node 1Qbo, the third odd control node 1Qbe and the fourth odd control node 1Qmo and controls the potential of the first even control node 2Qe through the first gate high potential voltage GVdd1 in response to the (n−2)th carry signal CS[n−2] and the fourth gate high potential voltage GVdde. Therefore, the same reference numerals will be given to the same elements of the (n+1)th stage circuit ST[n+1] as those of the nth stage circuit ST[n], and a repeated description of the same elements will be omitted or simplified.

The second node control circuit NCC2 according to one embodiment can include first to tenth TFTs T1 to T10.

The first to fourth TFTs T1 to T4 serve to control or setup the potential of the second even control node 2Qbo, and thus can be expressed as second node setup circuits.

The first TFT T1 and the second TFT T2 can be embodied to be electrically connected between the first gate high potential voltage line for transferring the first gate high potential voltage GVdd1 and the first odd control node 1Qo in series and charge the first gate high potential voltage GVdd1 in the first even control node 2Qe in response to the (n−2)th carry signal CS[n−2].

The first TFT T1 can be turned on in accordance with the (n−2)th carry signal CS[n−2] of a high voltage to output the first gate high potential voltage GVdd1 to a first connection node Nc1.

The second TFT T2 can be turned on in accordance with the (n−2)th carry signal CS[n−2] of the high voltage simultaneously with the first TFT T1 to supply the first gate high potential voltage GVdd1 supplied through the first TFT T1 and the first connection node Nc1 to the first even control node 2Qe.

The third TFTs T3*a* and T3*b* can be turned on in accordance with the second gate high potential voltage GVdd2 to always supply the second gate high potential voltage GVdd2 to the first connection node Nc1 between the first TFT T1 and the second TFT T2, thereby preventing off current of the first TFT T1 and current leakage of the first even control node 2Qe from occurring.

The third TFTs T3*a* and T3*b* according to one embodiment can include (3-1)th and (3-2)th TFTs T3*a* and T3*b* electrically connected with each other in series between the second gate high potential voltage line and the first connection node Nc1 to prevent the leakage current due to the off current from occurring.

The (3-1)th TFT T3*a* can be connected to the second gate high potential voltage line in the form of diode. The (3-2)th TFT T3*b* can be turned on by the second gate high potential voltage GVdd2 simultaneously with the (3-1)th TFT T3*a* to supply the second gate high potential voltage GVdd2 supplied through the (3-1)th TFT T3*a*, to the first connection node Nc1.

The fourth TFTs T4*a* and T4*b* can be turned on in accordance with the high voltage of the first even control node 2Qe to supply the first gate high potential voltage GVdd1 to the fourth even control node 2Qhe.

The fourth TFTs T4*a* and T4*b* according to one embodiment can include (4-1)th and (4-2)th TFTs T4*a* and T4*b* electrically connected with each other in series between the first gate high potential voltage line and the fourth even control node 2Qhe to prevent the leakage current due to the off current from occurring.

The (4-1)th TFT T4*a* can be turned on by the high voltage of the first even control node 2Qe to supply the first gate high potential voltage GVdd1 to the (4-2)th TFT T4*b*.

The (4-2)th TFT T4*b* can be turned on by the high voltage of the first even control node 2Qe simultaneously with the (4-1)th TFT T4*a* to supply the first gate high potential voltage GVdd1 supplied through the (4-1)th TFT T4*a*, to the fourth even control node 2Qhe.

The fifth and sixth TFTs T5 and T6 can be embodied to control the potential of each of the second even control node 2Qbo and the fourth even control node 2Qhe through the third gate low potential voltage GVss3 in response to the (n+4)th carry signal CS[n+4]. The fifth and sixth TFTs T5 and T6 can be expressed as first even discharge circuits.

The fifth TFT T5 can be turned on in accordance with the (n+4)th carry signal CS[n+4] of a high voltage to discharge or reset the potential of the fourth even control node 2Qhe to the third gate low potential voltage GVss3.

The sixth TFT T6 can be turned on in accordance with the (n+4)th carry signal CS[n+4] of a high voltage simultaneously with the fifth TFT T5 to supply the third gate low potential voltage GVss3 supplied through the fifth TFT T5 and the fourth even control node 2Qhe, to the first even control node 2Qe, thereby discharging or resetting the potential of the first even control node 2Qe to the third gate low potential voltage GVss3.

The seventh and eighth TFTs T7 and T8 can be embodied to control the potential of each of the first even control node 2Qe and the fourth even control node 2Qhe through the third gate low potential voltage GVss3 in response to the voltage of the second even control node 2Qbo. The seventh and eighth TFTs T7 and T8 can be expressed as second even discharge circuits.

The seventh TFT T7 can be turned on in accordance with the high voltage of the second even control node 2Qbo to discharge or reset the potential of the fourth even control node 2Qhe to the third gate low potential voltage GVss3.

The eighth TFT T8 can be turned on by the high voltage of the second even control node 2Qbo simultaneously with the seventh TFT T7 to supply the third gate low potential voltage GVss3 supplied through the seventh TFT T7 and the fourth even control node 2Qhe, to the first even control node 2Qe, thereby discharging or resetting the potential of the first even control node 2Qe to the third gate low potential voltage GVss3.

The ninth and tenth TFTs T9 and T10 can be embodied to control the potential of each of the first even control node 2Qe and the fourth even control node 2Qhe through the third gate low potential voltage GVss3 in response to the voltage of the third even control node 2Qbe. The ninth and tenth TFTs T9 and T10 can be expressed as third even discharge circuits.

The ninth TFT T9 can be turned on in accordance with the high voltage of the third even control node 2Qbe to discharge or reset the potential of the fourth even control node 2Qhe to the third gate low potential voltage GVss3.

The tenth TFT T10 can be turned on by the high voltage of the third even control node 2Qbe simultaneously with the ninth TFT T9 to supply the third gate low potential voltage GVss3 supplied through the ninth TFT T9 and the fourth even control node 2Qhe, to the first even control node 2Qe, thereby discharging or resetting the potential of the first even control node 2Qe to the third gate low potential voltage GVss3.

The second inverter circuit IC2 according to one embodiment can include 11th to 15th TFTs T11*a*, T11*b*, T12, T13, T14 and T15.

The 11th TFTs T11*a* and T11*b* can supply the fourth gate high potential voltage GVdde to the second connection node Nc2 in response to the fourth gate high potential voltage GVdde. The 11th TFTs T11*a* and T11*b* according to one embodiment can include (11-1)th and (11-2)th TFTs T11*a* and T11*b* electrically connected with each other in series between the fourth gate high potential voltage line and the second connection node Nc2 to prevent the leakage current due to the off current from occurring.

The (11-1)th TFT T11*a* can be connected to the fourth gate high potential voltage line in the form of diode. The (11-2)th TFT T11*b* can be turned on by the fourth gate high potential voltage GVdde simultaneously with the (11-1)th TFT T11*a* to supply the fourth gate high potential voltage GVdde supplied through the (11-1)th TFT T11*a*, to the second connection node Nc2.

The 12th TFT T12 can be turned on or turned off in accordance with a voltage of the second connection node Nc2, and can supply the fourth gate high potential voltage GVdde to the second even control node 2Qbo when it is turned on.

The 13th TFT T13 can be turned on or turned off in accordance with the voltage of the first even control node 2Qe, and can discharge or reset the potential of the second even control node 2Qbo to the third gate low potential voltage GVss3 when it is turned on.

The 14th TFT T14 can be turned on or turned off in accordance with the voltage of the first even control node 1Qo, and can discharge or reset the potential of the second connection node Nc2 to the second gate low potential voltage GVss2 when it is turned on.

The 15th TFT T15 can be turned on or turned off in accordance with the voltage of the first even control node 2Qe of the (n+1)th stage circuit ST[n+1], and can discharge or reset the potential of the second connection node Nc2 to the second gate low potential voltage GVss2 when it is turned on.

The second sensing control circuit SCC2 according to one embodiment can include 20th to 22th TFTs T20, T21 and T22.

The 20th TFT T20 can be embodied to control the potential of the first even control node 2Qe through the first gate high potential voltage GVdd1 supplied from the first sensing control circuit SCC1 of the nth stage circuit ST[n] in response to the first reset signal RST1.

The 20th TFT T20 can be turned on in accordance with the first reset signal RST1 of the high voltage to supply the first gate high potential voltage GVdd1 supplied through the sharing node Ns of the nth stage circuit ST[n], to the first even control node 2Qe, thereby charging the first gate high potential voltage GVdd1 in the first even control node 2Qe to activate the first even control node 2Qe.

The 21st and 22nd TFTs T21 and T22 can be embodied to discharge or reset the potential of the first even control node 2Qe to the third gate low potential voltage GVss3 in response to the display panel on signal POS supplied when the light emitting display apparatus is powered on. The 21st and 22nd TFTs T21 and T22 can be expressed as second stage initialization circuits.

The 21st TFT T21 can be turned on in accordance with the display panel on signal POS of the high voltage to discharge or reset the potential of the fourth even control node 2Qhe to the third gate low potential voltage GVss3.

The 22nd TFT T22 can be turned on in accordance with the display panel on signal POS of the high voltage simultaneously with the 21st TFT T21 to supply the third gate low potential voltage GVss3 supplied through the 21st TFT T21 and the fourth even control node 2Qhe, to the first even control node 2Qe, thereby charging or resetting the potential of the first even control node 2Qe to the third gate low potential voltage GVss3.

Optionally, the second sensing control circuit SCC2 can be omitted when the nth stage circuit ST[n] is omitted.

The second node reset circuit NRC2 according to one embodiment can include 23rd to 28th TFTs T21 to T28.

The 23rd TFT T23 can be embodied to control the potential of the second even control node 2Qbo through the third gate low potential voltage GVss3 in response to the (n−3)th carry signal CS[n−3]. The 23rd TFT T23 can be expressed as a (2-1)th reset circuit.

The 23rd TFT T23 can be turned on in accordance with the (n−3)th carry signal CS[n−3] of the high voltage in the display mode to discharge or reset the potential of the second even control node 2Qbo to the third gate low potential voltage GVss3.

The 24th and 25th TFTs T24 and T25 can be embodied to control the potential of the second even control node 2Qbo through the third gate low potential voltage GVss3 in response to the voltage of the fifth even control node 2Qme and the first reset signal RST1. The 24th and 25 TFTs T24 and T25 can be expressed as (2-2)th reset circuits.

The 24th TFT T24 can be turned on in accordance with the high voltage of the fifth even control node 2Qme to supply the third gate low potential voltage GVss3 to the fourth connection node Nc4.

The 25th TFT T25 can be turned on in accordance with the first reset signal RST1 of the high voltage to supply the third gate low potential voltage GVss3 supplied through the 24th TFT T24 and the fourth connection node Nc4, to the second even control node 2Qbo. The fourth connection node Nc4 can be a connection line between the 24th TFT T24 and the 25th TFT T25.

The 26th to 28th TFTs T26, T27 and T28 can be embodied to control the potential of the first even control node 2Qe with the third gate low potential voltage GVss3 in response to the voltage of the fourth even control node 2Qhe, the voltage of the fifth even control node 2Qme and the second reset signal RST2, in the sensing mode. The 26th to 28th TFTs T26, T27 and T28 can be expressed as fourth even discharge circuits.

The 26th to 28th TFTs T26, T27 and T28 can electrically be connected in series between the first even control node 2Qe and the fourth connection node Nc4 and electrically connect the first even control node 2Qe with the fourth connection node Nc4 in response to the voltage of the fourth odd control node 2Qhe, the voltage of the fifth even control node 2Qme and the second reset signal RST2.

The 26th TFT T26 can be turned on in accordance with the second reset signal RST2 of the high voltage to electrically connect the first even control node 2Qe with the fifth connection node Nc5.

The 27th TFT T27 can be turned on in accordance with the high voltage of the fifth even control node 2Qme to electrically connect the fifth connection node Nc5 with the fourth even control node 2Qhe.

The 28th TFT T28 can be turned on in accordance with the second reset signal RST2 of the high voltage to electrically connect the fourth even control node 2Qhe with the fourth connection node Nc4.

Optionally, the 24th to 28th TFTs T24, T25, T26, T27 and T28 can be omitted when the second sensing control circuit SCC2 is omitted.

The second output buffer circuit OBC2 according to one embodiment can include 29th to 37th TFTs T29 to T37, and first to third coupling capacitors Cc1, Cc2 and Cc3.

The 29th to 31st TFTs T29, T30 and T31 and the first coupling capacitor Cc1 can be embodied to output an (n+1)th scan shift clock SCCLK[n+1] as the (n+1)th scan signal SC[n+1] in response to the voltages of the first to third even control nodes 2Qe, 2Qbo and 2Qbe. The 29th to 31st TFTs T29, T30 and T31 and the first coupling capacitor Cc1 can be can be expressed as scan output circuits.

The 29th TFT T29 (or first even pull-up TFT) can output the (n+1)th scan signal SC[n+1] having a scan pulse of a high voltage corresponding to the (n+1)th scan shift clock SCCLK[n+1] to the first output node No1 in accordance with the voltage of the first even control node 2Qe to supply the scan pulse of the (n+1)th scan signal SC[n+1] to the first gate line of the nth gate line group.

According to one embodiment, as shown in FIG. 7, based on the (n+1)th scan shift clock SCCLK[n+1], the 29th TFT T29 can supply the first scan pulse SCP1 to the first gate line of the nth gate line group in the image display period of the display mode, and can supply the second scan pulse SCP2 to the first gate line of the (n+1)th gate line group in the black display period of the display mode. In the sensing mode, when driving characteristics of the pixels embodied in the (n+1)th horizontal line are sensed, the 29th TFT T29 can additionally supply the third scan pulse SCP3 and the fourth scan pulse SCP4 to the first gate line of the (n+1)th gate line group in the sensing period RSP based on the (n+1)th scan shift clock SCCLK[n+1].

The 30th TFT T30 (or (1-1)th even pull-down TFT) can output the (n+1)th scan signal SC[n+1] of a low voltage corresponding to the first gate low potential voltage GVss1 to the first output node No1 in accordance with the voltage of the second even control node 2Qbo to supply the (n+1)th scan signal SC[n+1] of the low voltage to the first gate line of the (n+1)th gate line group.

The 31st TFT T31 (or (1-2)th even pull-down TFT) can output the (n+1)th scan signal SC[n+1] of the low voltage corresponding to the first gate low potential voltage GVss1 to the first output node No1 in accordance with the voltage of the third even control node 2Qbe to supply the (n+1)th scan signal SC[n+1] of the low voltage to the first gate line of the (n+1)th gate line group.

The 30th TFT T30 and the 31st TFT T31 according to the present disclosure can be driven alternately on a certain time period basis in accordance with an opposite voltage of each of the second even control node 2Qbo and the third even control node 2Qbe, whereby the degradation speed can be delayed.

The first coupling capacitor Cc1 can be embodied between the first even control node 2Qe and the first output node No1. Optionally, the first coupling capacitor Cc1 can be embodied by parasitic capacitance between the gate electrode of the 29th TFT T29 and the first output node No1.

The 32nd to 34th TFTs T32, T33 and T34 and the second coupling capacitor Cc2 can be embodied to output an (n+1)th sense shift clock SECLK[n+1] as the (n+1)th sense signal SE[n+1] in response to the voltages of the first to third even control nodes 2Qe, 2Qbo and 2Qbe. The 32nd to 34th TFTs T32, T33 and T34 and the second coupling capacitor Cc2 can be can be expressed as sense output circuits.

The 32nd TFT T32 (or second even pull-up TFT) can output the (n+1)th sense signal SE[n+1] having a sense pulse of a high voltage corresponding to the (n+1)th sense shift clock SECLK[n+1] to the second output node No2 in accordance with the voltage of the first even control node 2Qe to supply the sense pulse of the (n+1)th sense signal SE[n+1] to the second gate line of the (n+1)th gate line group.

According to one embodiment, as shown in FIG. 7, based on the (n+1)th sense shift clock SECLK[n+1], the 32nd TFT T32 can supply the first sense pulse SEP1 to the second gate line of the (n+1)th gate line group in the image display period of the display mode. In the sensing mode, when driving characteristics of the pixels embodied in the (n+1)th horizontal line are sensed, the 32nd TFT T32 can additionally supply the second sense pulse SEP2 to the second gate line of the (n+1)th gate line group in the sensing period RSP based on the (n+1)th sense shift clock SECLK[n+1].

The 33rd TFT T33 (or (2-1)th even pull-down TFT) can output the (n+1)th sense shift clock SECLK[n+1] of the low voltage corresponding to the first gate low potential voltage GVss1 to the second output node No2 in accordance with the voltage of the second even control node 2Qbo to supply the (n+1)th sense shift clock SECLK[n+1] of the low voltage to the second gate line of the (n+1)th gate line group.

The 34th TFT T34 (or (2-2)th even pull-down TFT) can output the (n+1)th sense shift clock SECLK[n+1] of the low voltage corresponding to the first gate low potential voltage GVss1 to the second output node No2 in accordance with the voltage of the third even control node 2Qbe to supply the (n+1)th sense shift clock SECLK[n+1] of the low voltage to the second gate line of the (n+1)th gate line group.

The 33rd TFT T33 and the 34th TFT T34 according to the present disclosure can be driven alternately on a certain time period basis in accordance with an opposite voltage of each of the second even control node 2Qbo and the third even control node 2Qbe, whereby the degradation speed can be delayed.

The second coupling capacitor Cc2 can be embodied between the first even control node 2Qe and the second output node No2. Optionally, the second coupling capacitor Cc2 can be embodied by parasitic capacitance between the gate electrode of the 32nd TFT T32 and the second output node No2.

The 35th to 37th TFTs T35, T36 and T37 and the third coupling capacitor Cc3 can be embodied to output an (n+1)th carry shift clock CRCLK[n+1] as the nth carry signal SE[n] in response to the voltages of the first to third even control nodes 2Qe, 2Qbo and 2Qbe. The 35th to 37th TFTs T35, T36 and T37 and the third coupling capacitor Cc3 can be can be expressed as carry output circuits.

The 35th TFT T35 (or third even pull-up TFT) can output the (n+1)th carry signal CS[n+1] having a carry pulse of a high voltage corresponding to the (n+1)th carry shift clock CRCLK[n+1] to the third output node No3 in accordance with the voltage of the first even control node 2Qe to supply the (n+1)th carry signal CS[n+1] of the high voltage to the front or rear stage circuit. According to one embodiment, as shown in FIG. 7, based on the (n+1)th carry shift clock CRCLK[n+1], the 35th TFT T35 can output the (n+1)th carry signal CS[n+1] to the front or rear stage circuit in the display mode based on the (n+1)th carry shift clock CRCLK [n+1].

The 36th TFT T36 (or (3-1)th even pull-down TFT) can output the (n+1)th carry signal CS[n+1] of the low voltage corresponding to the first gate low potential voltage GVss1 to the third output node No3 in accordance with the voltage of the second even control node 2Qbo to supply the (n+1)th carry signal CS[n+1] of the low voltage to the front or rear stage circuit.

The 37th TFT T37 (or (3-2)th even pull-down TFT) can output the (n+1)th carry signal CS[n+1] of the low voltage corresponding to the first gate low potential voltage GVss1 to the third output node No3 in accordance with the voltage of the third even control node 2Qbe to supply the (n+1)th carry signal CS[n+1] of the low voltage to the front or rear stage circuit.

The 36th TFT T36 and the 37th TFT T37 according to the present disclosure can be driven alternately on a certain time period basis in accordance with an opposite voltage of each of the second even control node 2Qbo and the third even control node 2Qbe, whereby the degradation speed can be delayed.

The third coupling capacitor Cc3 can be embodied between the first even control node 2Qe and the third output node No3. Optionally, the third coupling capacitor Cc3 can be embodied by parasitic capacitance between the gate electrode of the 35th TFT T35 and the third output node No3.

Any one of the first and second coupling capacitors Cc1 and Cc2 of the first to third coupling capacitors Cc1, Cc2 and Cc3 can be omitted. For example, the first coupling capacitor Cc2 of the first and second coupling capacitors Cc1 and Cc2 can be omitted.

Figure 10:
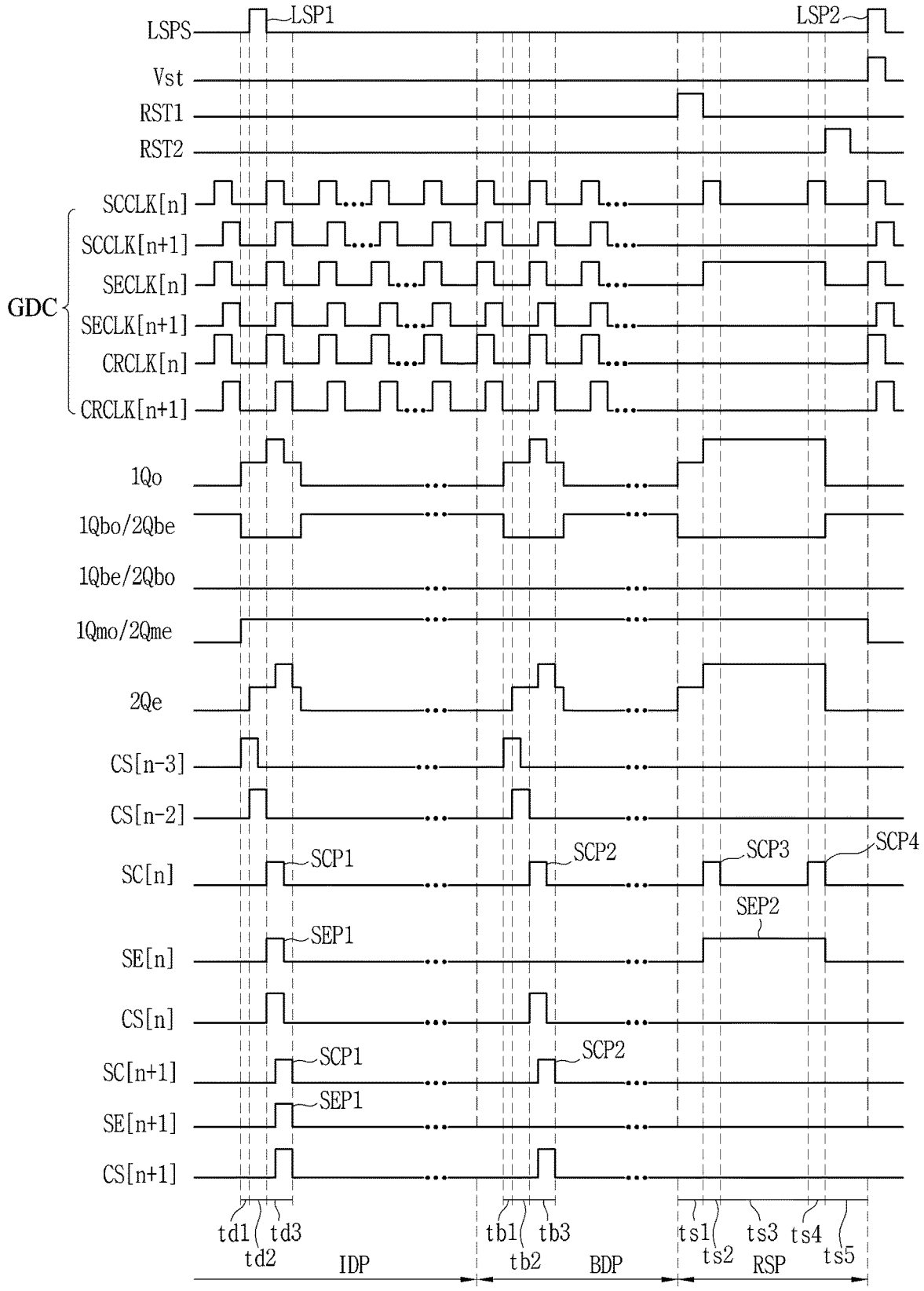
FIG. 10 is a view illustrating input and output waveforms of each of an nth stage circuit and an (n+1)th stage circuit, which are shown in FIG. 9.

FIG. 10 is a view illustrating input and output waveforms of each of an nth stage circuit and an (n+1)th stage circuit shown in FIG. 9, and FIGS. 11A to 11I are views illustrating an operation process of each of an nth stage circuit and an (n+1)th stage circuit shown in FIG. 9. In FIGS. 11A to 11I, thick solid lines indicate nodes and turned-on TFTs, which have a potential of a high voltage or more, and thin solid lines indicate nodes and turned-off TFTs, which have a potential of a low voltage. In description of FIG. 10 and FIGS. 11A to 11I, operation description of TFTs embodied in the nth stage circuit and the (n+1)th stage circuit is substantially the same as the description in FIG. 11, its repeated description will be omitted.

Figure 11A:
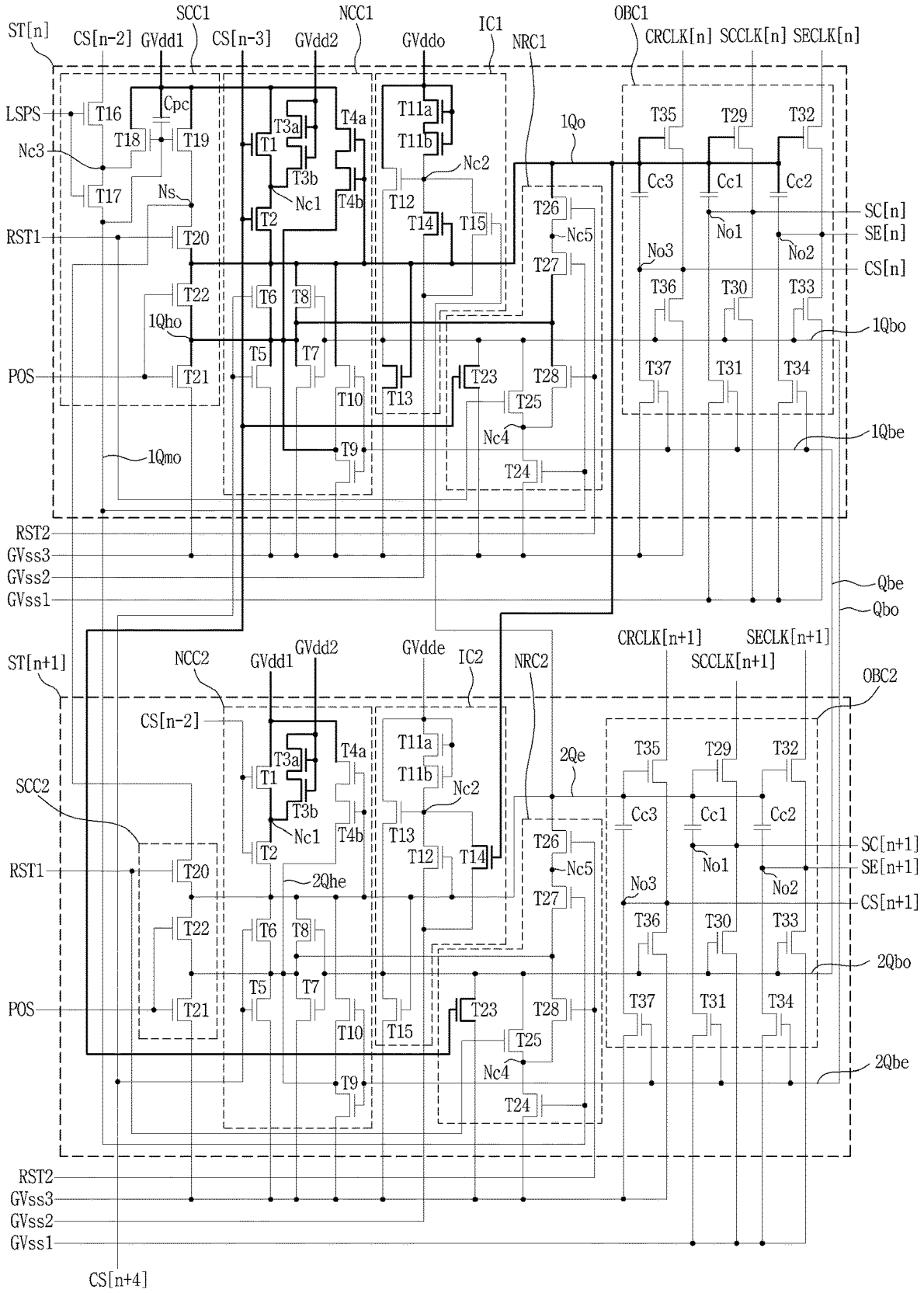
FIGS. 11A to 11I are views illustrating an operation process of each of an nth stage circuit and an (n+1)th stage circuit.

Referring to FIGS. 10 and 11A, for a first display period td1 of the image display period IDP of the display mode according to one embodiment of the present disclosure, the first odd control node 1Qo of the nth stage circuit ST[n] is charged with the first gate high potential voltage GVdd1 in accordance with the operation of the first node control circuit NCC1 responding to the (n−3)th carry signal CS[n−3] of the high voltage. The second odd control node 1Qbo of the nth stage circuit ST[n] is discharged with the third gate low potential voltage GVss3 in accordance with the operation of the first inverter circuit IC1 responding to the charging voltage of the first odd control node 1Qo. The first odd control node 2Qe of the (n+1)th stage circuit ST[n+1] is discharged with the third gate low potential voltage GVss3 in accordance with the operation of the second inverter circuit IC2 responding to the charging voltage of the first odd control node 1Qo of the nth stage circuit ST[n]. The second even control node 2Qbo of the (n+1)th stage circuit ST[n+1] is discharged with the third gate low potential voltage GVss3 in accordance with the operation of the second node reset circuit NRC2 responding to the (n−3)th carry signal CS[n−3] of the high voltage. The third odd control node 1Qbe of the nth stage circuit ST[n] is connected with the second even control node 2Qbo of the (n+1)th stage circuit ST[n+1] and thus discharged with the third gate low potential voltage GVss3. The third even control node 2Qbe of the (n+1)th stage circuit ST[n+1] is connected with the second odd control node 1Qbo of the nth stage circuit ST[n] and thus discharged with the third gate low potential voltage GVss3.

At the first display period td1 of the image display period IDP, the first gate high potential voltage GVdd1 charged in the first odd control node 1Qo of the nth stage circuit ST[n] is supplied from the first gate high potential voltage line through two TFTs T1 and T2, whereby voltage charging characteristic of the first odd control node 1Qo can be enhanced.

At the first display period td1 of the image display period IDP, as each of the nth scan shift clock SCCLK[n], the nth sense shift clock SECLK[n] and the nth carry shift clock CRCLK[n] is maintained at the low voltage, bootstrapping is not generated in the first odd control node 1Qo, whereby each of the odd pull-up TFTs T29, T32 and T35 of the first output buffer circuit OBC1 is maintained at the turn-off state without being turned on.

Figure 11B:
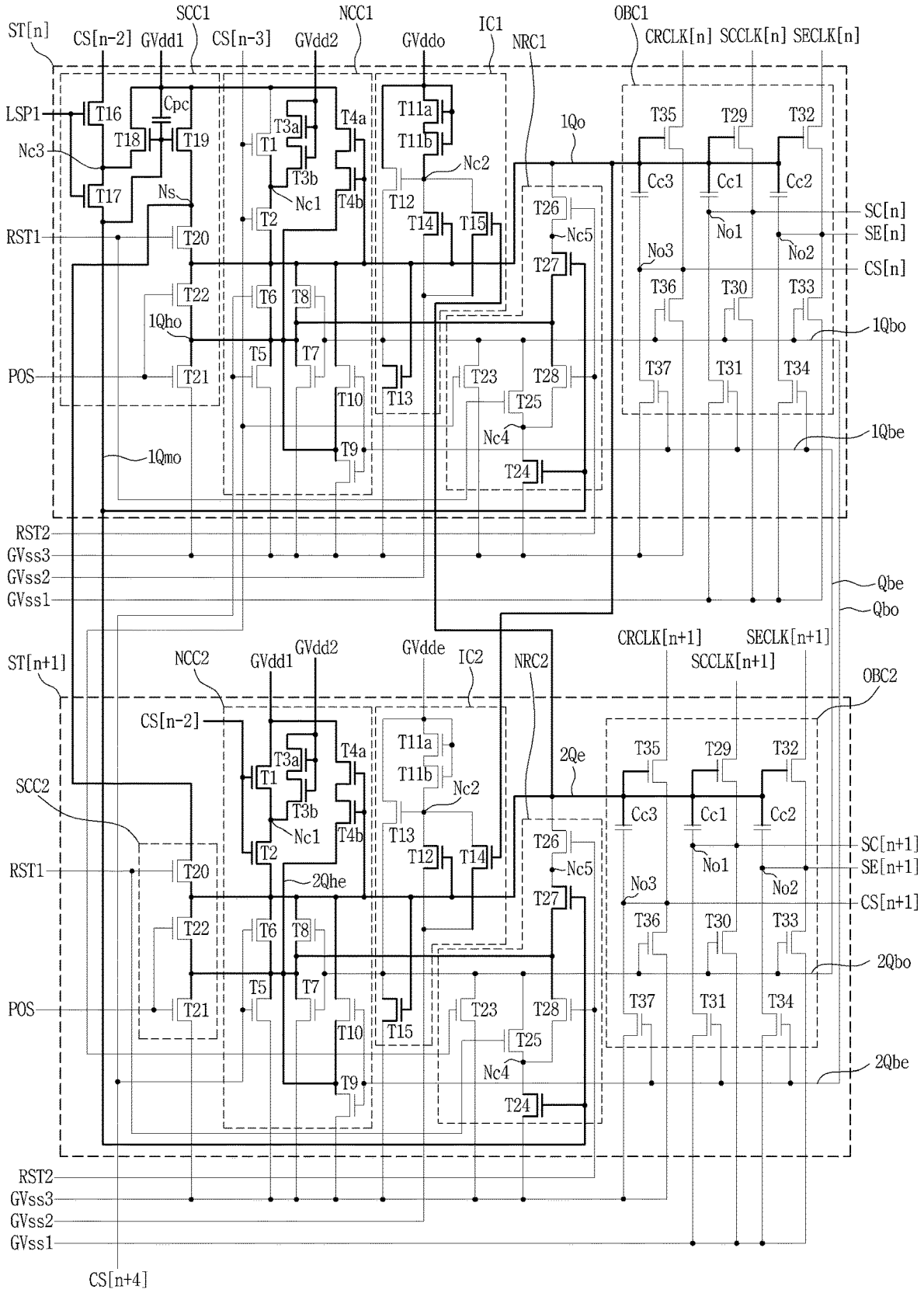

Referring to FIGS. 10 and 11B, for a second display period td2 of the image display period IDP of the display mode according to one embodiment of the present disclosure, the fifth odd control node 1Qmo of the nth stage circuit ST[n] is charged with the first gate high potential voltage GVdd1 in accordance with the operation of the first sensing control circuit SCC1 responding to the (n−2)th carry signal CS[n−2] of the high voltage and the line sensing selection pulse LSP1 of the line sensing preparation signal LSPS having a high voltage. The first odd control node 1Qo of the nth stage circuit ST[n] is maintained at the first gate high potential voltage GVdd1 charged for the first display period td1. The first even control node 2Qe of the (n+1)th stage circuit ST[n+1] is charged with the first gate high potential voltage GVdd1 in accordance with the operation of the second node control circuit NCC2 responding to the (n−2)th carry signal CS[n−2] of the high voltage. The first gate high potential voltage GVdd1 charged in the first even control node 2Qe is supplied from the first gate high potential voltage line through two TFTs T1 and T2, whereby voltage charging characteristics of the first even control node 2Qe can be enhanced. The second odd control node 1Qbo of the nth stage circuit ST[n] is maintained at the third gate low potential voltage GVss3 in accordance with the operation of the first inverter circuit IC1 responding to the charging voltage of the first odd control node 1Qo. The third even control node 2Qbe of the (n+1)th stage circuit ST[n+1] is connected with the second odd control node 1Qbo of the nth stage circuit ST[n] and thus maintained at the third gate low potential voltage GVss3. The second even control node 2Qbo of the (n+1)th stage circuit ST[n+1] is maintained at the third gate low potential voltage GVss3 in accordance with the operation of the second inverter circuit IC2 responding to the charging voltage of the first even control node 2Qe. The third odd control node 1Qbe of the nth stage circuit ST[n] is connected with the second even control node 2Qbo of the (n+1)th stage circuit ST[n+1] and thus maintained at the third gate low potential voltage GVss3.

At the second display period td2 of the image display period IDP, as each of the nth scan shift clock SCCLK[n], the nth sense shift clock SECLK[n] and the nth carry shift clock CRCLK[n] is maintained at the low voltage, bootstrapping is not generated in the first odd control node 1Qo, whereby each of the odd pull-up TFTs T29, T32 and T35 of the first output buffer circuit OBC1 is maintained at the turn-off state without being turned on. And, as each of the (n+1)th scan shift clock SCCLK[n+1], the (n+1)th sense shift clock SECLK[n+1] and the (n+1)th carry shift clock CRCLK[n+1] is maintained at the low voltage, bootstrapping is not generated in the first even control node 2Qe, whereby each of the even pull-up TFTs T29, T32 and T35 of the second output buffer circuit OBC2 is maintained at the turn-off state without being turned on.

Figure 11C:
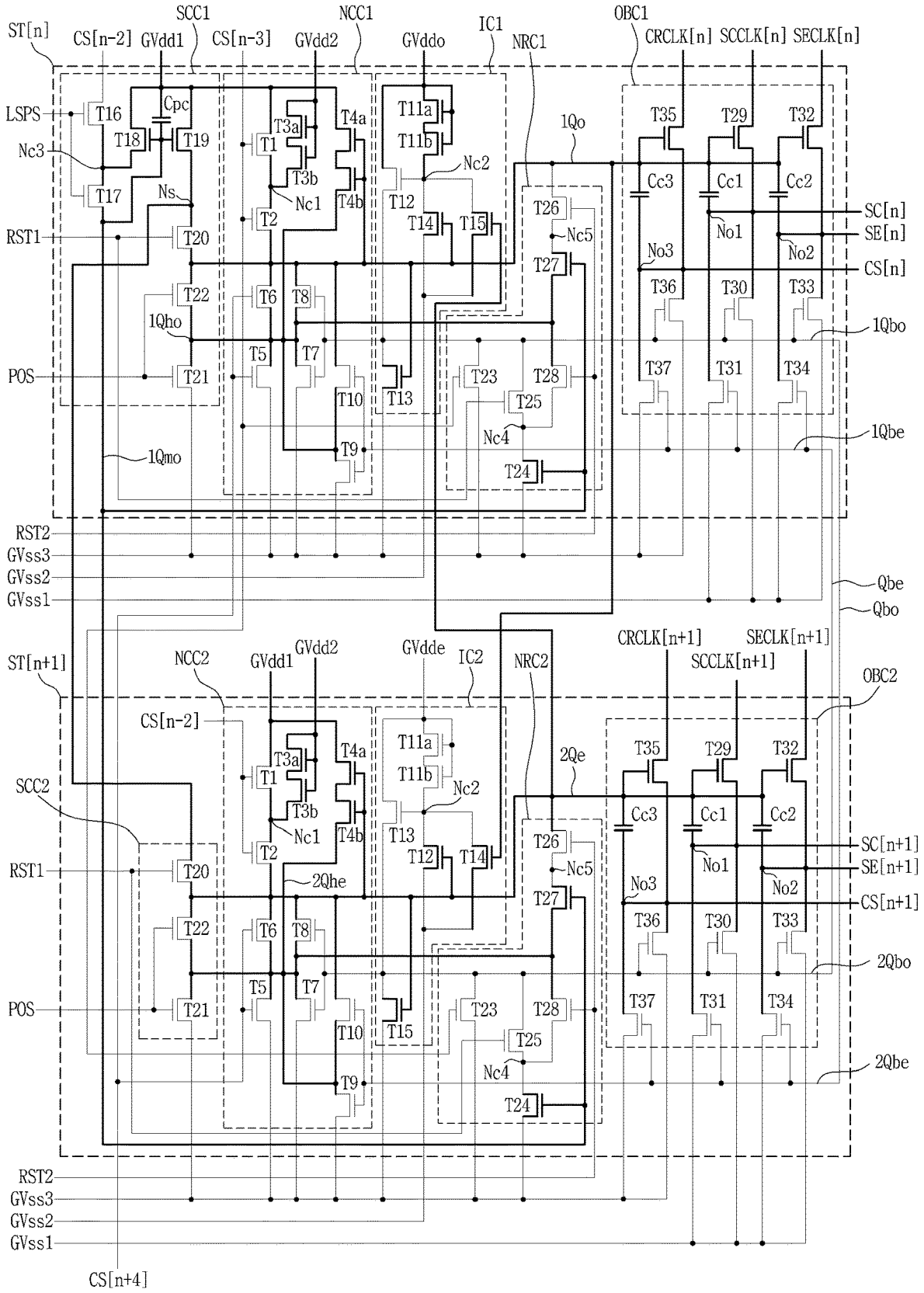

Referring to FIGS. 10 and 11C, for a third display period td3 of the image display period IDP of the display mode according to one embodiment of the present disclosure, each of the second to fifth odd control nodes 1Qbo, 1Qbe, 1Qho and 1Qmo of the nth stage circuit ST[n] and each of the first to fifth even control nodes 2Qe, 2Qbo, 2Qbe, 2Qhe and 2Qme of the (n+1)th stage circuit ST[n+1] maintains the voltage state of the second display period td2 as it is.

For the third display period td3 of the image display period IDP, as each of the nth scan shift clock SCCLK[n], the nth sense shift clock SECLK[n] and the nth carry shift clock CRCLK[n] is input as the high voltage, bootstrapping is generated in the first odd control node 1Qo, whereby each of the odd pull-up TFTs T29, T32 and T35 of the first output buffer circuit OBC1 is completely turned on. Therefore, the nth stage circuit ST[n] outputs the nth scan signal SC[n] having a first scan pulse SCP1 of a high voltage through the first output node No1, outputs the nth sense signal SE[n] having a first sense pulse SEP1 of a high voltage through the second output node No2, and outputs the nth carry signal CS[n] having a high voltage through the third output node No3. Therefore, an image data addressing period for the pixels disposed in the nth horizontal line can be performed.

At the third display period td3 of the image display period IDP, as each of the (n+1)th scan shift clock SCCLK[n+1], the (n+1)th sense shift clock SECLK[n+1] and the (n+1)th carry shift clock CRCLK[n+1] is maintained at the low voltage and then input as the high voltage for a clock non-overlap period, bootstrapping is generated in the first even control node 2Qe, whereby each of the odd pull-up TFTs T29, T32 and T35 of the first output buffer circuit OBC1 is completely turned on. Therefore, the (n+1)th stage circuit ST[n+1] outputs the (n+1)th scan signal SC[n+1] having a first scan pulse SCP1 of a high voltage through the first output node No1, outputs the (n+1)th sense signal SE[n+1] having a first sense pulse SEP1 of a high voltage through the second output node No2, and outputs the (n+1)th carry signal CS[n+1] having a high voltage through the third output node No3. Therefore, an image data addressing period for the pixels disposed in the (n+1)th horizontal line can be performed.

Figure 11D:
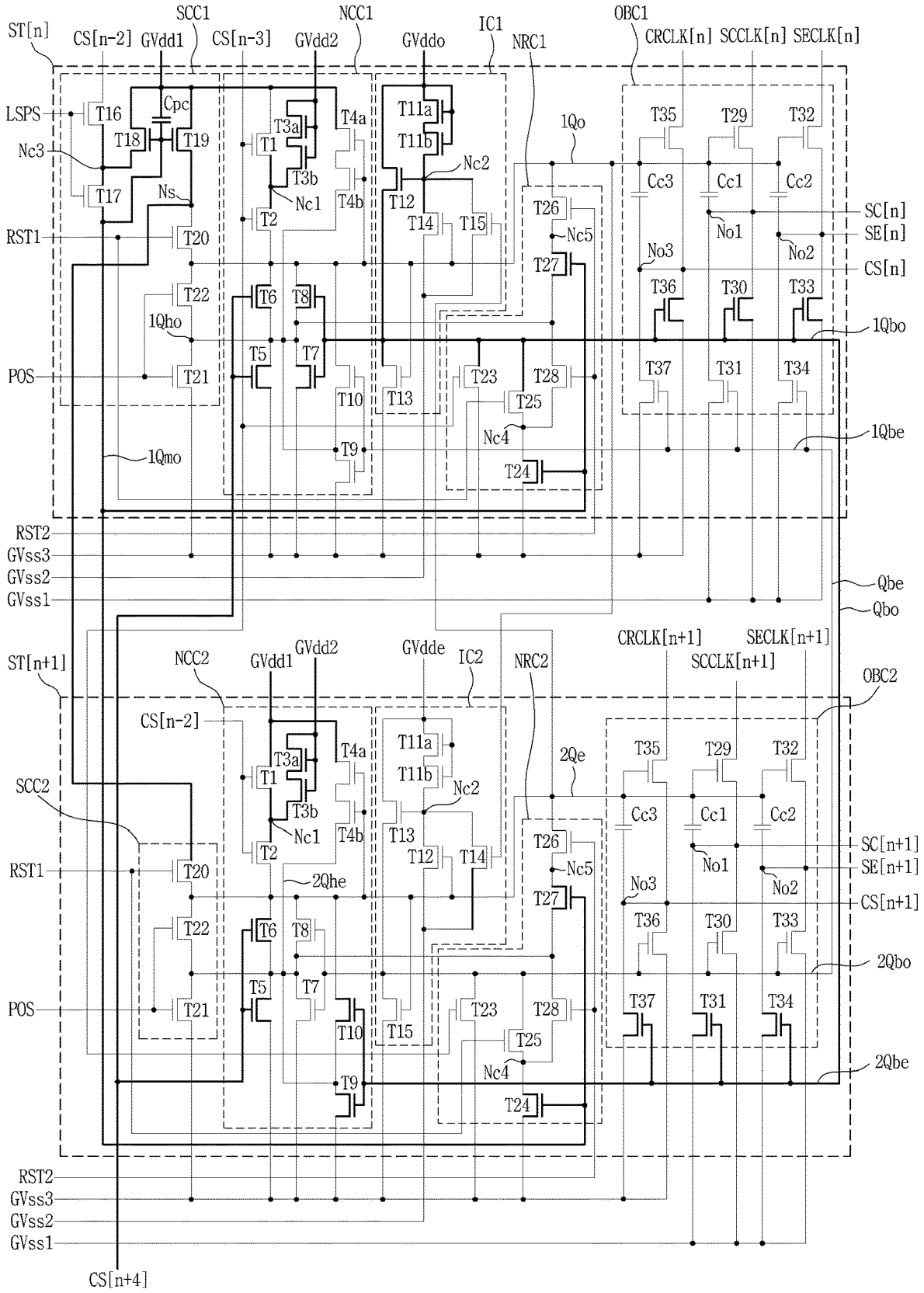

Referring to FIGS. 10 and 11D, after a third display period td3 of the image display period IDP of the display mode according to one embodiment of the present disclosure, the fifth odd control node 1Qmo of the nth stage circuit ST[n] maintains the charging state as it is.

After the third display period td3 of the image display period IDP, the first odd control node 1Qo of the nth stage circuit ST[n] is discharged with the third gate low potential voltage GVss3 in accordance with the operation of the first node control circuit NCC1 responding to the (n+4)th carry signal CS[n+4] (or the (n+3)th carry signal CS[n+3]) of the high voltage. The second odd control node 1Qbo of the nth stage circuit ST[n] is charged with the third gate high potential voltage GVddo in accordance with the operation of the first inverter circuit IC1 responding to discharge of the first odd control node 1Qo. Therefore, as each of the odd pull-down TFTs T30, T33 and T36 is turned on by the charging voltage of the second odd control node 1Qbo, the first output buffer circuit OBC1 outputs the nth scan signal SC[n] of the low voltage through the first output node No1, outputs the nth sense signal SE[n] of the low voltage through the second output node No2, and outputs the nth carry signal CS[n] of the low voltage through the third output node No3. Therefore, the pixels disposed in the nth horizontal line can emit light in accordance with a data current corresponding to an image data voltage which is addressed.

After the third display period td3 of the image display period IDP, the first even control node 2Qe of the (n+1)th stage circuit ST[n+1] is discharged with the third gate low potential voltage GVss3 in accordance with the operation of the second node control circuit NCC2 responding to the (n+4)th carry signal CS[n+4] of the high voltage. The third even control node 2Qbe of the (n+1)th stage circuit ST[n+1] is connected with the second odd control node 1Qbo of the nth stage circuit ST[n] and thus charged with the third gate high potential voltage GVddo. Therefore, as each of the even pull-down TFTs T31, T34 and T37 is turned on by the charging voltage of the third even control node 2Qbe, the second output buffer circuit OBC2 outputs the (n+1)th scan signal SC[n+1] of the low voltage through the first output node No1, outputs the (n+1)th sense signal SE[n+1] of the low voltage through the second output node No2, and outputs the (n+1)th carry signal CS[n+1] of the low voltage through the third output node No3. Therefore, the pixels disposed in the (n+1)th horizontal line can emit light in accordance with a data current corresponding to an image data voltage which is addressed.

Figure 11E:
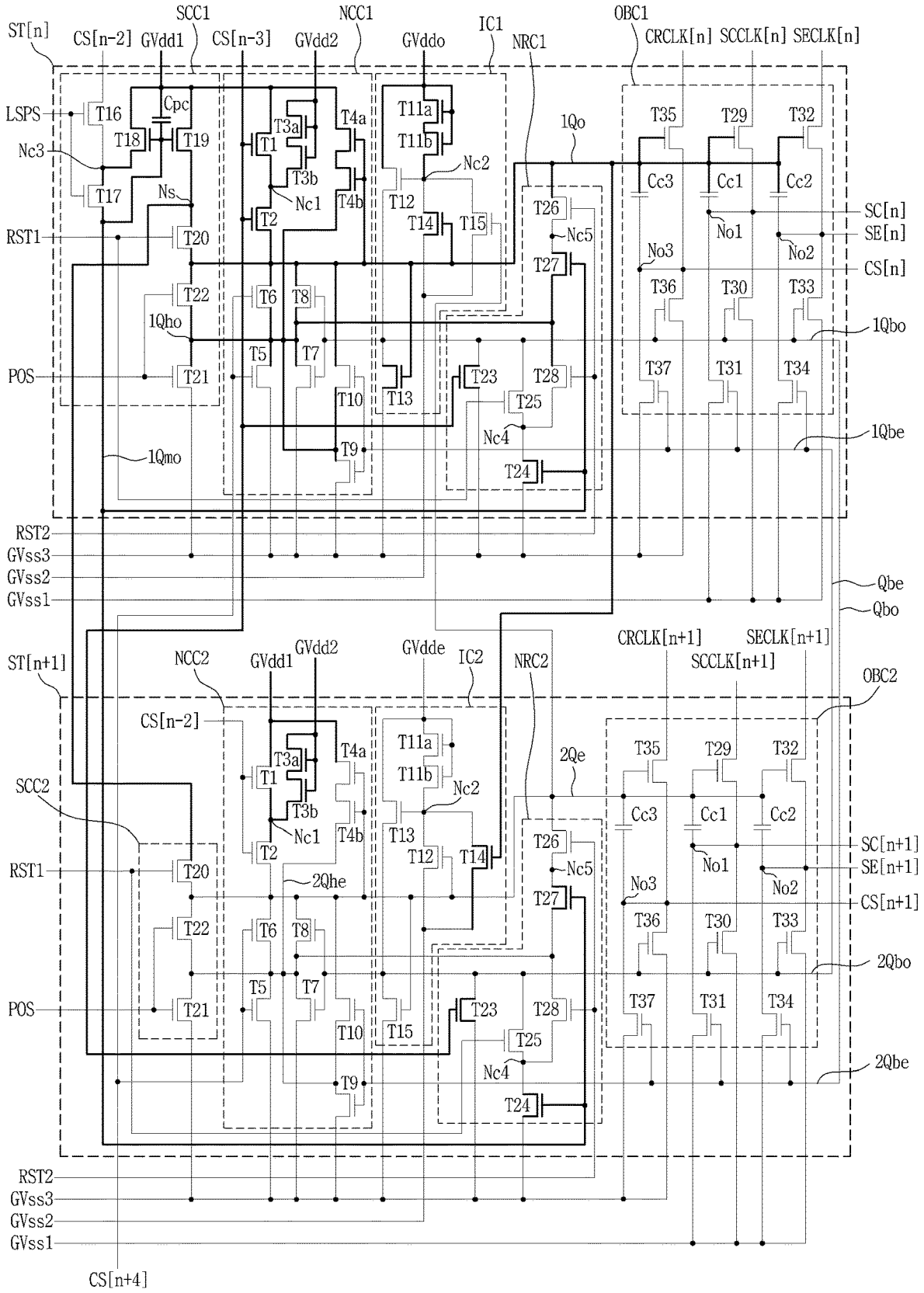

Referring to FIGS. 10 and 11E, for the black display period BDP of the display mode according to one embodiment of the present disclosure, the fifth odd control node 1Qmo of the nth stage circuit ST[n] maintains the charging state as it is.

For a first black period tb1 of the black display period BDP, the first odd control node 1Qo of the nth stage circuit ST[n] is charged with the first gate high potential voltage GVdd1 in accordance with the operation of the first node control circuit NCC1 responding to the (n−3)th carry signal CS[n−3] of the high voltage. The second odd control node 1Qbo of the nth stage circuit ST[n] is discharged with the third gate low potential voltage GVss3 in accordance with the operation of the first inverter circuit IC1 responding to the charging voltage of the first odd control node 1Qo.

At the first black period tb1 of the black display period BDP, the first gate high potential voltage GVdd1 charged in the first odd control node 1Qo of the nth stage circuit ST[n] is supplied from the first gate high potential voltage line through two TFTs T1 and T2, whereby voltage charging characteristics of the first odd control node 1Qo can be enhanced.

For the first black period tb1 of the black display period BDP, the first even control node 2Qe of the (n+1)th stage circuit ST[n+1] is discharged with the third gate low potential voltage GVss3 in accordance with the operation of the second inverter circuit IC2 responding to the charging voltage of the first odd control node 1Qo. The second even control node 2Qbo of the (n+1)th stage circuit ST[n+1] is connected with the third odd control node 1Qbe of the nth stage circuit ST[n] and thus maintained at the third gate low potential voltage GVss3. The third even control node 2Qbe of the nth stage circuit ST[n] is connected with the second odd control node 1Qbo of the nth stage circuit ST[n] and thus maintained at the third gate low potential voltage GVss3.

At the second black period tb2 and the third black period tb3 after the first black period tb1 of the black display period BDP, the fifth odd control node 1Qmo of the nth stage circuit ST[n] maintains the charging state as it is. Since the first black period tb1 and the second black period tb2 are substantially the same as the second display period td2 and the third display period td3 shown in FIG. 11D except that the nth scan shift clock SCCLK[n] is only input as the high voltage, their repeated description will be omitted. Therefore, for the second black period tb2 and the third black period tb3 of the black display period BDP, the pixels disposed in the nth horizontal line can display a black image as a black data voltage is addressed by the nth scan signal SC[n] having the second scan pulse SCP2 of the high voltage.

Figure 11F:
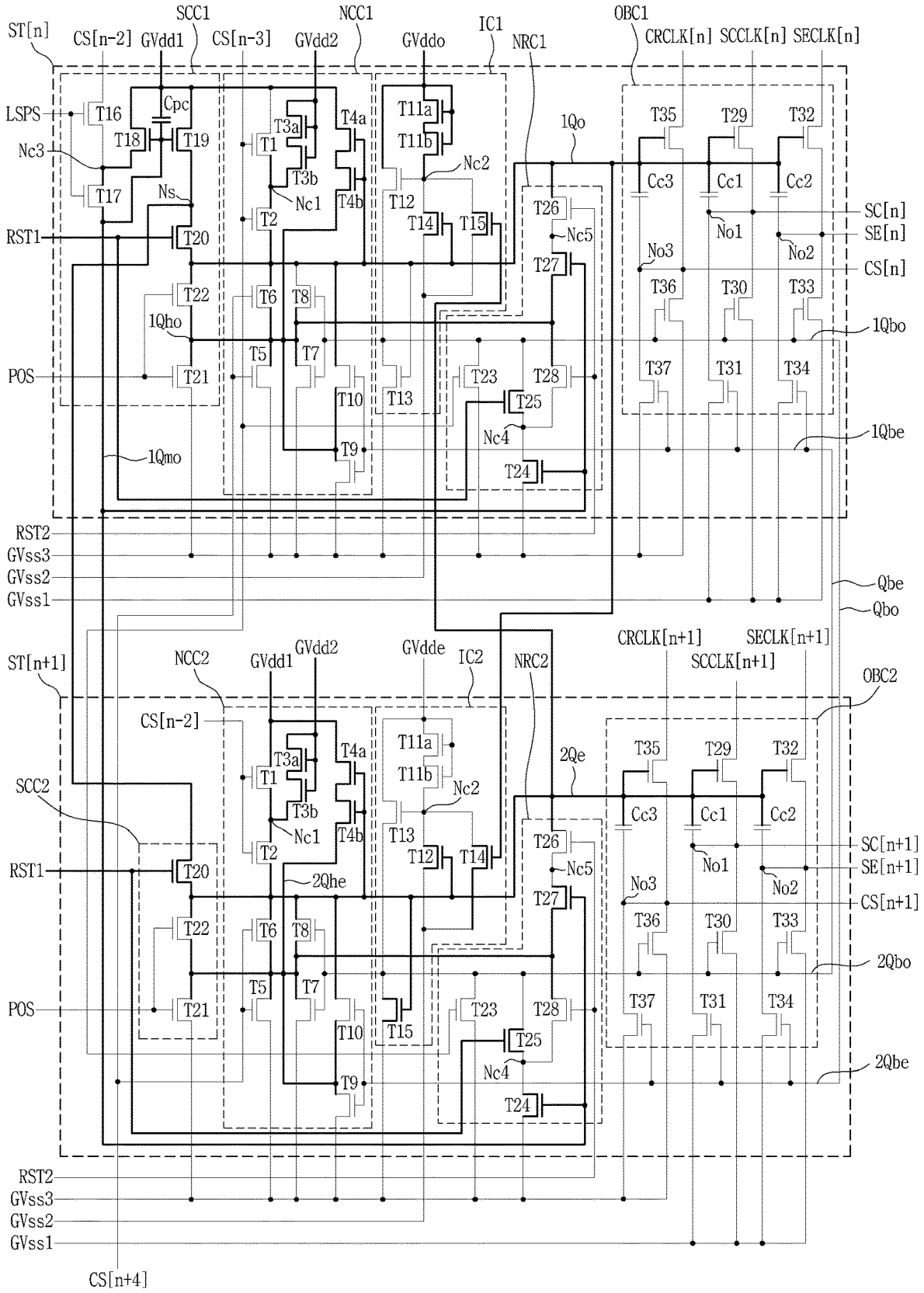

Referring to FIGS. 10 and 11F, at the first sensing period ts1 of the sensing period RSP of the sensing mode according to one embodiment of the present disclosure, the first odd control node 1Qo of the nth stage circuit ST[n] is charged with the first gate high potential voltage GVdd1 in accordance with the operation of the first sensing control circuit SCC1 responding to the first reset signal RST1 of the high voltage. The second odd control node 1Qbo of the nth stage circuit ST[n] is discharged with the third gate low potential voltage GVss3 in accordance with the operation of the first inverter circuit IC1 responding to the charging voltage of the first odd control node 1Qo.

For the first sensing period ts1 of the sensing period RSP, the first even control node 2Qe of the (n+1)th stage circuit ST[n+1] is discharged with the first gate high potential voltage GVdd1 supplied through the sharing node Ns of the nth stage circuit ST[n] in accordance with the operation of the second sensing control circuit SCC2 responding to the first reset signal RST1 of the high voltage. The second even control node 2Qbo of the (n+1)th stage circuit ST[n+1] is discharged with the third gate low potential voltage GVss3 in accordance with the operation of the second inverter circuit IC2 responding to the charging voltage of the first even control node 2Qe.

At the first sensing period ts1 of the sensing period RSP, as each of the nth scan shift clock SCCLK[n] and the nth sense shift clock SECLK[n] is maintained at the low voltage, bootstrapping is not generated in the first odd control node 1Qo, whereby each of the odd pull-up TFTs T29, T32 and T35 of the first output buffer circuit OBC1 is maintained at the turn-off state without being turned on. Likewise, at the first sensing period ts1 of the sensing period RSP, as each of the (n+1)th scan shift clock SCCLK[n+1], the (n+1)th sense shift clock SECLK[n+1] and the (n+1)th carry shift clock CRCLK[n+1] is maintained at the low voltage, bootstrapping is not generated in the first even control node 2Qe, whereby each of the even pull-up TFTs T32, T35 and T38 of the second output buffer circuit OBC2 is maintained at the turn-off state without being turned on.

Figure 11G:
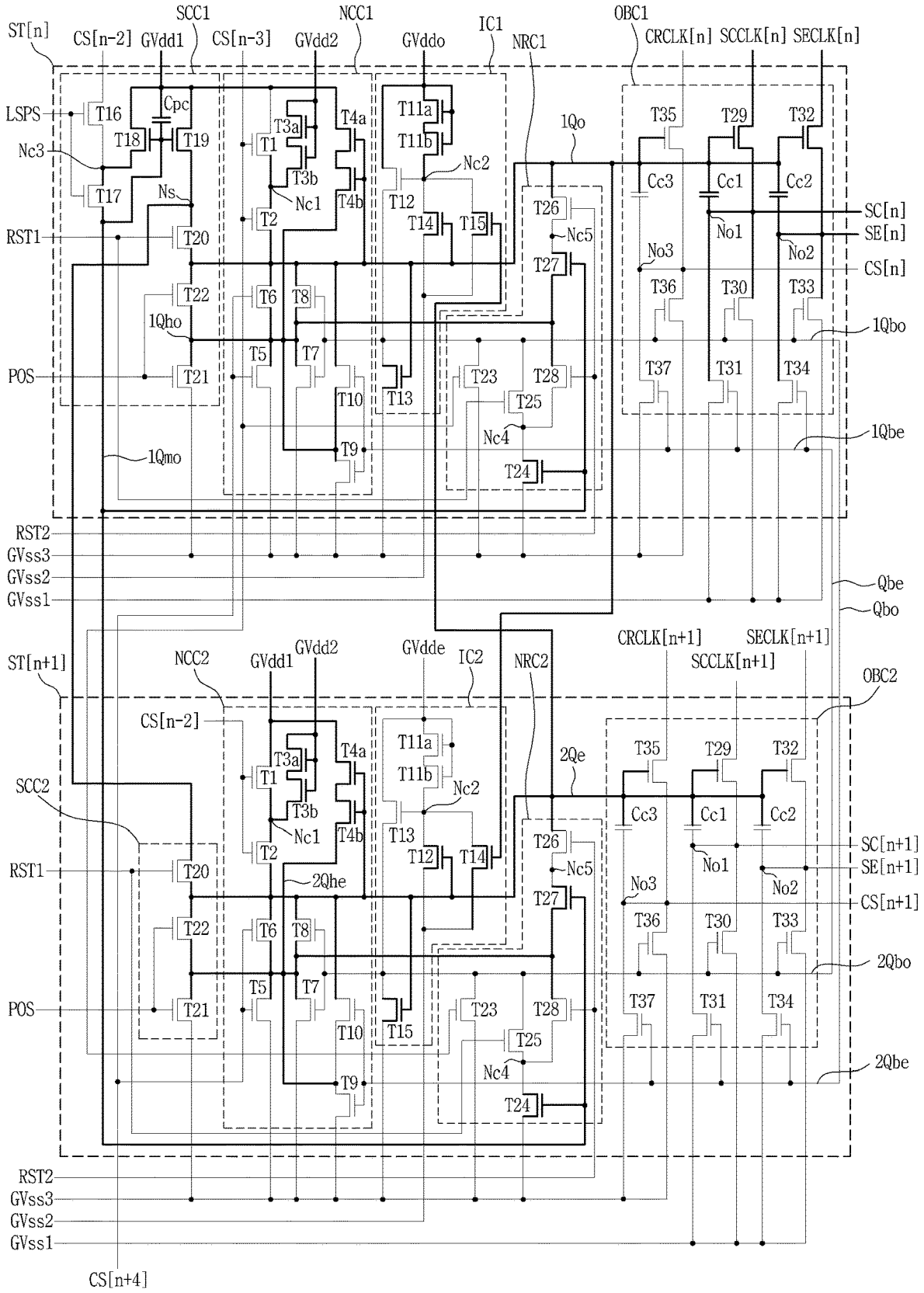

Referring to FIGS. 10 and 11G, for the second sensing period ts2 of the sensing period RSP of the sensing mode according to one embodiment of the present disclosure, each of the nth scan shift clock SCCLK[n] and the nth sense shift clock SECLK[n] is input as the high voltage and the nth carry shift clock CRCLK[n] is input as the low voltage, bootstrapping is generated in the first odd control node 1Qo, whereby each of the odd pull-up TFTs T29, T32 and T35 of the first output buffer circuit OBC1 is completely turned on. Therefore, the nth stage circuit ST[n] outputs the nth scan signal SC[n] having a third scan pulse SCP3 of a high voltage through the first output node No1, outputs the nth sense signal SE[n] having a second sense pulse SEP2 of a high voltage through the second output node No2, and outputs the nth carry signal CS[n] having a low voltage through the third output node No3. Therefore, a sensing data addressing period for the pixels disposed in the nth horizontal line can be performed for the second sensing period ts2 of the sensing period RSP.

At the second sensing period ts2 of the sensing period RSP, as each of the (n+1)th scan shift clock SCCLK[n+1], the (n+1)th sense shift clock SECLK[n+1] and the (n+1)th carry shift clock CRCLK[n+1] is maintained at the low voltage, bootstrapping is not generated in the first even control node 2Qe, whereby each of the even pull-up TFTs T29, T32 and T35 of the second output buffer circuit OBC2 is maintained at the turn-off state without being turned on.

For a fourth sensing period ts4 after the third sensing period ts3 of the sensing period RSP, each of the nth scan shift clock SCCLK[n] and the nth carry shift clock CRCLK [n] is input as the low voltage and the nth sense shift clock SECLK[n] is input as the high voltage, whereby each of the odd pull-up TFTs T29, T32 and T35 of the first output buffer circuit OBC1 is maintained at the turn-on state. Therefore, the nth stage circuit ST[n] outputs the nth scan signal SC[n] of a low voltage through the first output node No1, outputs the nth sense signal SE[n] having a second sense pulse SEP2 of a high voltage through the second output node No2 as it is, and outputs the nth carry signal CS[n] having a low voltage through the third output node No3 as it is. Therefore, a sampling period for sensing driving characteristics of the pixels disposed in the nth horizontal line can be performed for the fourth sensing period ts4 of the sensing period RSP.

For a fifth sensing period ts5 after the fourth sensing period ts4 of the sensing period RSP, the nth scan shift clock SCCLK[n] is input as the high voltage, the nth sense shift clock SECLK[n] is maintained as the high voltage and the nth carry shift clock CRCL[n] is maintained at the low voltage, whereby each of the odd pull-up TFTs T29, T32 and T35 of the first output buffer circuit OBC1 is maintained at the turn-on state. Therefore, the nth stage circuit ST[n] outputs the nth scan signal SC[n] having a fourth scan pulse SCP4 of a high voltage through the first output node No1, outputs the nth sense signal SE[n] having a second sense pulse SEP2 of a high voltage through the second output node No2 as it is, and outputs the nth carry signal CS[n] having a low voltage through the third output node No3 as it is. Therefore, a data restoring period for restoring a light emission state of the pixels disposed in the nth horizontal line to a previous state of the sensing period RSP can be performed for the fourth sensing period ts4 of the sensing period RSP.

Figure 11H:
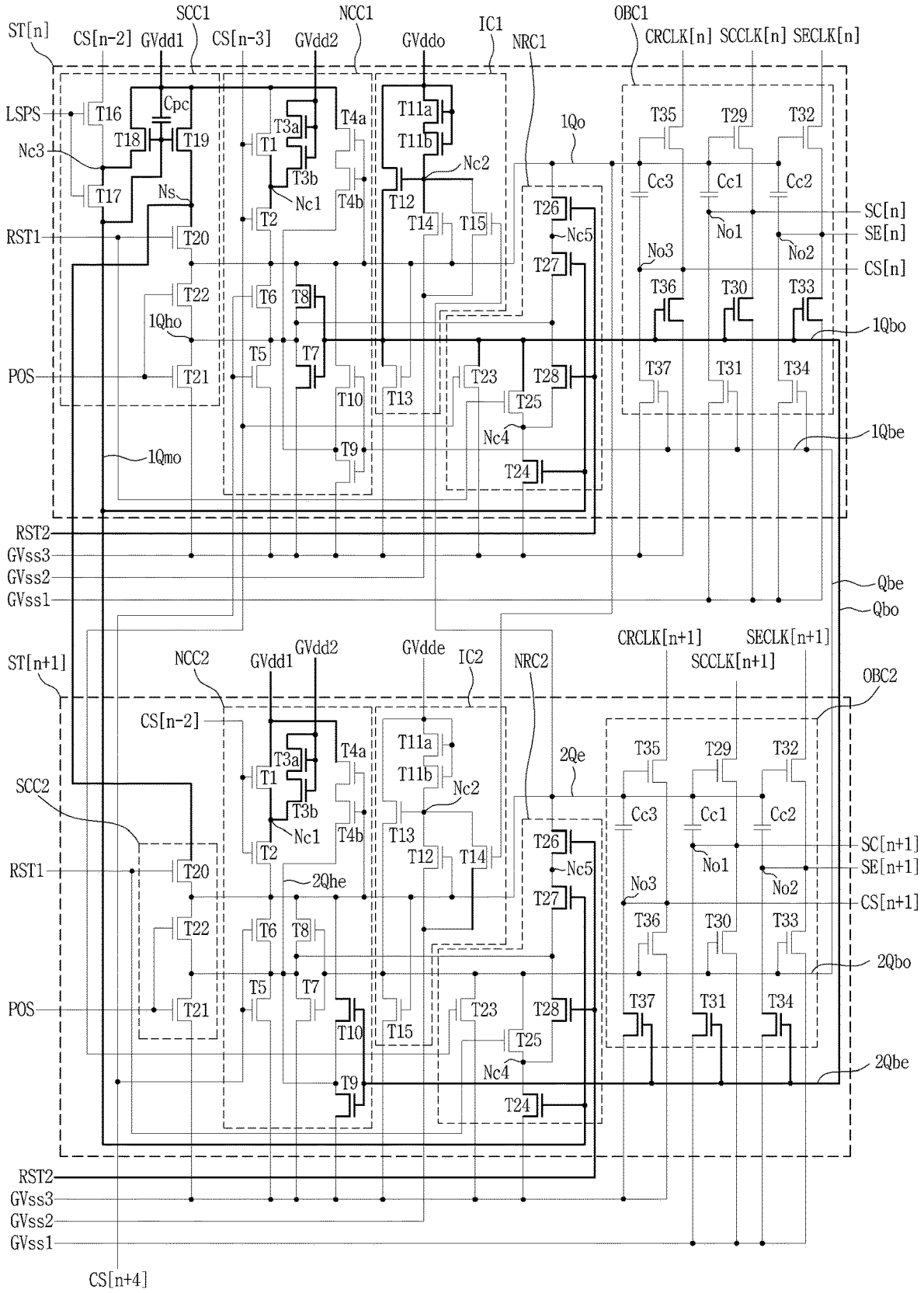

Referring to FIGS. 10 and 11H, for the fifth sensing period ts5 of the sensing period RSP of the sensing mode according to one embodiment of the present disclosure, the first odd control node 1Qo of the nth stage circuit ST[n] is discharged with the third gate low potential voltage GVss3 in accordance with the operation of the first node reset circuit NRC1 responding to the second reset signal RST2 of the high voltage and the charging voltage of the fifth odd control node 1Qmo. Therefore, the sensing mode for the pixels disposed in the nth horizontal line can be released.

At the fifth sensing period ts5 of the sensing period RSP, the second odd control node 1Qbo of the nth stage circuit ST[n] is charged with the third gate high potential voltage GVddo in accordance with the operation of the first inverter circuit IC1 responding to the discharge voltage of the first odd control node 1Qo. Therefore, as each of the odd pull-down TFTs T30, T33 and T36 is turned on by the charging voltage of the second odd control node 1Qbo, the first output buffer circuit OBC1 outputs the nth scan signal SC[n] of a low voltage through the first output node No1, outputs the nth sense signal SE[n] of a low voltage through the second output node No2, and outputs the nth carry signal CS[n] having a low voltage through the third output node No3.

For the fifth sensing period ts5 of the sensing period RSP, the first odd control node 2Qe of the (n+1)th stage circuit ST[n+1] is discharged with the third gate low potential voltage GVss3 in accordance with the operation of the second node reset circuit NRC2 responding to the second reset signal RST2 of the high voltage and the discharge voltage of the fifth odd control node 1Qmo. The third even control node 2Qbe of the (n+1)th stage circuit ST[n+1] is connected with the second odd control node 2Qbo of the nth stage circuit ST[n] and thus charged with the third gate high potential voltage GVddo. Therefore, as each of the even pull-down TFTs T31, T34 and T37 is turned on by the charging voltage of the third even control node 2Qbe, the second output buffer circuit OBC2 outputs the (n+1)th scan signal SC[n+1] of a low voltage through the first output node No1, outputs the (n+1)th sense signal SE[n+1] of a low voltage through the second output node No2, and outputs the (n+1)th carry signal CS[n+1] having a low voltage through the third output node No3.

Figure 11I:
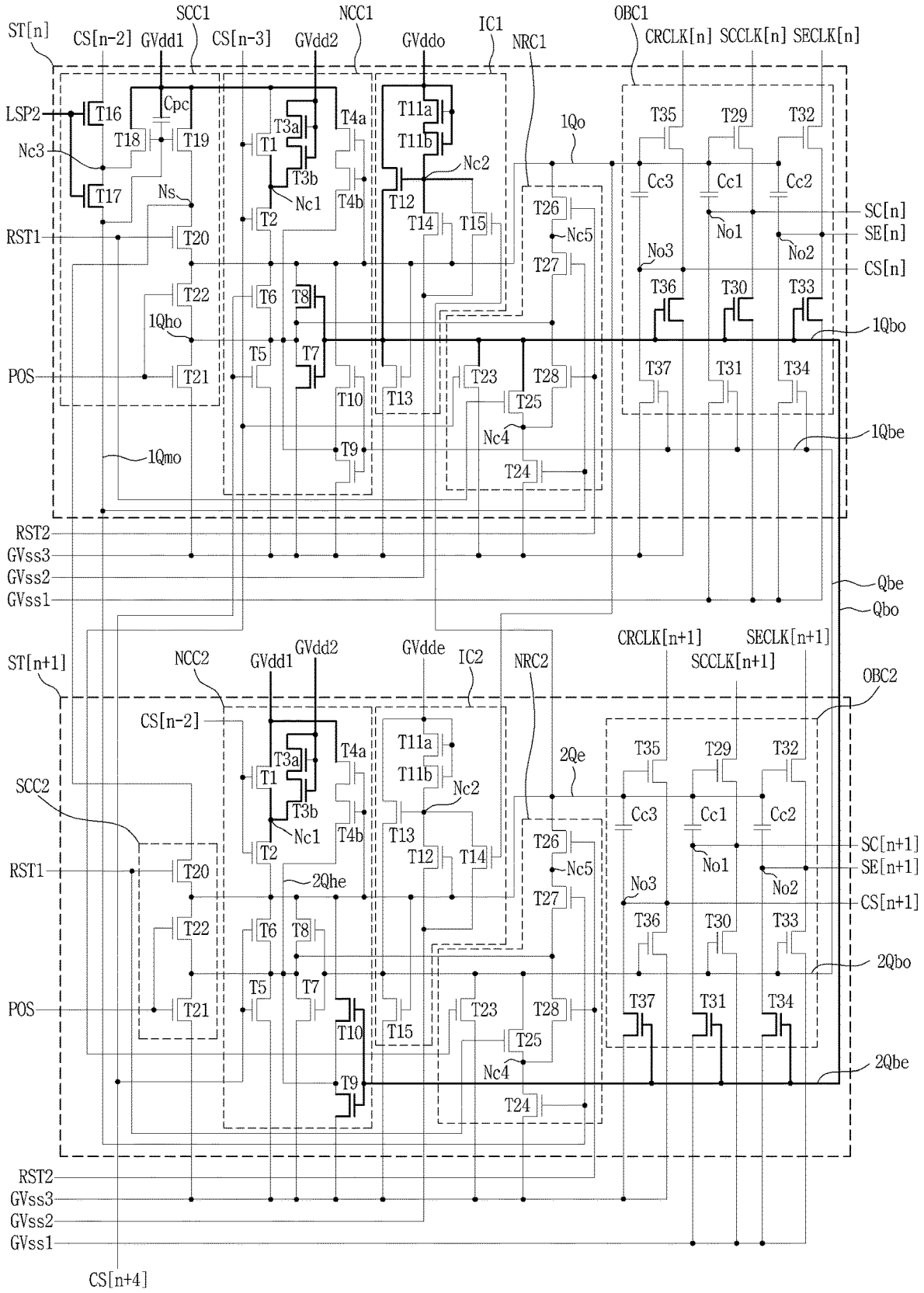

Referring to FIGS. 10 and 11I, at the start timing of the display mode after the sensing mode according to one embodiment of the present disclosure, the fifth odd control node 1Qmo of the nth stage circuit ST[n] is charged or discharged with the low voltage of the (n−2)th carry signal CS[n−2] in accordance with the operation of the first sensing control circuit SCC1 responding to the line sensing release pulse LSP2 having a high voltage of the line sensing preparation signal LSPS. The second odd control node 1Qbo of the nth stage circuit ST[n] maintains the charged state with the third gate high potential voltage GVddo. Therefore, as each of the odd pull-down TFTs T30, T33 and T36 is maintained at the turn-on state by the charging voltage of the second odd control node 1Qbo, the first output buffer circuit OBC1 outputs the nth scan signal SC[n] of a low voltage through the first output node No1, outputs the nth sense signal SE[n] of a low voltage through the second output node No2, and outputs the nth carry signal CS[n] having a low voltage through the third output node No3.

At the start timing of the display mode after the sensing mode, the third even control node 2Qbe of the (n+1)th stage circuit ST[n+1] is connected with the second odd control node 2Qbo of the nth stage circuit ST[n] and thus maintains the charged state with the third gate high potential voltage GVddo. Therefore, as each of the even pull-down TFTs T31, T34 and T37 is turned on by the charging voltage of the third even control node 2Qbe, the second output buffer circuit OBC2 outputs the (n+1)th scan signal SC[n+1] of a low voltage through the first output node No1, outputs the (n+1)th sense signal SE[n+1] of a low voltage through the second output node No2, and outputs the (n+1)th carry signal CS[n+1] having a low voltage through the third output node No3.

Figure 12A:
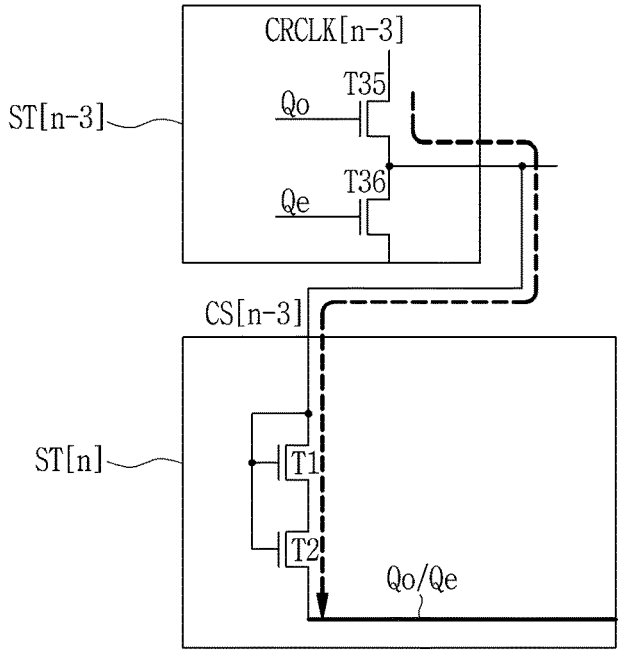
FIGS. 12A and 12B are views illustrating a charging path of a first control node embodied in each stage circuit of a gate driving circuit according to one embodiment of the present disclosure and a comparison example.
Figure 12B:
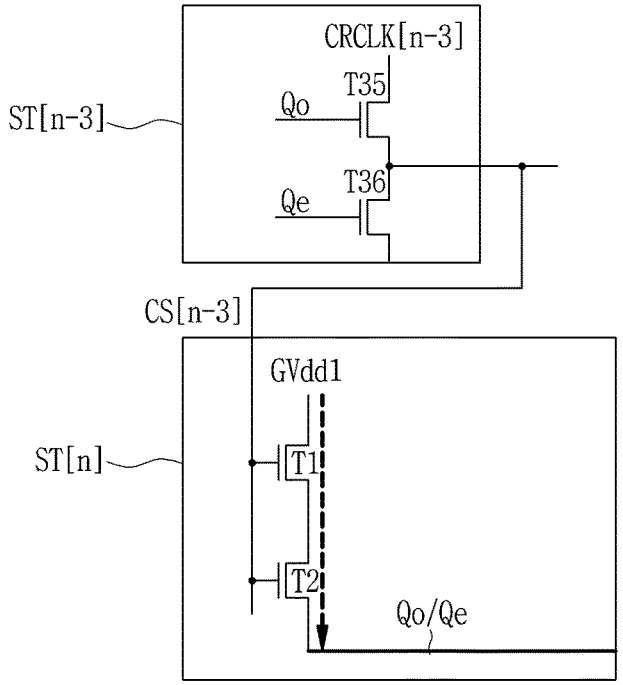
Figure 13A:
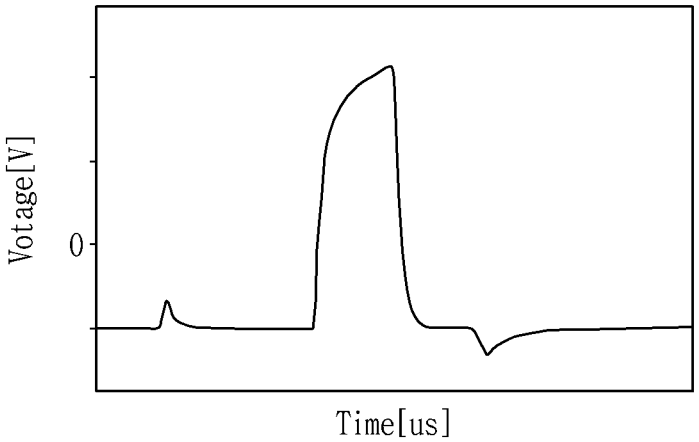
FIGS. 13A and 13B are waveforms illustrating output characteristics of gate driving circuits according to one embodiment of the present disclosure and a comparison example.
Figure 13B:
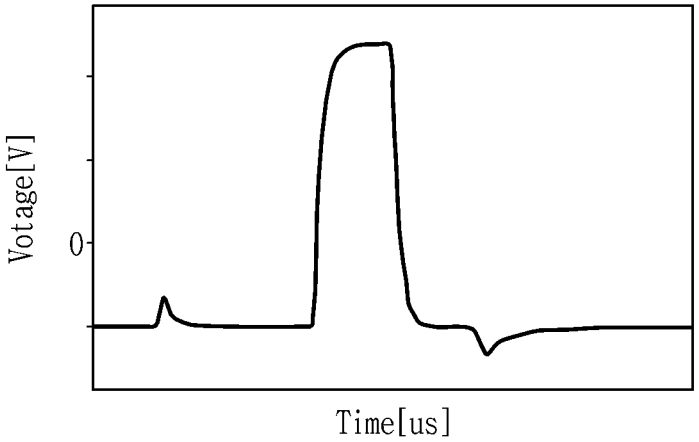

FIGS. 12A and 12B are views illustrating a charging path of a first control node embodied in each stage circuit of a gate driving circuit according to one embodiment of the present disclosure and a comparison example, and FIGS. 13A and 13B are waveforms illustrating output characteristics of gate driving circuits according to one embodiment of the present disclosure and a comparison example.

Referring to FIG. 12A, according to the comparison example, first control nodes Qo and Qe embodied in each stage circuit ST[n] can be charged with the high voltage of the (n−3)th carry signal CS[n−3] of the high voltage supplied through the first and second TFTs T1 and T2 turned on by the (n−3)th carry signal CS[n−3] of the high voltage output from a front stage circuit ST[n−3]. At this time, the high voltage of the (n−3)th carry signal CS[n−3] can be charged in the first control nodes Qo and Qe by passing through the pull-up TFT T35 of the front stage circuit ST[n−3], the first TFT T1 and the second TFT T2 from a carry clock line. Therefore, in the comparison example, a voltage charging rate of the first control nodes Qo and Qe can be deteriorated by a voltage drop of the (n−3)th carry signal CS[n−3], which is generated by resistance components of three TFTs disposed on a charging path of the first control nodes Qo and Qe. Particularly, in the comparison example, when an on-current or mobility characteristic of the TFT is deteriorated by degradation or threshold voltage shift of the TFT, the voltage charging rate of the first control nodes Qo and Qe can be more deteriorated. Therefore, the gate driving circuit according to the comparison example can output an abnormal signal as shown in FIG. 13A as the voltage charging rate of the first control nodes Qo and Qe is deteriorated by the on-current deterioration of the TFT.

Referring to FIG. 12B, according to one embodiment of the present disclosure, the first control nodes Qo and Qe embodied in each stage circuit ST[n] can be charged with the first gate high potential voltage GVdd1 supplied from the first gate high potential voltage line through the first and second TFTs T1 and T2 turned on by the (n−3)th carry signal CS[n−3] of the high voltage output from the front stage circuit ST[n−3]. At this time, the first gate high potential voltage GVdd1 can be charged in the first control nodes Qo and Qe by passing through the first TFT T1 and the second TFT T2 from the first gate high potential voltage line. Therefore, in one embodiment of the present disclosure, the voltage charging rate of the first control nodes Qo and Qe can be improved by resistance component reduction based on reduction of the number of the TFTs disposed on the charging path of the first control nodes Qo and Qe in comparison with the comparison example. Also, in one embodiment of the present disclosure, the first gate high potential voltage GVdd1 of a direct current voltage not the carry clock according to the comparison example can be discharged in the first control nodes Qo and Qe, whereby voltage charging capacity of the first control nodes Qo and Qe can be improved. Therefore, in one embodiment of the present disclosure, the voltage charging capacity of the first control nodes Qo and Qe can remarkably be improved, whereby an output characteristic of the output signal can be improved as shown in FIG. 13A. As a result, in one embodiment of the present disclosure, an error operation of the gate driving circuit, which is caused by deterioration of the voltage charging rate of the first control nodes Qo and Qe based on on-current or mobility deterioration of the TFT by degradation or threshold voltage shift of the TFT, can be avoided.

Figure 14A:
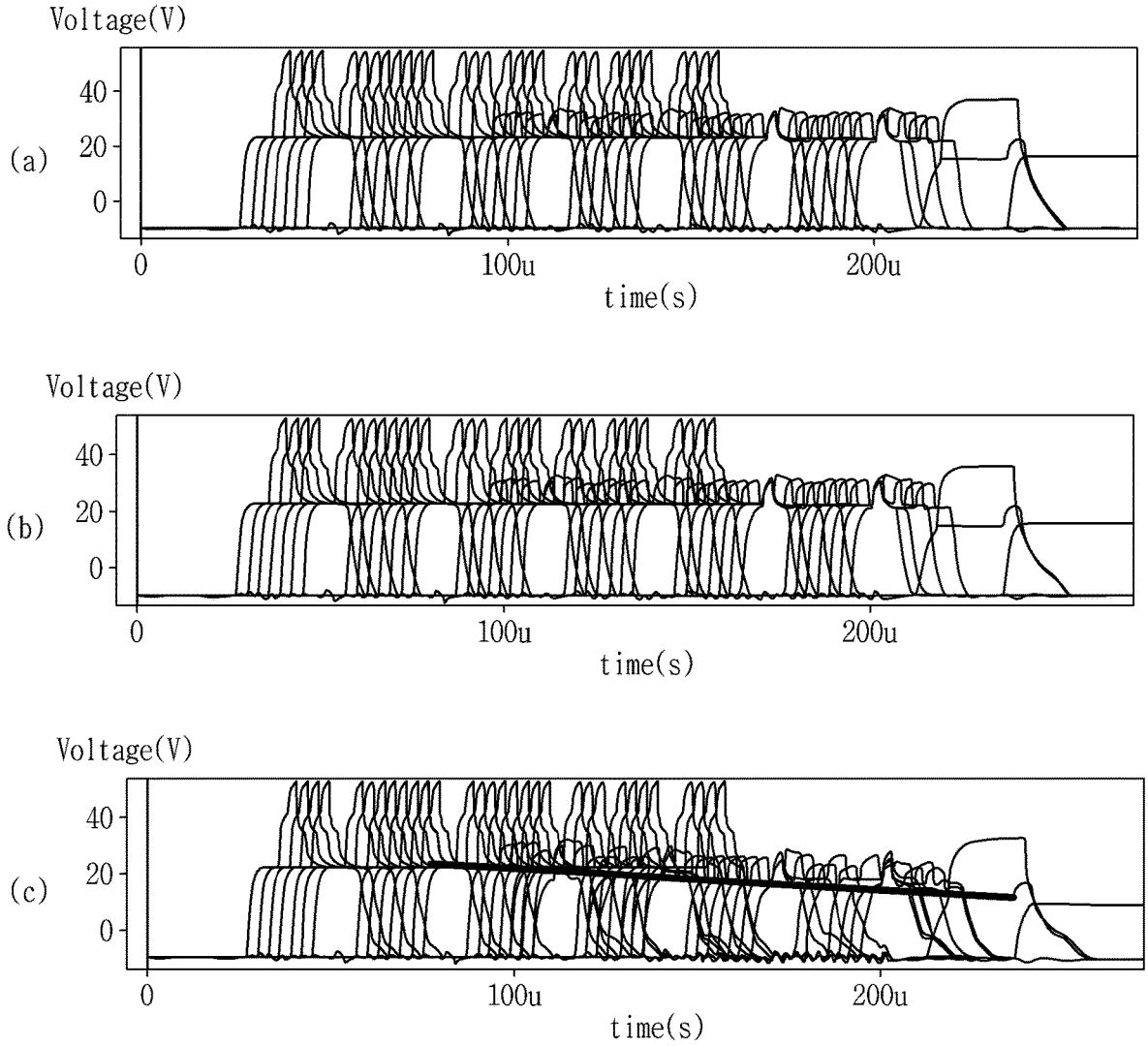
FIGS. 14A and 14B are views illustrating charging voltage waveforms of a first control node of each of gate driving circuits according to one embodiment of the present disclosure and a comparison example.
Figure 14B:
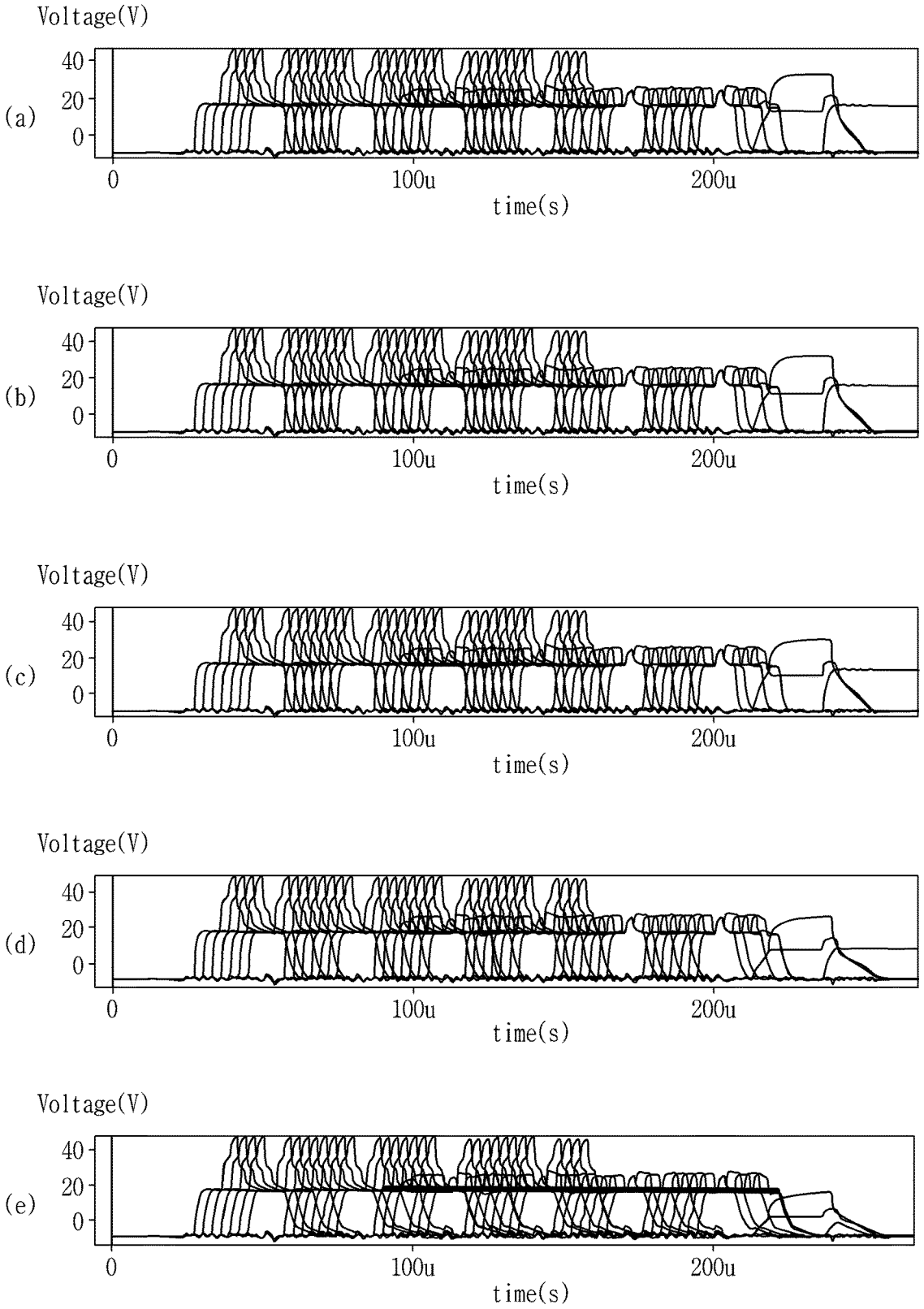

FIGS. 14A and 14B are views illustrating charging voltage waveforms of a first control node of each of gate driving circuits according to one embodiment of the present disclosure and a comparison example. The comparison example shown in FIG. 14A denotes charging voltage waveforms of the first control node when the on-current characteristic of the first TFT is deteriorated to 30% (see (a) of FIG. 14A), 40% (see (b) of FIG. 14A) and 50% (see (c) of FIG. 14A). One embodiment of the present disclosure shown in FIG. 14B denotes charging voltage waveforms of the first control node when the on-current characteristic of the first TFT is deteriorated to 40% (see (a) of FIG. 14B), 50% (see (b) of FIG. 14B), 60% (see (c) of FIG. 14B), 70% (see (d) of FIG. 14B) and 80% (see (e) of FIG. 14B).

As will be aware from FIG. 14A, it is noted that voltage charging of the first control node according to the comparison example is normally performed when the on-current characteristic of the first TFT is deteriorated to 30% (see (a) of FIG. 14A) and 40% (see (b) of FIG. 14A) but is not performed normally when the on-current characteristic of the first TFT is deteriorated to 50% (see (c) of FIG. 14A). Therefore, the gate driving circuit according to the comparison example can be operated in error due to deterioration of the voltage charging rate of the first control node when the on-current characteristic of the first TFT is deteriorated to 50% (see (c) of FIG. 14A) or more.

As will be aware from FIG. 14B, it is noted that voltage charging of the first control node according to one embodiment of the present disclosure is normally performed when the on-current characteristic of the first TFT is deteriorated to 40% (see (a) of FIG. 14B), 50% (see (b) of FIG. 14B), 60% (see (c) of FIG. 14B) and 70% (see (d) of FIG. 14B) but is not performed normally when the on-current characteristic of the first TFT is deteriorated to 80% (see (e) of FIG. 14B). Therefore, the gate driving circuit according to one embodiment of the present disclosure can be operated normally when the on-current characteristic of the first TFT is deteriorated to a level less than 80% (see (e) of FIG. 14B), due to improvement of the voltage charging rate of the first control node. Therefore, in one embodiment of the present disclosure, reliability of the gate driving circuit can be improved for deterioration of the on-current characteristic of the first TFT.

A gate driving circuit and a light emitting display apparatus comprising the same according to one or more embodiments of the present disclosure will be described below.

A gate driving circuit according to one embodiment of the present disclosure comprises first to mth stage circuits, the each of the first to mth stage circuits includes first to third control nodes, a node control circuit controlling a voltage of each of the first to third control nodes, and an output buffer circuit outputting each of a scan signal, a sense signal and a carry signal in accordance with each of the first to third control nodes, and the node control circuit includes a node setup circuit charging a first gate high potential voltage in the first control node in response to a first carry signal supplied from a front stage circuit.

According to one embodiment of the present disclosure, the first gate high potential voltage can be supplied to the first control node by passing through two thin film transistors from a first gate high potential voltage line.

According to one embodiment of the present disclosure, the node setup circuit can include first and second thin film transistors electrically connected between the first gate high potential voltage line transferring the first gate high potential voltage and the first control node in series and together turned on by the first front carry signal of a first voltage.

According to one embodiment of the present disclosure, the node setup circuit can further include a third thin film transistor always supplying a second gate high potential voltage to a first connection node between the first thin film transistor and the second thin film transistor.

According to one embodiment of the present disclosure, the second gate high potential voltage can be lower than the first gate high potential voltage.

According to one embodiment of the present disclosure, the third thin film transistor can include (3-1)th and (3-2)th thin film transistors electrically connected between a second gate high potential voltage line transferring the second gate high potential voltage and the first control node in series and together turned on by the second gate high potential voltage.

According to one embodiment of the present disclosure, the second control node embodied in the nth stage circuit of the first to mth stage circuits can be electrically connected with the third control node embodied in an (n+1)th stage circuit, and the third control node embodied in the nth stage circuit can be electrically connected with the second control node embodied in the (n+1)th stage circuit.

According to one embodiment of the present disclosure, each of the first to mth stage circuits can further include an inverter circuit controlling the voltage of the second control node in accordance with the voltage of the first control node, and a node reset circuit resetting the voltage of the second control node to a gate low potential voltage in response to the first front carry signal.

According to one embodiment of the present disclosure, the inverter circuit of the nth stage circuit can additionally control the voltage of the second control node of the nth stage circuit in accordance with the voltage of the first control node of the (n+1)th stage circuit, and the inverter circuit of the (n+1)th stage circuit can additionally control the voltage of the second control node of the (n+1)th stage circuit in accordance with the voltage of the first control node of the nth stage circuit.

According to one embodiment of the present disclosure, each of the first to mth stage circuits can include a memory node, and a sensing control circuit controlling each of a voltage of the memory node and the voltage of the first control node, and the sensing control circuit of the nth stage circuit can further include a sensing control circuit controlling the voltage of the memory node in response to a line sensing preparation signal and a second front carry signal supplied from the front stage circuit, outputting the first gate high potential voltage to a sharing node in accordance with the voltage of the memory node, and supplying the first gate high potential voltage to the first control node in response to a first reset signal and the voltage of the memory node.

According to one embodiment of the present disclosure, the sensing control circuit of each of the first to mth stage circuits can reset the voltage of the first control node to the gate low potential voltage in response to a display panel on signal.

According to one embodiment of the present disclosure, the node reset circuit of the nth stage circuit can discharge the voltage of the first control node of the nth stage circuit with the gate low potential voltage in response to the first reset signal and the voltage of the memory node, and discharge the voltage of the first control node of the nth stage circuit with the gate low potential voltage in response to a second reset signal and the voltage of the memory node.

According to one embodiment of the present disclosure, the sensing control circuit of the (n+1)th stage circuit can be electrically connected with the memory node of the nth stage circuit, and supply the first gate high potential voltage supplied through a sharing node of the nth stage circuit to the first control node of the (n+1)th stage circuit in response to the first reset signal.

According to one embodiment of the present disclosure, the node reset circuit of the (n+1)th stage circuit can discharge the voltage of the first control node with the gate low potential voltage in response to the first reset signal and the voltage of the memory node, and discharge the voltage of the first control node of the (n+1)th stage circuit with the gate low potential voltage in response to the second reset signal and the voltage of the memory node.

According to one embodiment of the present disclosure, each of the first to mth stage circuits can sequentially output the scan signal, the sense signal and the carry signal for a vertical active period of each frame period, and any one of the first to mth stage circuits can output the scan signal and the sense signal for a vertical blank period of each frame period.

A light emitting display apparatus according to one embodiment of the present disclosure comprises a light emitting display panel including a plurality of pixels, a plurality of gate line groups having first and second gate lines connected to the plurality of pixels, and a plurality of data and reference lines connected to the plurality of pixels, crossing the plurality of gate line groups, a gate driving circuit portion connected to the plurality of gate line groups, a data driving circuit portion connected to the plurality of data lines and the plurality of reference lines; and a timing controller controlling a driving timing of each of the gate driving circuit portion and the data driving circuit portion, and the gate driving circuit comprises first to mth stage circuits, and each of the first to mth stage circuits includes first to third control nodes, a node control circuit controlling a voltage of each of the first to third control nodes, and an output buffer circuit outputting each of a scan signal, a sense signal and a carry signal in accordance with each of the first to third control nodes, and the node control circuit includes a node setup circuit charging a first gate high potential voltage in the first control node in response to a first carry signal supplied from a front stage circuit.

According to one embodiment of the present disclosure, the timing controller can control the light emitting display panel in a display mode and a sensing mode, the gate driving circuit portion can supply a scan signal and a sense signal to any one of the plurality of gate line groups in the sensing mode, and the data driving circuit portion can supply a sensing data voltage synchronized with the scan signal to the plurality of data lines and senses driving characteristics of the pixels through the plurality of reference lines in the sensing mode.

According to one embodiment of the present disclosure, the timing controller can control the display mode in an image display period and a black display period, the gate driving circuit portion can supply only the scan signal to a first gate line corresponding to at least one of the plurality of gate line groups at the black display period, and the data driving circuit portion can supply a black data voltage synchronized with the scan signal to the plurality of data lines at the black display period.

According to one embodiment of the present disclosure, each of the plurality of pixels can display an image at the image display period and displays a black image at the black display period.

According to one embodiment of the present disclosure, the gate driving circuit portion can sequentially supply the scan signal and the sense signal to the plurality of gate line groups at a vertical active period of each frame period, and output the scan signal and the sense signal to any one of the plurality of gate line groups at a vertical blank period of each frame period.

A gate driving circuit and light emitting display apparatus including the same according to an embodiment of the present disclosure can be applied to all electronic apparatus including a light emitting display panel and/or a gate driving circuit built in the light emitting display panel. Example, gate driving circuit and light emitting display apparatus including the same according to an embodiment of the present disclosure can be applied to mobile devices, video phones, smart watches, watch phones, wearable devices, foldable devices, rollable devices, bendable devices, flexible devices, curved devices, portable multimedia players (PMPs), personal digital assistants (PDAs), electronic organizers, desktop personal computers (PCs), laptop PCs, netbook computers, workstations, navigation devices, automotive navigation devices, automotive display apparatuses, televisions (TVs), wall paper display apparatuses, signage devices, game machines, notebook computers, monitors, cameras, camcorders, home appliances, etc.

It will be apparent to those skilled in the art that the present disclosure described above is not limited by the above-described embodiments and the accompanying drawings and that various substitutions, modifications, and variations can be made in the present disclosure without departing from the spirit or scope of the disclosures. Consequently, the scope of the present disclosure is defined by the accompanying claims, and it is intended that all variations or modifications derived from the meaning, scope, and equivalent concept of the claims fall within the scope of the present disclosure.

The various embodiments described above can be combined to provide further embodiments. All of the U.S. patents, U.S. patent application publications, U.S. patent applications, foreign patents, foreign patent applications and non-patent publications referred to in this specification and/or listed in the Application Data Sheet are incorporated herein by reference, in their entirety. Aspects of the embodiments can be modified, if necessary to employ concepts of the various patents, applications and publications to provide yet further embodiments.

These and other changes can be made to the embodiments in light of the above-detailed description. In general, in the following claims, the terms used should not be construed to limit the claims to the specific embodiments disclosed in the specification and the claims, but should be construed to include all possible embodiments along with the full scope of equivalents to which such claims are entitled. Accordingly, the claims are not limited by the disclosure.

What is claimed is:

1. A gate driving circuit comprising:

first to mth stage circuits where m is a positive number, each of the first to mth stage circuits including:

first to third control nodes;

a node control circuit configured to control a voltage of each of the first to third control nodes; and an output buffer circuit configured to output each of a scan signal, a sense signal and a carry signal in accordance with each of the first to third control nodes, wherein the node control circuit includes a node setup circuit configured to charge a first gate high potential voltage to the first control node in response to a first front carry signal supplied from a front stage circuit, and wherein the node setup circuit includes:

first and second thin film transistors electrically connected between a first gate high potential voltage line transferring the first gate high potential voltage and the first control node in series and together turned on by the first front carry signal of a first voltage; and a third thin film transistor always supplying a second gate high potential voltage to a first connection node between the first thin film transistor and the second thin film transistor, and being turned on by the second gate high potential voltage.

2. The gate driving circuit of claim 1, wherein the second gate high potential voltage is lower than the first gate high potential voltage.

3. The gate driving circuit of claim 1, wherein the third thin film transistor includes (3-1)th and (3-2)th thin film transistors electrically connected between a second gate high potential voltage line transferring the second gate high potential voltage and the first control node in series and together turned on by the second gate high potential voltage.

4. The gate driving circuit of claim 1, wherein the second control node embodied in the nth stage circuit of the first to mth stage circuits is electrically connected with the third control node embodied in an (n+1)th stage circuit, where n is a number, and the third control node embodied in the nth stage circuit is electrically connected with the second control node embodied in the (n+1)th stage circuit.

5. The gate driving circuit of claim 4, wherein each of the first to mth stage circuits further includes:

an inverter circuit configured to control the voltage of the second control node in accordance with the voltage of the first control node; and a node reset circuit configured to reset the voltage of the second control node to a gate low potential voltage in response to the first front carry signal.

6. The gate driving circuit of claim 5, wherein the inverter circuit of the nth stage circuit additionally controls the voltage of the second control node of the nth stage circuit in accordance with the voltage of the first control node of the (n+1)th stage circuit, and the inverter circuit of the (n+1)th stage circuit additionally controls the voltage of the second control node of the (n+1)th stage circuit in accordance with the voltage of the first control node of the nth stage circuit.

7. The gate driving circuit of claim 5, wherein each of the first to mth stage circuits includes:

a memory node; and a sensing control circuit configured to control each of a voltage of the memory node and the voltage of the first control node, and the sensing control circuit of the nth stage circuit further includes a sensing control circuit controlling the voltage of the memory node in response to a line sensing preparation signal and a second front carry signal supplied from the front stage circuit, outputting the first gate high potential voltage to a sharing node in accordance with the voltage of the memory node, and supplying the first gate high potential voltage to the first control node in response to a first reset signal and the voltage of the memory node.

8. The gate driving circuit of claim 7, wherein the sensing control circuit of each of the first to mth stage circuits resets the voltage of the first control node to the gate low potential voltage in response to a display panel on signal.

9. The gate driving circuit of claim 7, wherein the node reset circuit of the nth stage circuit discharges the voltage of the first control node of the nth stage circuit with the gate low potential voltage in response to the first reset signal and the voltage of the memory node, and discharges the voltage of the first control node of the nth stage circuit with the gate low potential voltage in response to a second reset signal and the voltage of the memory node.

10. The gate driving circuit of claim 7, wherein the sensing control circuit of the (n+1)th stage circuit is electrically connected with the memory node of the nth stage circuit, and supplies the first gate high potential voltage supplied through a sharing node of the nth stage circuit to the first control node of the (n+1)th stage circuit in response to the first reset signal.

11. The gate driving circuit of claim 10, wherein the node reset circuit of the (n+1)th stage circuit discharges the voltage of the first control node with the gate low potential voltage in response to the first reset signal and the voltage of the memory node, and discharges the voltage of the first control node of the (n+1)th stage circuit with the gate low potential voltage in response to the second reset signal and the voltage of the memory node.

12. The gate driving circuit of claim 1, wherein each of the first to mth stage circuits sequentially outputs the scan signal, the sense signal and the carry signal for a vertical active period of each frame period, and any one of the first to mth stage circuits outputs the scan signal and the sense signal for a vertical blank period of each frame period.

13. A light emitting display apparatus comprising:

a light emitting display panel including a plurality of pixels, a plurality of gate line groups having first and second gate lines connected to the plurality of pixels, and a plurality of data and reference lines connected to the plurality of pixels, crossing the plurality of gate line groups;

a gate driving circuit portion connected to the plurality of gate line groups;

a data driving circuit portion connected to the plurality of data lines and the plurality of reference lines; and a timing controller configured to control a driving timing of each of the gate driving circuit portion and the data driving circuit portion, wherein the gate driving circuit portion includes the gate driving circuit of claim 1.

14. The light emitting display apparatus of claim 13, wherein the timing controller controls the light emitting display panel in a display mode and a sensing mode, the gate driving circuit portion supplies a scan signal and a sense signal to any one of the plurality of gate line groups in the sensing mode, and the data driving circuit portion supplies a sensing data voltage synchronized with the scan signal to the plurality of data lines and senses driving characteristics of the pixels through the plurality of reference lines in the sensing mode.

15. The light emitting display apparatus of claim 14, wherein the timing controller controls the display mode in an image display period and a black display period, the gate driving circuit portion supplies only the scan signal to a first gate line corresponding to at least one of the plurality of gate line groups at the black display period, and the data driving circuit portion supplies a black data voltage synchronized with the scan signal to the plurality of data lines at the black display period.

16. The light emitting display apparatus of claim 15, wherein each of the plurality of pixels displays an image at the image display period and displays a black image at the black display period.

17. The light emitting display apparatus of claim 13, wherein the gate driving circuit portion sequentially supplies the scan signal and the sense signal to the plurality of gate line groups at a vertical active period of each frame period, and outputs the scan signal and the sense signal to any one of the plurality of gate line groups at a vertical blank period of each frame period.

18. A gate driving circuit comprising:

first to mth stage circuits where m is a positive number, each of the first to mth stage circuits including:

first to third control nodes;

a node control circuit configured to control a voltage of each of the first to third control nodes; and an output buffer circuit configured to output each of a scan signal, a sense signal and a carry signal in accordance with each of the first to third control nodes, wherein the node control circuit includes a node setup circuit configured to charge a first gate high potential voltage to the first control node in response to a first front carry signal supplied from a front stage circuit, wherein the second control node embodied in the nth stage circuit of the first to mth stage circuits is electrically connected with the third control node embodied in an (n+1)th stage circuit, where n is a number, and the third control node embodied in the nth stage circuit is electrically connected with the second control node embodied in the (n+1)th stage circuit.

19. A gate driving circuit comprising:

first to mth stage circuits where m is a positive number, each of the first to mth stage circuits including:

first to third control nodes;

a node control circuit configured to control a voltage of each of the first to third control nodes; and an output buffer circuit configured to output each of a scan signal, a sense signal and a carry signal in accordance with each of the first to third control nodes, wherein the node control circuit includes a node setup circuit configured to charge a first gate high potential voltage to the first control node in response to a first front carry signal supplied from a front stage circuit, and wherein each of the first to mth stage circuits sequentially outputs the scan signal, the sense signal and the carry signal for a vertical active period of each frame period, and any one of the first to mth stage circuits outputs the scan signal and the sense signal for a vertical blank period of each frame period.

* * * * *